US012644266B2

(12) United States Patent
Kashimura et al.

(10) Patent No.: US 12,644,266 B2
(45) Date of Patent: Jun. 2, 2026

(54) FLUSH TOILET DEVICE

(71) Applicant: TOTO LTD., Kitakyushu (JP)

(72) Inventors: Hideaki Kashimura, Kitakyushu (JP); Daichi Okada, Kitakyushu (JP); Ayako Habu, Kitakyushu (JP); Satoshi Matsunaka, Kitakyushu (JP); Seika Tatsuoka, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 137 days.

(21) Appl. No.: 18/800,587

(22) Filed: Aug. 12, 2024

(65) Prior Publication Data

US 2025/0059749 A1 Feb. 20, 2025

(30) Foreign Application Priority Data

Aug. 16, 2023 (JP) ..... 2023-132411
Aug. 16, 2023 (JP) ..... 2023-132527
Aug. 16, 2023 (JP) ..... 2023-132528

(51) Int. Cl.
*E03D 1/26* (2006.01)
*E03D 1/33* (2006.01)
(Continued)

(52) U.S. Cl.
CPC ..... *E03D 1/26* (2013.01); *E03D 1/33* (2013.01); *E03D 1/34* (2013.01); *E03D 5/024* (2013.01)

(58) Field of Classification Search
CPC .... E03D 1/26; E03D 1/30; E03D 1/32; E03D 1/33; E03D 1/34; E03D 1/36; E03D 5/024; E03D 5/09; E03D 11/08; E03D 2201/40
(Continued)

(56) References Cited

U.S. PATENT DOCUMENTS

2007/0061955 A1 3/2007 Asada et al.
2015/0013058 A1* 1/2015 Bucher ..... E03D 9/037 4/378
(Continued)

FOREIGN PATENT DOCUMENTS

JP H07-180202 A 7/1995
JP 2004-100182 A 4/2004
(Continued)

OTHER PUBLICATIONS

"Decision to Grant a Patent" mailed by the Japanese Patent Office on Jul. 17, 2025, which corresponds to Japanese Patent Application No. 2023-132411 and is related to U.S. Appl. No. 18/800,587; with English language translation.
(Continued)

*Primary Examiner* — Tuan N Nguyen
(74) *Attorney, Agent, or Firm* — Studebaker Brackett PLLC

(57) ABSTRACT

Provided is a flush toilet device in which flushing can be effectively performed with small amount of flush water by accurately setting opening times for individual drain valves. A flush toilet device (1) of the present invention includes a flush toilet main body (2), a flush water tank (4), a first drain valve (10) configured to control flush water from a rim spout port (2d) by opening and closing a first drain port (4b) provided in the flush water tank, a second drain valve (12) configured to control flush water from a jet spout port (2e) by opening and closing a second drain port (4c) provided in the flush water tank, and a hydraulic drive mechanism (16) configured to open the first or second drain valve by using water supply pressure of flush water supplied from a tap water supply line to the flush water tank.

19 Claims, 31 Drawing Sheets

(51) Int. Cl.
*E03D 1/34* (2006.01)
*E03D 5/02* (2006.01)

(58) Field of Classification Search
USPC .... 4/324–326, 345–346, 378, 379, 395–401, 4/405, 407, 415, 425
See application file for complete search history.

(56) References Cited

U.S. PATENT DOCUMENTS

| | | | | |
|---|---|---|---|---|
| 2015/0197928 | A1* | 7/2015 | McHale | E03D 11/08 4/422 |
| 2023/0065471 | A1 | 3/2023 | Tanimoto et al. | |
| 2023/0066417 | A1 | 3/2023 | Hashimoto et al. | |
| 2023/0069634 | A1 | 3/2023 | Tanimoto et al. | |

FOREIGN PATENT DOCUMENTS

| | | | |
|---|---|---|---|
| JP | 2006-132122 | A | 5/2006 |
| JP | 2018-100575 | A | 6/2018 |
| JP | 2023-032963 | A | 3/2023 |
| WO | 2005/085538 | A1 | 9/2005 |

OTHER PUBLICATIONS

"Decision to Grant a Patent" mailed by the Japanese Patent Office on Jul. 17, 2025, which corresponds to Japanese Patent Application No. 2023-132527 and is related to U.S. Appl. No. 18/800,587; with English language translation.

"Decision to Grant a Patent" mailed by the Japanese Patent Office on Jul. 17, 2025, which corresponds to Japanese Patent Application No. 2023-132528 and is related to U.S. Appl. No. 18/800,587; with English language translation.

* cited by examiner

FLUSH TOILET DEVICE

TECHNICAL FIELD

The present invention relates to a flush toilet device, and more particularly to a flush toilet device that performs flushing with flush water stored in a flush water tank.

BACKGROUND ART

In a typical tank-type flush toilet device in the prior art, a single drain valve is provided in a flush water tank, and flush water discharged from the flush water tank is directed to a rim spout port and a jet spout port and spouted from each spout port. That is, a water conduit formed in a flush toilet main body branches into conduits in the middle thereof, leading flush water to the rim spout port and the jet spout port.

WO 2005/085538 (Patent Document 1) describes a flush toilet. This flush toilet is a tank-type flush toilet and is provided with a tank that stores flush water for rim spouting and a tank that stores flush water for jet spouting. The flush water tank for rim spouting is provided with a drain valve for rim spouting and the flush water tank for jet spouting is provided with a drain valve for jet spouting. Opening these drain valves results in spouting from the rim spout port and the jet spout port, respectively.

On the other hand, JP 2018-100575 A (Patent Document 2) describes a flush toilet. This flush toilet includes a toilet main body, a storage tank, a pressure pump that pressurizes and sends flush water stored in the storage tank to the toilet main body, and a water supply channel switching valve that switches the supply destination of the flush water supplied from a tap water supply line. In this flush toilet, the pressure pump and the water supply channel switching valve are controlled to execute different flushing sequences when a full flush is executed and when a light flush is executed. This makes it possible to spout flush water in an appropriate amount from each spout port of the toilet main body at appropriate times for the full flush and the light flush. As a result, effective toilet flushing is achieved with minimal flush water.

CITATION LIST

Patent Literature

Patent Document 1: WO 2005/085538
Patent Document 2: JP 2018-100575 A

SUMMARY OF INVENTION

Technical Problem

However, in the flush toilet device provided with a single drain valve in the prior art, spouting from the rim spout port and the jet spout port is started substantially simultaneously. Accordingly, the flush water is not always spouted from the appropriate spout port at the appropriate time, and thus some of the flush water is not fully utilized during flushing. That is, water waste occurs because the flush water is not fully utilized during flushing.

On the other hand, in the flush toilet described in Patent Document 1, because separate drain valves are provided for rim spouting and jet spouting, spouting from the rim spout port and the jet spout port can be started at different times. However, since the flush toilet described in Patent Document 1 has a structure in which each drain valve is pulled up by a bead chain connected to an operation lever, it is not possible to set the start times for spouting from each drain port as desired. Therefore, even in the flush toilet described in Patent Document 1, a sufficient water saving effect cannot be obtained.

Further, in the flush toilet device provided with a single drain valve in the prior art, the spouting and the stopping of the flush water from the rim spout port and the jet spout port are controlled by the single drain valve. Thus, it is not possible to correctly set end time points for the spouting from each spout port. This results in cases where the refill water after the discharge of waste from the bowl becomes excessive and the excess flush water flows out from the trap conduit and is wasted.

On the other hand, in the flush toilet described in Patent Document 1, because drain valves are provided for rim spouting and jet spouting, it is possible to independently control the spouting and stopping from the rim spout port and the jet spout port. However, since the flush toilet described in Patent Document 1 has the structure in which each drain valve is pulled up by a bead chain connected to an operation lever, it is not possible to set the start times for stopping of spouting from each spout port as desired. Therefore, even in the flush toilet described in Patent Document 1, a sufficient water saving effect cannot be obtained.

Further, in the flush toilet described in Patent Document 2, some of the flush water used for flushing is discharged by the supply pressure of the water supplied from the tap water supply line, resulting in malfunctions such as an insufficient amount of flush water and an inability to perform sufficient flushing in a case where, for example, the flush toilet is installed in an area where water supply pressure is low. Further, in the flush toilet described in Patent Document 1, it is necessary to control the pressure pump and the switching valve to execute the flushing sequences for a full flush and a light flush, resulting in the problem that the flushing device increases in complexity and in cost.

Accordingly, an object of the present invention is to provide a flush toilet device that can effectively perform flushing with small amount of flush water by accurately setting opening times for individual drain valves.

Further, an object of the present invention is to provide a flush toilet device that executes different flushing sequences for a full flush and a light flush to effectively flush a toilet while supplying an entire amount of flush water used for flushing from a flush water tank.

Solution to Problem

To solve the problems described above, a flush toilet device according to the present invention is a flush toilet device configured to perform flushing with flush water stored in a flush water tank. The flush toilet device includes a flush toilet main body including a bowl and a drain trap conduit extending from a lower portion of the bowl, a flush water tank disposed at a rear portion of the flush toilet main body and configured to store flush water for flushing the bowl of the flush toilet main body, a first drain valve configured to switch between spouting and stopping flush water from a rim spout port provided at an upper edge portion of the bowl by opening and closing a first drain port provided in the flush water tank, a second drain valve configured to switch between spouting and stopping flush water from a jet spout port provided in the lower portion of the bowl by opening and closing a second drain port provided in the flush water tank, and a hydraulic drive mechanism configured to open the first drain valve or the second drain valve by using water supply pressure of flush water supplied from a tap water supply line to the flush water tank.

According to the present invention configured as described above, the spouting and stopping of flush water from the rim spout port are switched by the first drain valve and the spouting and stopping of flush water from the jet spout port are switched by the second drain valve. With this configuration, it is possible to independently set the times for rim spouting and jet spouting as desired and effectively flush the bowl of the flush toilet main body with small amount of flush water. Further, since the first drain valve or the second drain valve is opened by the hydraulic drive mechanism by using the supply pressure of the flush water, it is unnecessary to pull up the drain valve with electric power such as that generated by a motor, and thus the opening time of the drain valve can be set without the use of a complex mechanism for opening the drain valve.

In the present invention, preferably, the flush toilet device further includes a delay mechanism, and one of the first drain valve and the second drain valve is opened later than the other by the delay mechanism during flushing of the bowl.

In flush toilet devices in the prior art that execute spouting from a rim spout port and a jet spout port using a single drain valve, spouting is started substantially simultaneously from the rim spout port and the jet spout port. Thus, spouting is performed at times not always necessary, and some of the flush water is wasted. According to the present invention configured as described above, since one of the first drain valve and the second drain valve is opened later than the other by the delay mechanism, it is possible to start the spouting from the rim spout port and the jet spout port at necessary times depending on the configuration of the flush toilet main body and effectively flush the bowl while suppressing the amount of flush water.

In the present invention, preferably, the hydraulic drive mechanism is configured to open the second drain valve.

According to the present invention configured as described above, the second drain valve is opened by the hydraulic drive mechanism, making it possible to adjust the time at which flush water is supplied to the hydraulic drive mechanism and thus adjust the time at which the spouting from the jet spout port is started and set the start time of jet spouting as desired.

In the present invention, preferably, the delay mechanism includes a ball tap configured to operate in association with a water level in the flush water tank, and flush water is supplied to the hydraulic drive mechanism when a float of the ball tap has lowered to a predetermined position.

According to the present invention configured as described above, since flush water is supplied to the hydraulic drive mechanism when the float of the ball tap has lowered to the predetermined position, it is possible to start the supply of flush water to the hydraulic drive mechanism and start the spouting from the jet spout port at appropriate times on the basis of the water level in the flush water tank.

In the present invention, preferably, the delay mechanism includes a ball tap having a float, a small tank provided with a discharge hole and disposed surrounding the float in the flush water tank, and a check valve float configured to open the discharge hole of the small tank when a water level in the flush water tank drops to a predetermined water level, and flush water is supplied to the hydraulic drive mechanism when a water level in the small tank has dropped to a predetermined water level.

According to the present invention configured as described above, the delay mechanism includes the small tank and the check valve float, and flush water is supplied to the hydraulic drive mechanism when the water level in the small tank has lowered to a predetermined water level. As a result, due to the configuration of the small tank and the like, it is possible to set the time at which flush water is supplied to the hydraulic drive mechanism as desired and start spouting at a time suitable for flushing.

In the present invention, preferably, the delay mechanism includes a first ball tap configured to start water supply into the flush water tank when a water level in the flush water tank has lowered to a predetermined first water level, and a second ball tap configured to start supply of flush water to the hydraulic drive mechanism when the water level in the flush water tank drops to a predetermined second water level lower than the first water level.

According to the present invention configured as described above, the delay mechanism includes the first ball tap configured to start water supply into the flush water tank at the first water level and the second ball tap configured to start supply of flush water to the hydraulic drive mechanism at the second water level lower than the first water level. As a result, by setting the second ball tap, it is possible to set a time at which flush water is supplied to the hydraulic drive mechanism as desired and start spouting at a time suitable for flushing.

In the present invention, preferably, the flush water tank is provided with a partition wall partitioning the flush water tank into a first tank portion provided with the first drain port and a second tank portion provided with the second drain port.

In a case in which the first drain valve and the second drain valve are provided in a single flush water tank, even if the valves are each opened at predetermined times, the amount of flush water spouted from the rim spout port and the jet spout port varies for each flush toilet main body combined due to variation in flow channel resistance of the flush water conduit provided in the flush toilet main body. According to the present invention configured as described above, since the first tank portion provided with the first drain port and the second tank portion provided with the second drain port are partitioned by the partition wall, it is possible to suppress variations in the amount of flush water spouted from each spout port. As a result, it is possible to perform appropriate flushing of the bowl while suppressing the amount of flush water and appropriately set a retained water level in the bowl after completion of one flush of toilet.

In the present invention, preferably, the first drain valve is configured to close in association with a drop in water level in the first tank portion, the second drain valve is configured to close in association with a drop in water level in the second tank portion, and by setting a pressure loss in a rim conduit through which the first drain port and the rim spout port are in communication with each other greater than a pressure loss in a jet conduit through which the second drain port and the jet spout port are in communication with each other, a water level in the second tank portion is caused to drop earlier than a water level in the first tank portion, closing the second drain valve earlier than the first drain valve.

According to the present invention configured as described above, the pressure loss of the rim conduit is set greater than the pressure loss of the jet conduit, making a flow amount of flush water flowing out from the first tank portion per unit time less than a flow amount of flush water flowing out from the second tank portion per unit time. As a result, the water level in the first tank portion drops more gradually than the water level in the second tank portion, and the spouting of flush water from the rim spout port in the first tank portion continues even after the water level in the second tank portion drops and the second drain valve is closed. Thus, even after the spouting from the jet spout port is completed, the spouting from the rim spout port is continued. Accordingly, it is possible to set the level of water retained in the bowl to an appropriate water level by refilling.

In the present invention, preferably, the first drain valve is configured to close in association with a drop in water level in the first tank portion, the second drain valve is configured to close in association with a drop in water level in the second tank portion, and the first tank portion is formed with a volume larger than a volume of the second tank portion, so that the water level in the second tank portion drops earlier than the water level in the first tank portion, closing the second drain valve earlier than the first drain valve.

According to the present invention configured as described above, the first tank portion is formed with the volume larger than the volume of the second tank portion, so that the water level in the first tank portion drops more gradually than the water level in the second tank portion. As a result, the spouting of flush water from the rim spout port in the first tank portion continues even after the water level in the second tank portion drops and the second drain valve is closed. Thus, even after the spouting from the jet spout port is completed, the spouting from the rim spout port is continued. Accordingly, it is possible to set the retained water level in the bowl to an appropriate water level by refilling.

In the present invention, preferably, the partition wall of the flush water tank is provided with a small hole through which the first tank portion and the second tank portion are in communication with each other at a predetermined water level.

According to the present invention configured as described above, the partition wall of the flush water tank is provided with the small hole through which the first tank portion and the second tank portion are in communication with each other at a predetermined water level. With this configuration, when the water level in the second tank portion is higher than the water level in the first tank portion, flush water flows from the second tank portion into the first tank portion. As a result, a drop in the water level of the first tank portion is delayed, making it possible to lengthen the time period during which the first drain valve is open. Therefore, the amount of flush water spouted from the rim spout port can be increased, and spouting from the rim spout port is continued even after spouting from the jet spout port is completed. Thus, refilling is performed, and the level of water retained in the bowl can be set to an appropriate water level.

In the present invention, preferably, the flush toilet device further includes an operation unit configured to selectively execute a full flush mode and a light flush mode, the light flush mode being a mode in which a smaller amount of flush water is supplied to the bowl than in the full flush mode, when the full flush mode is executed, flush water is supplied to the bowl by opening the first drain valve and then, after a predetermined time period elapses, opening the second drain valve and, when the light flush mode is executed, the first drain valve and the second drain valve are opened simultaneously or the first drain valve is opened and then the second drain valve is opened before the predetermined time period elapses.

According to the present invention configured as described above, the spouting and stopping of flush water from the rim spout port are switched by the first drain valve and the spouting and stopping of flush water from the jet spout port are switched by the second drain valve. With this configuration, it is possible to independently set the times for rim spouting and jet spouting as desired while supplying all flush water used for flushing from the flush water tank. Thus, the bowl of the flush toilet main body can be effectively flushed with flush water stored in the flush water tank. Here, rim spouting at the start of toilet flushing mainly has a function of rinsing away waste adhering to a waste receiving surface of the bowl, and jet spouting mainly has a function of pushing out waste and retained water in the bowl to a drain trap conduit. Therefore, for a light flush in which the amount of waste adhering to the bowl is small, there is little need to perform rim spouting prior to the start of toilet flushing. According to the present invention configured as described above, during execution of the full flush mode, flush water is supplied to the bowl by opening the first drain valve and then, after a predetermined time period elapses, opening the second drain valve and, during execution of the light flush mode, the first drain valve and the second drain valve are opened simultaneously or the first drain valve is opened and then the second drain valve is opened before the predetermined time period elapses. This makes it possible to reduce the amount of rim spouting before the start of jet spouting, which is less necessary in the light flush mode, and suppress the amount of flush water while ensuring sufficient flushing performance.

In the present invention, preferably, the operation unit is configured to open the first drain valve and then open the second drain valve when the full flush mode is executed, and is configured to open the first drain valve and the second drain valve substantially simultaneously when the light flush mode is executed.

According to the present invention configured as described above, when the light flush mode is executed, the first drain valve and the second drain valve are opened substantially simultaneously, making it possible to significantly reduce the amount of rim spouting water before the start of jet spouting and greatly suppress the amount of flush water while ensuring sufficient flushing performance.

In the present invention, preferably, the hydraulic drive mechanism opens the second drain valve using water supply pressure of flush water supplied from a tap water supply line to the flush water tank.

According to the present invention configured as described above, since the second drain valve is opened by the hydraulic drive mechanism, it is possible to start jet spouting by pulling up the drain valve after a predetermined time period elapses after rim spouting is started in the full flush mode without using electrical power such as that generated by a motor. This makes it possible to effectively flush the bowl while suppressing the amount of flush water.

In the present invention, preferably, the flush toilet device further includes a ball tap having a float configured to operate in association with a water level in the flush water tank, the ball tap is configured to supply flush water to the hydraulic drive mechanism when the float has lowered to a predetermined position, when the full flush mode is executed by the operation unit, the float lowers as the water level in the flush water tank drops, starting supply of flush water to the hydraulic drive mechanism and, when the light flush mode is executed by the operation unit, the float is forced down on the basis of operation of the operation unit, starting supply of flush water to the hydraulic drive mechanism.

According to the present invention configured as described above, when the full flush mode is executed, the float lowers as the water level in the flush water tank drops to start supply of flush water to the hydraulic drive mechanism, and thus jet spouting is started after the water level in the flush water tank drops. On the other hand, when the light flush mode is executed, the float is forced down to start supply of flush water to the hydraulic drive mechanism, and thus jet spouting is started without waiting for the water level in the flush water tank to drop. Thus, a flushing sequence of the full flush mode and the light flush mode can be set without the use of electrical control.

In the present invention, preferably, the flush toilet device further includes a ball tap having a float configured to operate in association with a water level in the flush water tank, the ball tap is configured to supply flush water to the hydraulic drive mechanism when the float has lowered to a predetermined position, when the full flush mode is executed by the operation unit, the float lowers as the water level in the flush water tank drops, starting supply of flush water to the hydraulic drive mechanism and, when the light flush mode is executed by the operation unit, the second drain valve is forced to open on the basis of operation of the operation unit before the float lowers to the predetermined position.

According to the present invention configured as described above, when the full flush mode is executed, the float lowers as the water level in the flush water tank drops to start supply of flush water to the hydraulic drive mechanism, and thus jet spouting is started after the water level in the flush water tank drops. On the other hand, when the light flush mode is executed, the second drain valve is forced to open on the basis of operation of the operation unit to start jet spouting. Thus, the flushing sequence of the full flush mode and the light flush mode can be set without the use of electrical control.

In the present invention, preferably, the operation unit includes a handle, the full flush mode is executed when the handle is rotated in a first direction, and the light flush mode is executed when the handle is rotated in a second direction opposite to the first direction. According to the present invention configured as described above, the full flush mode is executed when the handle is rotated in the first direction and the light flush mode is executed when the handle is rotated in the second direction. Thus, execution of the full flush mode and the light flush mode can be controlled with a simple mechanism.

In the present invention, preferably, the operation unit includes a first button and a second button, the full flush mode is executed when the first button is pressed, and the light flush mode is executed when the second button is pressed.

According to the present invention configured as described above, the full flush mode is executed when the first button is pressed and the light flush mode is executed when the second button is pressed. Thus, execution of the full flush mode and the light flush mode can be controlled with a simple mechanism.

Advantageous Effects of Invention

According to the flush toilet device of the present invention, it is possible to effectively perform flushing with small amount of flush water by accurately setting opening times for individual drain valves.

Furthermore, according to the flush toilet device of the present invention, it is possible to effectively flush a toilet by executing different flushing sequences for a full flush and a light flush while supplying an entire amount of flush water used for flushing from a flush water tank.

DESCRIPTION OF EMBODIMENTS

Next, a flush toilet device according to a first embodiment of the present invention will be described with reference to the accompanying drawings.

Figure 1:
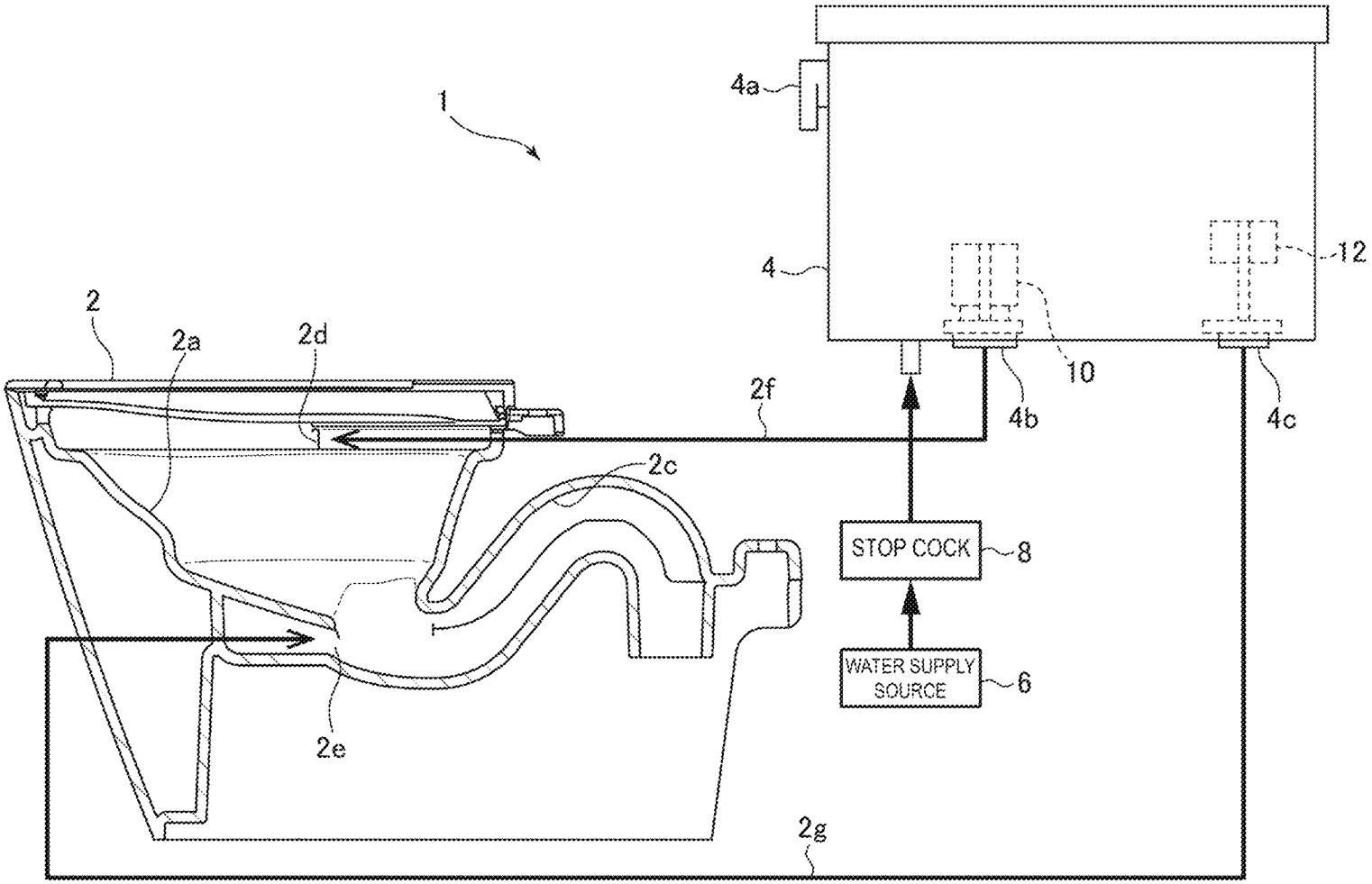
FIG. 1 is a block diagram illustrating a flush toilet device according to a first embodiment of the present invention.
Figure 2:
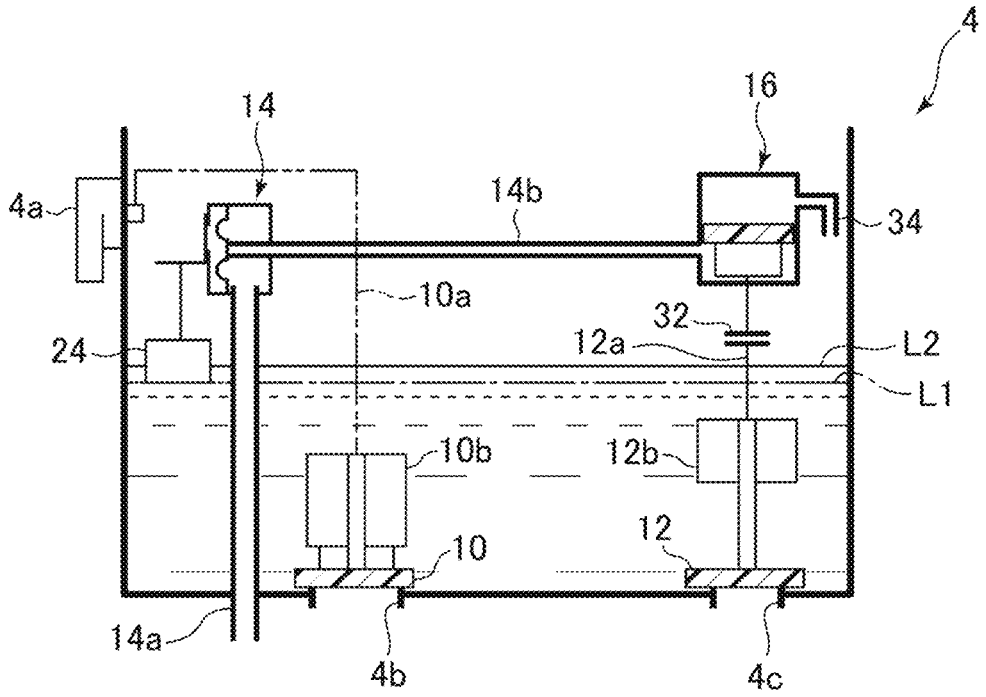
FIG. 2 is a cross-sectional view illustrating a schematic configuration of a flush water tank provided in the flush toilet device according to the first embodiment of the present invention.
Figure 3:
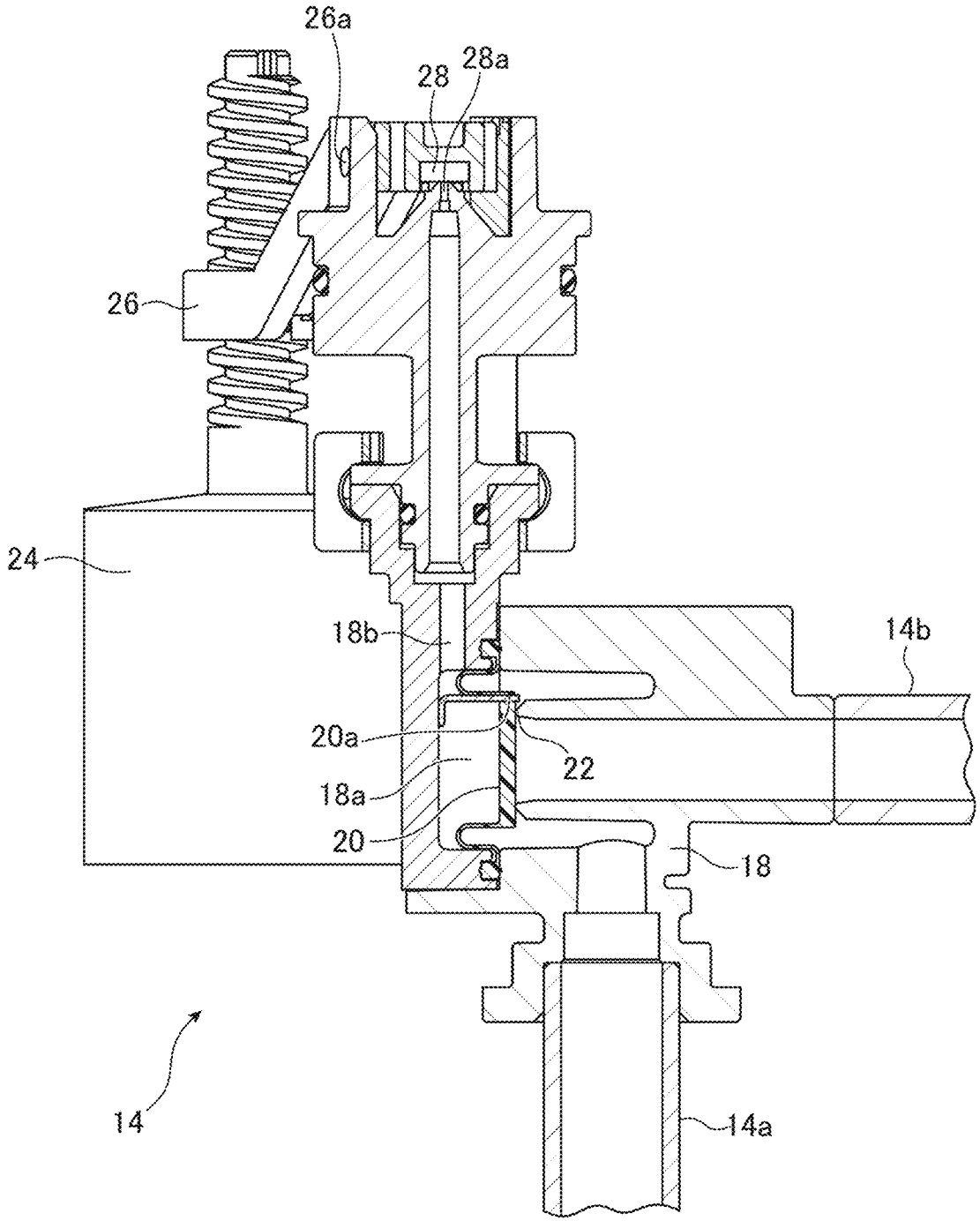
FIG. 3 is a cross-sectional view illustrating a structure of a ball tap incorporated into the flush water tank in the flush toilet device according to the first embodiment of the present invention.
Figure 4:
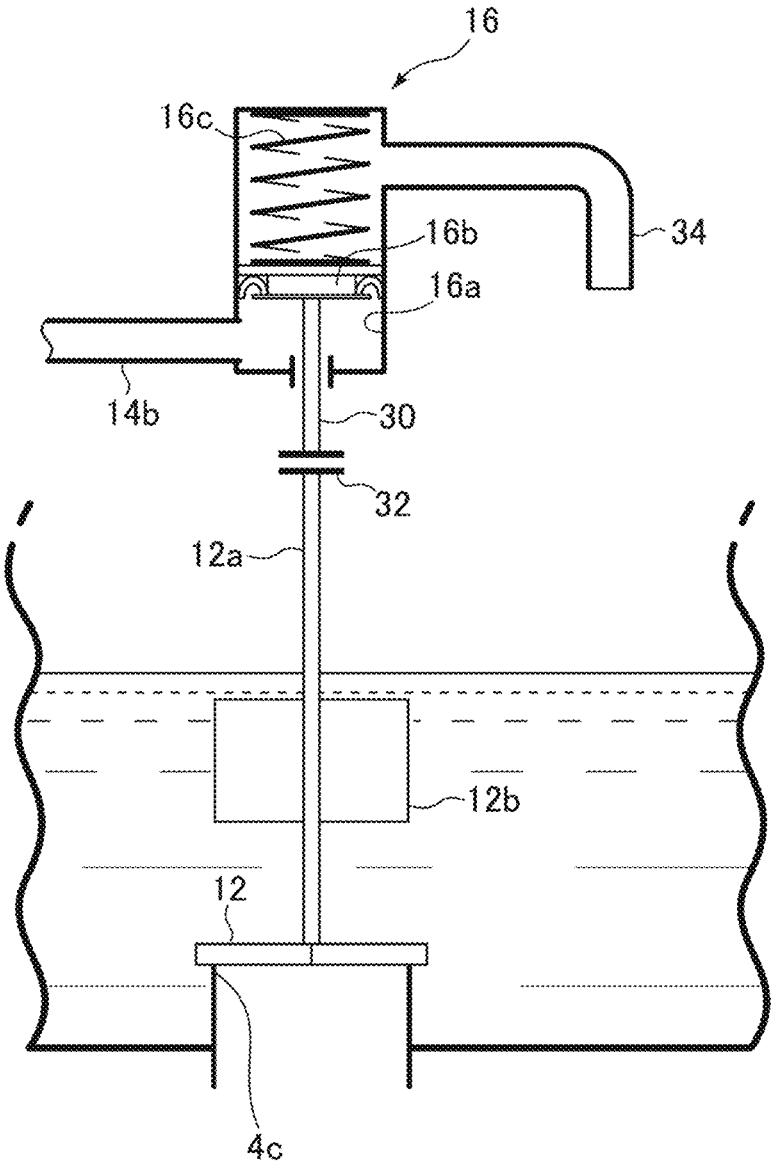
FIG. 4 is a cross-sectional view illustrating a structure of a hydraulic drive mechanism incorporated into the flush water tank in the flush toilet device according to the first embodiment of the present invention.

FIG. 1 is a block diagram illustrating a flush toilet device according to the first embodiment of the present invention. FIG. 2 is a cross-sectional view illustrating a schematic configuration of a flush water tank provided in the flush toilet device according to the first embodiment of the present invention. FIG. 3 is a cross-sectional view illustrating a structure of a ball tap incorporated into the flush water tank in the flush toilet device according to the first embodiment of the present invention. FIG. 4 is a cross-sectional view illustrating a structure of a hydraulic drive mechanism incorporated into the flush water tank in the flush toilet device according to the first embodiment of the present invention.

As illustrated in FIG. 1, a flush toilet device 1 according to the embodiment of the present invention includes a flush toilet main body 2, which is a flush toilet, and a flush water tank 4 disposed at a rear portion of the flush toilet main body 2. The flush toilet device 1 of the present embodiment is configured to perform flushing when a user operates a lever handle 4*a* provided on the flush water tank 4 after use of the flush toilet device 1. Note that, as an exemplary modification, the present invention may also be configured such that flushing is performed on the basis of a control signal from a remote control device (not illustrated) or a detection signal from a human presence sensor (not illustrated).

The flush toilet main body 2 includes a bowl 2*a* and a drain trap conduit 2*c* extending from a lower portion of the bowl 2*a*. Further, a rim spout port 2*d* is provided at an upper edge portion of the bowl 2*a*, and a jet spout port 2*e* is provided at the lower portion of the bowl 2*a*. When the toilet is flushed, flush water is spouted from the rim spout port 2*d* and the jet spout port 2*e* at predetermined times, a waste receiving surface of the bowl 2*a* is flushed, and waste and the flush water in the bowl 2*a* are discharged to the drain trap conduit 2*c*. The waste and flush water discharged to the drain trap conduit 2*c* are discharged to a sewer pipe (not illustrated) through a drain socket (not illustrated).

The flush water is supplied to the flush water tank 4 from a water supply source 6 such as a tap water supply line through a stop cock 8, and the supplied flush water is stored up to a predetermined water level in the flush water tank 4. The stop cock 8 is provided for stopping the supply of flush water to the flush water tank 4 during maintenance or the like, and is normally in an "open" state. The flush water tank 4 includes a first drain valve 10 and a second drain valve 12, which are configured to respectively open and close a first drain port 4*b* and a second drain port 4*c* provided at a bottom portion of the flush water tank 4.

Flush water flowing out from the first drain port 4*b* passes through a rim conduit 2*f* formed inside the flush toilet main body 2 and is spouted from the rim spout port 2*d*. Accordingly, the first drain valve 10 switches between spouting and stopping the flush water from the rim spout port 2*d* by opening and closing the first drain port 4*b* provided in the flush water tank 4. Further, flush water flowing out from the second drain port 4*c* passes through a jet conduit 2*g* formed inside the flush toilet main body 2 and is spouted from the jet spout port 2*e*. Accordingly, the second drain valve 12 switches between spouting and stopping the flush water from the jet spout port 2*e* by opening and closing the second drain port 4*c* provided in the flush water tank 4.

Next, an internal structure of the flush water tank 4 will be described with reference to FIG. 2.

As illustrated in FIG. 2, the flush water tank 4 includes the first drain valve 10 that opens and closes the first drain port 4*b*, the second drain valve 12 that opens and closes the second drain port 4*c*, a ball tap 14 which is a delay mechanism, and a hydraulic drive mechanism 16.

The flush water tank 4 is a tank configured to store flush water to be supplied to the flush toilet main body 2, and the first drain port 4*b* and the second drain port 4*c* for discharging the stored flush water to the flush toilet main body 2 are formed at the bottom portion of the flush water tank 4.

The first drain valve 10 is a valve body disposed so as to open and close the first drain port 4*b*, and the first drain port 4*b* is opened by the first drain valve 10 being pulled up. As a result, flush water in the flush water tank 4 is discharged to the rim conduit 2*f* (FIG. 1) of the flush toilet main body 2, and is spouted from the rim spout port 2*d*.

In the present embodiment, when a user rotates the lever handle 4*a* provided on the flush water tank 4, a bead chain 10*a* (schematically illustrated in FIG. 2) coupled to the first drain valve 10 is pulled, pulling up the first drain valve 10. Further, in the present embodiment, the first drain valve 10 is a valve body having a floating ball 10*b*. The first drain valve 10 is configured to, after being pulled up from the first drain port 4*b* and opened, gradually fall as the water level in the flush water tank 4 drops, closing the first drain port 4*b* when the water level drops to a predetermined water level.

The second drain valve 12 is a valve body disposed so as to open and close the second drain port 4*c*, and the second drain port 4*c* is opened by pulling up the second drain valve 12. As a result, flush water in the flush water tank 4 is discharged to the jet conduit 2*g* (FIG. 1) of the flush toilet main body 2 and is spouted from the jet spout port 2*e*.

In the present embodiment, the second drain valve 12 is configured to be pulled up from the second drain port 4*c* by the hydraulic drive mechanism 16. The second drain valve 12 is a valve body having a valve stem 12*a* extending upward and a floating ball 12*b*, and the valve stem 12*a* is pulled up by the hydraulic drive mechanism 16. Then, when pulled up to a predetermined height, the second drain valve 12 is separated from the hydraulic drive mechanism 16 and gradually falls as the water level in the flush water tank 4 drops, closing the second drain port 4*c*.

Further, in the present embodiment, the floating ball 12*b* of the second drain valve 12 is attached at a position higher than that of the floating ball 10*b* of the first drain valve 10. Thus, the second drain valve 12 is seated on and closes the second drain port 4*c* in a state in which the water level in the flush water tank 4 is relatively high. That is, when the first drain valve 10 and the second drain valve 12 fall as the water level in the flush water tank 4 drops, the second drain valve 12 is first seated on and closes the second drain port 4*c*.

The ball tap 14, which is a delay mechanism, is configured such that flush water supplied from the water supply source 6 flows in through an inflow pipe 14*a* and, by the action of this ball tap 14, the second drain valve 12 is opened later than the first drain valve 10 in the present embodiment.

Next, a configuration of the ball tap 14 will be described with reference to FIG. 3. As illustrated in FIG. 3, the ball tap 14 includes a main portion 18 to which the inflow pipe 14*a* and an outflow pipe 14*b* are connected, a main valve body 20 disposed in the main portion 18, a valve seat 22 on which the main valve body 20 is seated, an arm portion 26 that is rotated by a float 24, and a pilot valve 28 that is moved by rotation of the arm portion 26. That is, the ball tap 14 includes the float 24 that operates in association with the water level in the flush water tank 4, and is configured to supply flush water to the hydraulic drive mechanism 16 when the float 24 lowers to a predetermined position.

The main portion 18 is a member provided with a connecting portion for the inflow pipe 14*a* at a lower portion thereof and a connecting portion for the outflow pipe 14*b* on one side thereof. Further, the valve seat 22 is formed inside the main portion 18. The valve seat 22 is in communication with the outflow pipe 14*b* connected to the connecting portion. Furthermore, the main valve body 20 is disposed inside the main portion 18 so as to open and close the valve seat 22. When the valve seat 22 is opened, tap water flowing in from the inflow pipe 14*a* passes through the valve seat 22 and flows out to the outflow pipe 14*b*. Further, the outflow pipe 14*b* is connected to the hydraulic drive mechanism 16.

The main valve body 20 is a diaphragm-type valve body having a substantially disk shape, and is attached in the main portion 18 so as to be seated on and unseated from the valve seat 22. Further, a bleed hole 20*a* is provided in a peripheral edge portion of the main valve body 20. In the main portion 18, a pressure chamber 18*a* is formed on a side (left side in FIG. 3) of the main valve body 20 opposite to the valve seat 22. That is, the pressure chamber 18*a* is defined by an inner wall surface of the main portion 18 and by the main valve body 20 and, when pressure in the pressure chamber 18*a* increases, the main valve body 20 is pressed against the valve seat 22 by this pressure and is seated on the valve seat 22.

Furthermore, in the pressure chamber 18*a* provided in the main portion 18, a pressure passageway 18*b* extends upward with the pressure chamber 18*a* in communication therewith, and a pilot valve port 28*a* is provided at an upper end of the pressure passageway 18*b*. This pilot valve port 28*a* opens upward and is configured to be opened and closed by the pilot valve 28.

On the other hand, the float 24 is supported by the arm portion 26, and the arm portion 26 is rotatably supported by a support shaft 26*a*. Furthermore, the pilot valve 28 is coupled to the arm portion 26, and the pilot valve 28 is configured to be moved in a vertical direction in association with the rotation of the arm portion 26. As a result, in a state in which the water level in the flush water tank 4 has risen to or above a predetermined set water level $L_1$, the float 24 is pushed upward, and the pilot valve 28 is accordingly moved downward and seated on the pilot valve port 28*a* to close the pilot valve port 28*a*. Meanwhile, when the flush water in the flush water tank 4 is drained and the water level in the flush water tank 4 drops, the float 24 moves downward and the pilot valve 28 moves upward, opening the pilot valve port 28*a*. Therefore, the pilot valve port 28*a* of the main portion 18 is closed during toilet flush standby state where the water level in the flush water tank 4 is higher than the set water level $L_1$.

Further, the tap water flowing into the main portion 18 from the inflow pipe 14*a* flows into a space having a ring configuration surrounding the valve seat 22, passes through the bleed hole 20*a* of the main valve body 20, and flows into the pressure chamber 18*a*. In a state in which the pilot valve port 28*a* is closed by the pilot valve 28, there is no outflow path for the tap water flowing from the bleed hole 20*a* into the pressure chamber 18*a*, which increases the pressure in the pressure chamber 18*a*. When the pressure in the pressure chamber 18*a* increases, the main valve body 20 is pressed toward the valve seat 22 (to the right side in FIG. 3) by this pressure, and the valve seat 22 is closed by the main valve body 20.

Meanwhile, when the first drain valve 10 is opened by the flushing operation and the water level in the flush water tank 4 drops below the set water level $L_1$, the float 24 moves downward and the pilot valve 28 moves upward, opening the pilot valve port 28*a*. When the pilot valve port 28*a* is opened, the water in the pressure chamber 18*a* flows out from the pilot valve port 28*a*, as a result the pressure in the pressure chamber 18*a* drops. Accordingly, the main valve body 20 is moved so as to separate from the valve seat 22 (to the left side in FIG. 3), and the valve seat 22 is opened. In this way, in a state in which the pilot valve port 28*a* is opened, the pressure in the pressure chamber 18*a* does not rise, and thus the valve seat 22 is in an open state.

Next, a configuration of the hydraulic drive mechanism 16 will be described with reference to FIG. 4.

The hydraulic drive mechanism 16 is configured to drive the second drain valve 12 by using the supply pressure of the flush water supplied from the tap water supply line to the flush water tank 4. Specifically, the hydraulic drive mechanism 16 includes a cylinder 16*a* into which the water supplied from the ball tap 14 flows, a piston 16*b* slidably disposed in the cylinder 16*a*, and a rod 30 that protrudes from a lower end of the cylinder 16*a* and drives the second drain valve 12. Furthermore, a spring 16*c* is disposed inside the cylinder 16*a*, urging the piston 16*b* downward, and a rubber seal is attached to the piston 16*b*, ensuring water tightness between an inner wall surface of the cylinder 16*a* and the piston 16*b*. Further, a clutch mechanism 32 is provided at a lower end of the rod 30. The clutch mechanism 32 couples and separates the rod 30 and the valve stem 12*a* of the second drain valve 12.

The cylinder 16*a* is a member having a cylindrical shape, is disposed with its axis oriented in the vertical direction, and slidably receives the piston 16*b* therein. The outflow pipe 14*b* extending from the ball tap 14 is connected to a lower end portion of the cylinder 16*a* such that flush water flowing out from the ball tap 14 flows into the cylinder 16*a*. Therefore, the piston 16*b* in the cylinder 16*a* is pushed up by overcoming the urging force of the spring 16*c* by the water flowing into the cylinder 16*a*.

On the other hand, an outflow hole is provided in an upper end portion of the cylinder 16*a*, and a water supply pipe 34 is in communication with the inside of the cylinder 16*a* via the outflow hole. Accordingly, when water flows into the cylinder 16*a* from the outflow pipe 14*b* connected to the lower portion of the cylinder 16*a*, the piston 16*b* is pushed upward from the lower position of the cylinder 16*a*. Accordingly, when the piston 16*b* is pushed up to a position higher than the outflow hole, the water flowing into the cylinder 16*a* flows out from the outflow hole and into the water supply pipe 34. Further, the flush water flowing into the water supply pipe 34 falls within the flush water tank 4, and the flush water is supplied to the flush water tank 4.

The rod 30 is a rod-shaped member connected to a lower surface of the piston 16*b*, and protrudes downwardly from the inside of the cylinder 16*a* through a through hole formed in a bottom surface of the cylinder 16*a*. The valve stem 12*a* of the second drain valve 12 is connected to the lower end of the rod 30 via the clutch mechanism 32, and the rod 30 couples the piston 16*b* and the second drain valve 12. Therefore, when water flows into the cylinder 16*a* and the piston 16*b* is pushed up, the rod 30 connected to the piston 16*b* lifts the second drain valve 12 upward, thereby opening the second drain valve 12.

Further, a gap is provided between the rod 30 downwardly protruding from the inside of the cylinder 16*a* and an inner wall of the through hole of the cylinder 16*a*, and some of the water flowing into the cylinder 16*a* flows out from the gap. The water flowing out from the gap flows into the flush water tank 4. Note that the gap is relatively narrow, resulting in large flow channel resistance. Thus, even in a state in which the water flows out from the gap, the water flowing from the outflow pipe 14*b* into the cylinder 16*a* causes the pressure in the cylinder 16*a* to increase and pushes the piston 16*b* up while overcoming the urging force of the spring 16*c*.

Furthermore, the clutch mechanism 32 detachably couples the second drain valve 12 with the rod 30. The clutch mechanism 32 is configured to separate the valve stem 12*a* of the second drain valve 12 from the rod 30 when the second drain valve 12 is lifted a predetermined distance together with the rod 30. In a state in which the valve stem 12*a* and the rod 30 are separated by the clutch mechanism 32, the second drain valve 12 is not accompanied with the movement of the piston 16*b* and an upper portion of the rod 30, and the second drain valve 12 falls as the water level in the flush water tank 4 drops.

Next, actions of the flush toilet device 1 according to the first embodiment of the present invention will be described with new reference to FIG. 5 to FIG. 9.

Figure 7:
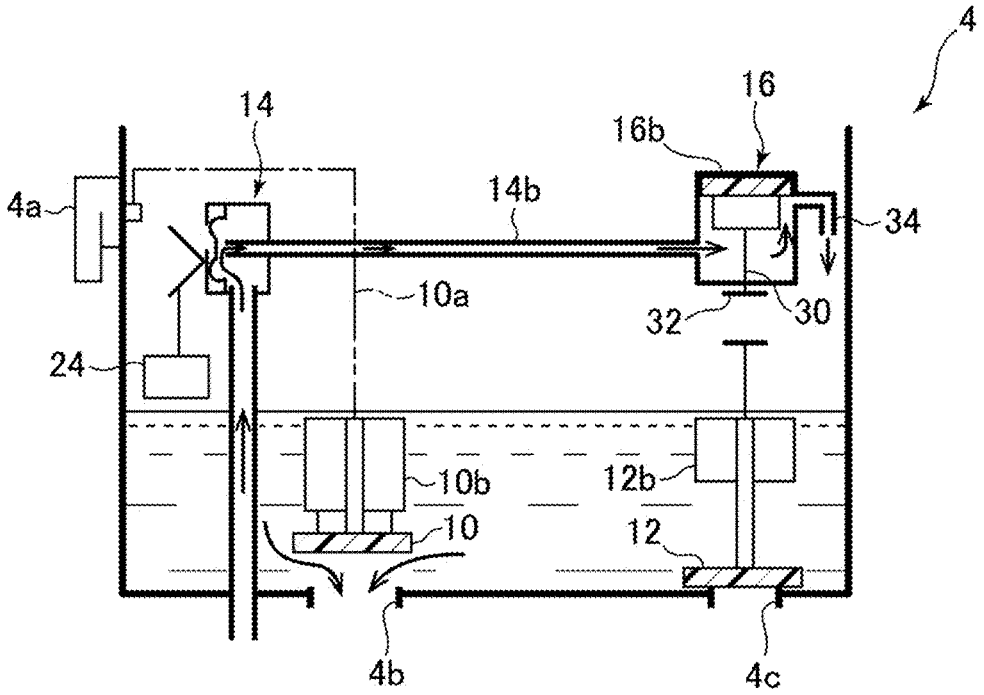
FIG. 7 is a schematic view for explaining operation of the flush toilet device according to the first embodiment of the present invention.
Figure 8:
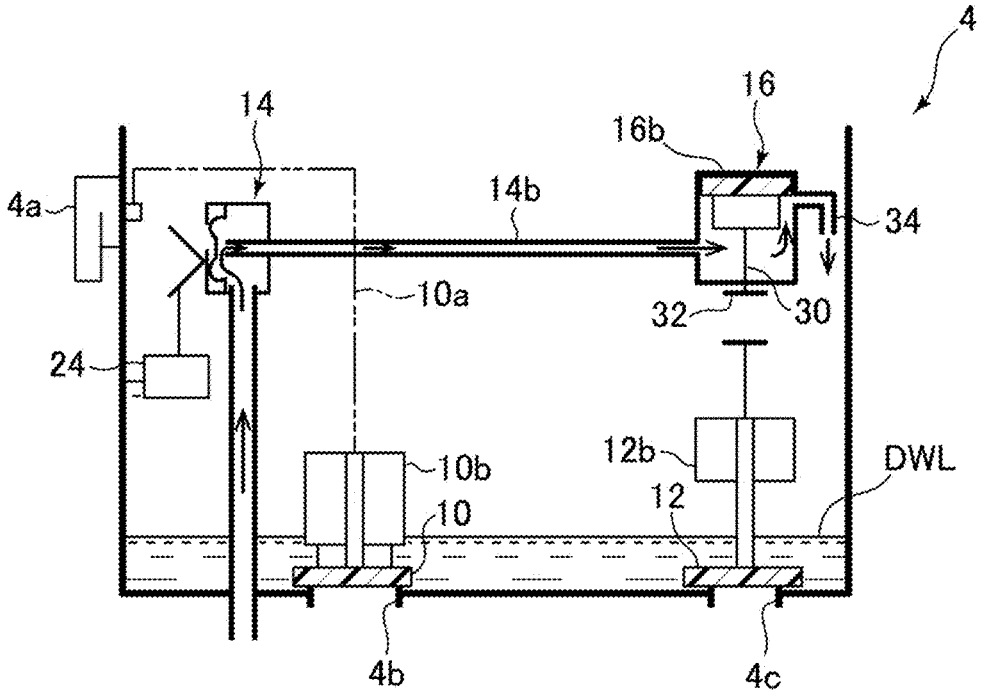
FIG. 8 is a schematic view for explaining operation of the flush toilet device according to the first embodiment of the present invention.
Figure 9:
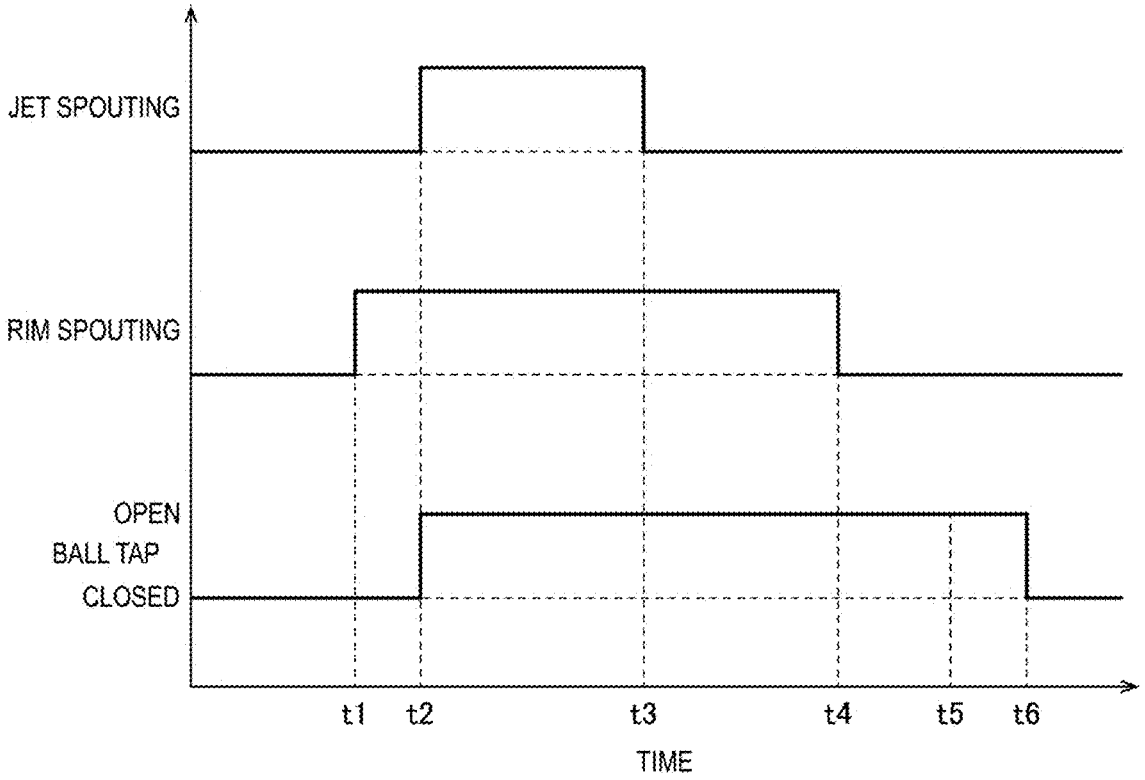
FIG. 9 is a time chart illustrating operation of the flush toilet device according to the first embodiment of the present invention.

FIG. 5 to FIG. 8 are schematic views for explaining operations of the flush toilet device 1 according to the first embodiment of the present invention. FIG. 9 is a time chart illustrating operation of the flush toilet device 1 according to the first embodiment of the present invention.

First, in the toilet flush standby state described above, as illustrated in FIG. 2, the first drain port 4*b* and the second drain port 4*c* of the flush water tank 4 are closed by the first drain valve 10 and the second drain valve 12, respectively. Further, in the standby state, an initial water level $L_2$ inside the flush water tank 4 is higher than the predetermined set water level $L_1$ (the reason that the initial water level $L_2$ is higher than the set water level $L_1$ will be described below). As a result, the pilot valve port 28*a* of the main portion 18 (FIG. 3) of the ball tap 14 is in a closed state, and the valve seat 22 is closed by the main valve body 20.

Figure 5:
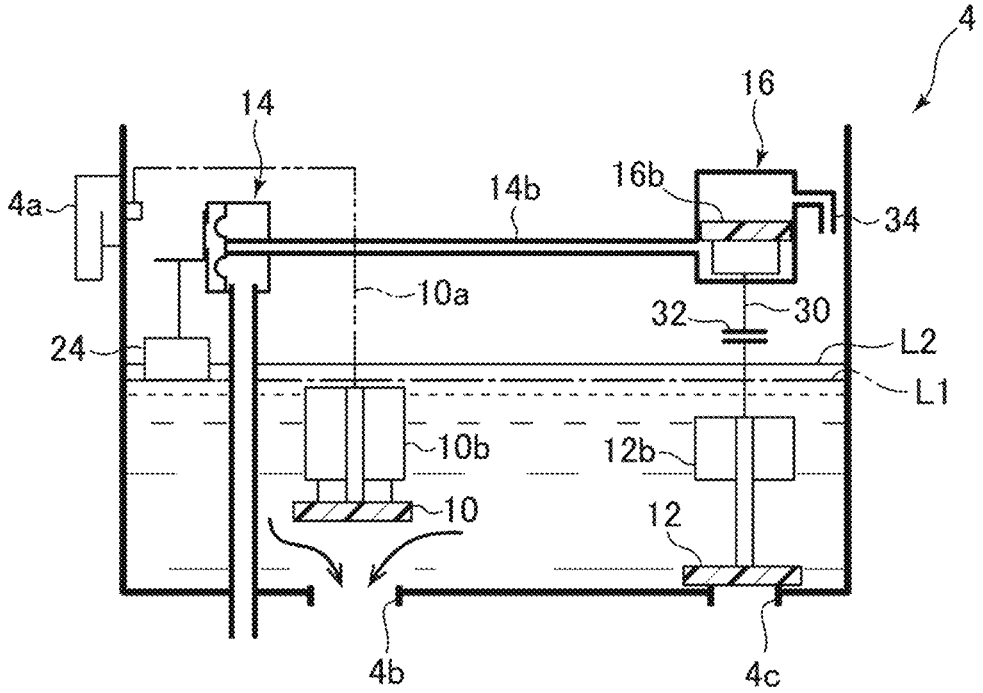
FIG. 5 is a schematic view for explaining operation of the flush toilet device according to the first embodiment of the present invention.

Next, at time t1 in FIG. 9, when the user rotates the lever handle 4*a* of the flush water tank 4 to flush the toilet, the bead chain 10*a* connected to the lever handle 4*a* pulls up the first drain valve 10. As a result, as illustrated in FIG. 5, the first drain valve 10 is separated from the first drain port 4*b*, opening the first drain port 4*b*. When the first drain port 4*b* is opened, the flush water stored in the flush water tank 4 flows from the first drain port 4*b* into the rim conduit 2*f* (FIG. 1) and is spouted from the rim spout port 2*d*. The rim spouting from the rim spout port 2*d* generates a circulating flow on the waste receiving surface of the bowl 2*a*, thereby flushing the waste receiving surface.

Figure 6:
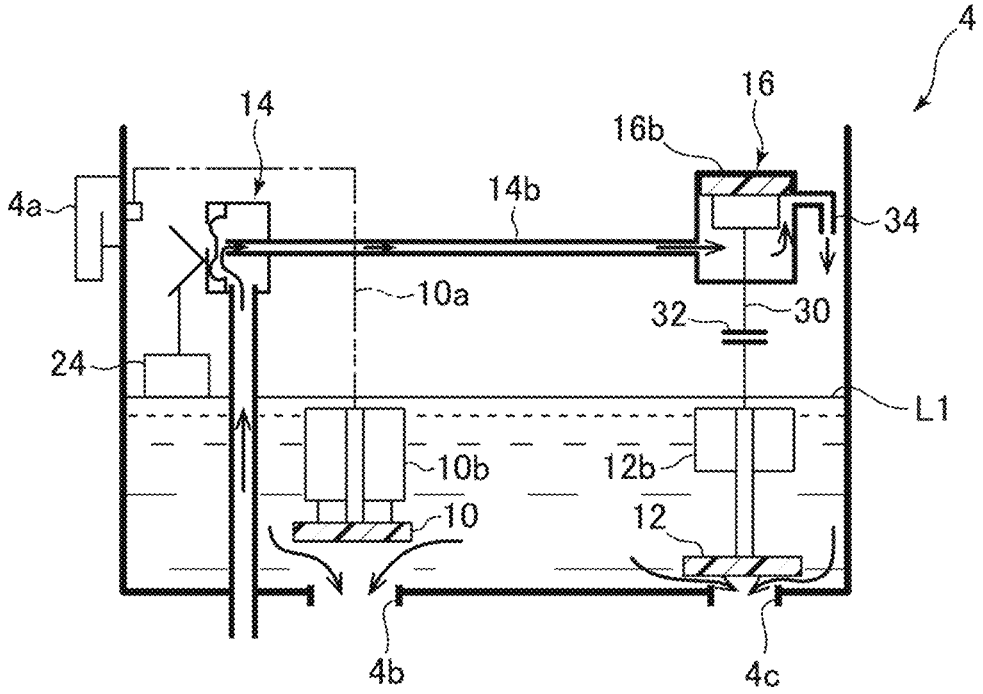
FIG. 6 is a schematic view for explaining operation of the flush toilet device according to the first embodiment of the present invention.

The flush water is discharged from the first drain port 4*b*, causing the water level in the flush water tank 4 to drop. Then, when the water level in the flush water tank 4 is lower than the set water level $L_1$ at time t2 in FIG. 9, the float 24 of the ball tap 14 lowers, opening the pilot valve 28 (FIG. 3). As a result, the pressure in the pressure chamber 18*a* drops, opening the main valve body 20 and starting water supply to the hydraulic drive mechanism 16, as illustrated in FIG. 6.

When flush water is supplied to the hydraulic drive mechanism 16, the flush water flowing into the cylinder 16*a* (FIG. 4) overcomes the urging force of the spring 16*c* and pushes the piston 16*b* up. As a result, the rod 30 coupled to the piston 16*b* pulls up the valve stem 12*a* of the second drain valve 12, opening the second drain port 4*c*. That is, the second drain valve 12 is driven and opened by the water supply pressure of the tap water supplied through the ball tap 14.

When the second drain port 4*c* is opened, the flush water stored in the flush water tank 4 flows from the second drain port 4*c* into the jet conduit 2*g* (FIG. 1) and is spouted from the jet spout port 2*e*. The jet spouting from the jet spout port 2*e* fills the drain trap conduit 2*c* and induces a siphon action. When the siphon action is generated, residual water and waste in the bowl 2*a* are suctioned into the drain trap conduit 2*c* and discharged to a sewer pipe (not illustrated).

When the second drain valve 12 is pulled up to a predetermined height together with the piston 16*b* of the hydraulic drive mechanism 16, the valve stem 12*a* of the second drain valve 12 is separated from the rod 30 by the clutch mechanism 32 (FIG. 4). As a result, the second drain valve 12 falls toward the second drain port 4*c*. Then, at time t3 in FIG. 9, as illustrated in FIG. 7, the second drain valve 12 is seated on the second drain port 4*c*, closing the second drain port 4*c*. As a result, the jet spouting from the jet spout port 2*e* is stopped. Note that, as described above, since the floating ball 12*b* of the second drain valve 12 is attached at a relatively high position, the second drain valve 12 is seated on the second drain port 4*c* earlier than the first drain valve 10.

In the state illustrated in FIG. 7, the main valve body 20 of the ball tap 14 is in an open state, and thus flush water supplied from the water supply source 6 (tap water supply line) is supplied to the hydraulic drive mechanism 16 via the ball tap 14 and flows into the flush water tank 4 from the water supply pipe 34 connected to the cylinder 16*a*. Meanwhile, since the first drain valve 10 is still open, the flush water in the flush water tank 4 flows out from the first drain port 4*b* and is spouted from the rim spout port 2*d*. After the jet spouting is stopped at time t3 in FIG. 9, the flush water spouted from the rim spout port 2*d* is utilized as refill water for returning the water level in the bowl 2*a* to a residual water level in the standby state.

Here, the flow rate of flush water flowing out from the first drain port 4*b* is greater than the flow rate of flush water flowing into the flush water tank 4 from the water supply pipe 34. Thus, in the state illustrated in FIG. 7, the water level in the flush water tank 4 drops and the first drain valve 10 also falls accordingly. Then, when the water level in the flush water tank 4 drops to a dead water level DWL at time t4 in FIG. 9, as illustrated in FIG. 8, the first drain valve 10 is seated on the first drain port 4*b*, and the first drain valve 10 is closed. The rim spouting from the rim spout port 2*d* is thereby stopped.

Furthermore, the main valve body 20 of the ball tap 14 is maintained in an open state even after the first drain valve 10 is closed, as a result the flush water supplied from the water supply source 6 (tap water supply line) flows into the flush water tank 4 from the water supply pipe 34 via the ball tap 14 and the hydraulic drive mechanism 16. As a result, the water level in the flush water tank 4 rises. Then, at time t5 in FIG. 9, when the water level in the flush water tank 4 rises to the set water level $L_1$, the float 24 of the ball tap 14 rises and the pilot valve 28 (FIG. 3) is closed.

When the pilot valve 28 is closed in this way, flush water flowing into the pressure chamber 18*a* from the bleed hole 20*a* provided in the main valve body 20 of the ball tap 14 cannot flow out, causing the pressure in the pressure chamber 18*a* to rise. Then, at time t6 in FIG. 9, the main valve body 20 is pressed by the pressure in the pressure chamber 18*a* and seated on the valve seat 22, closing the main valve body 20. As a result, the water supply from the water supply source 6 to the hydraulic drive mechanism 16 via the ball tap 14 is stopped, thereby stopping the supply of flush water to the flush water tank 4.

When the water supply to the hydraulic drive mechanism 16 is stopped, the piston 16*b* (FIG. 4) in the cylinder 16*a* pushed up by the water supply is pushed down by the urging force of the spring 16*c*. Accordingly, the rod 30 attached to the piston 16*b* also drops. When the rod 30 drops to a predetermined position, the rod 30 is coupled again to the valve stem 12*a* of the second drain valve 12 by the clutch mechanism 32. Thus, one toilet flush is completed, and the flush toilet device 1 returns to the toilet flush standby state illustrated in FIG. 2.

As a result, there is a predetermined time lag between the time at which the water level in the flush water tank 4 rises to the set water level $L_1$ and the pilot valve 28 is closed (time t5 in FIG. 9) and the time at which the main valve body 20 of the ball tap 14 is closed (time t6 in FIG. 9). Then, during the period from time t5 to time t6, the main valve body 20 is open, and the supply of flush water is continued. Consequently, at the time point when the main valve body 20 is closed at time t6, the water level in the flush water tank 4 reaches the initial water level $L_2$, which is higher than the set water level $L_1$.

As a result, the initial water level $L_2$ in the flush water tank 4 in the standby state of the flush toilet device 1 is set higher than the predetermined set water level $L_1$ at which the pilot valve 28 is closed. Therefore, at the time point when the user operates the lever handle 4*a* in the standby state (time t1 in FIG. 9), the water level in the flush water tank 4 is higher than the set water level $L_1$, and the main valve body 20 of the ball tap 14 is not opened. Consequently, between the times t1 and t2, during which a predetermined amount of flush water is discharged from the first drain port 4*b* for rim spouting and the water level in the flush water tank 4 drops to the set water level $L_1$, the pilot valve 28 is opened and the main valve body 20 of the ball tap 14 is also opened. As a result, at time t2, water supply to the hydraulic drive mechanism 16 is started and the second drain valve 12 is opened by the hydraulic drive mechanism 16, starting jet spouting.

According to the flush toilet device of the first embodiment of the present invention, the spouting and stopping of flush water from the rim spout port 2*d* are switched by the first drain valve 10, and the spouting and stopping of flush water from the jet spout port 2*e* are switched by the second drain valve 12. With this configuration, it is possible to independently set the times for rim spouting and jet spouting as desired and effectively flush the bowl 2*a* of the flush toilet main body 2 with minimal flush water (FIG. 1). Further, since the second drain valve 12 is opened by the hydraulic drive mechanism 16 by using the supply pressure of the flush water, the drain valve is pulled up without using electric power such as that generated by a motor, and thus the opening time of the drain valve can be set without the use of a complex mechanism for opening the drain valve.

Further, according to the flush toilet device of the present embodiment, since the second drain valve 12 is opened later than the first drain valve 10 (FIG. 9) by the ball tap 14, which is a delay mechanism, it is possible to start the spouting from the rim spout port 2*d* and the jet spout port 2*e* at necessary times depending on the configuration of the flush toilet main body 2 and effectively flush the bowl 2*a* while suppressing the amount of flush water.

Furthermore, according to the flush toilet device 1 of the present embodiment, since the second drain valve 12 is opened by the hydraulic drive mechanism 16, by adjusting the time at which flush water is supplied to the hydraulic drive mechanism 16 (time t2 in FIG. 9), the time at which the spouting from the jet spout port 2*e* is started can be adjusted, and the start time for jet spouting can be set as desired.

Further, according to the flush toilet device of the present embodiment, flush water is supplied to the hydraulic drive mechanism 16 when the float 24 of the ball tap 14 has lowered to a predetermined position, making it possible to start the supply of flush water to the hydraulic drive mechanism 16 and start spouting from the jet spout port 2*e* at appropriate times on the basis of the water level in the flush water tank 4.

Next, the flush toilet device according to a second embodiment of the present invention will be described with reference to FIG. 10 to FIG. 12.

The flush toilet device of the present embodiment differs from that of the first embodiment described above in the configuration of the delay mechanism provided in the flush water tank. Thus, only components and operation of the second embodiment of the present invention that differ from those of the first embodiment will be described below, and the same components will be denoted by the same reference signs and descriptions thereof will be omitted.

Figure 10:
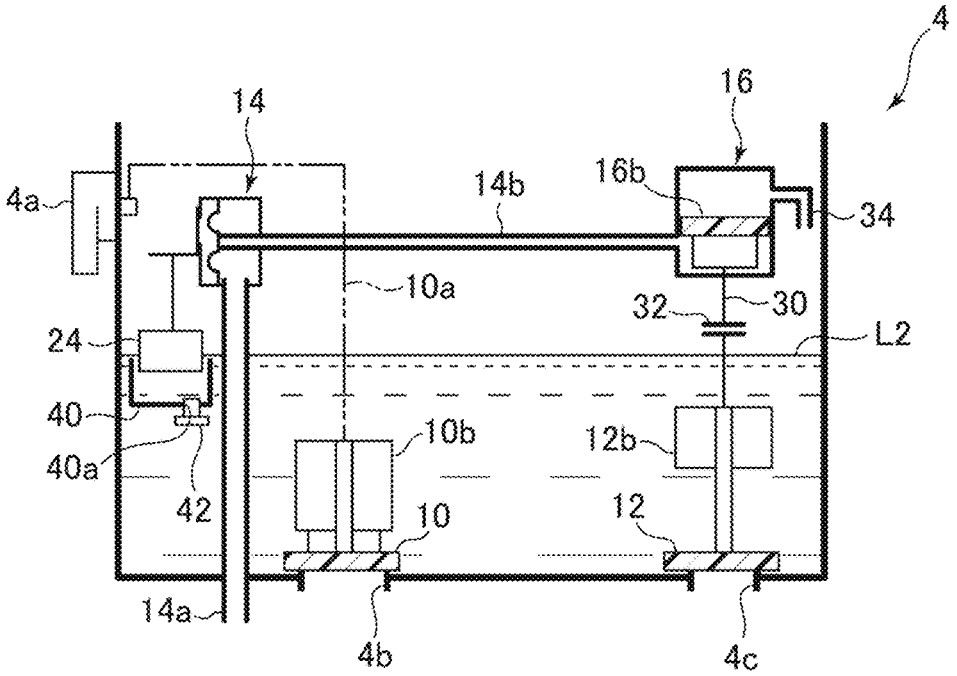
FIG. 10 is a cross-sectional view illustrating a schematic configuration of the flush water tank provided in the flush toilet device according to a second embodiment of the present invention.

FIG. 10 is a cross-sectional view illustrating a schematic configuration of the flush water tank provided in the flush toilet device according to the second embodiment of the present invention. FIG. 11 is a schematic view for explaining operations of the flush water tank in the flush toilet device according to the second embodiment of the present invention. FIG. 12 is a time chart illustrating operations of the flush toilet device according to the second embodiment of the present invention.

As illustrated in FIG. 10, the flush water tank 4 provided in the flush toilet device of the present embodiment includes the first drain valve 10, the second drain valve 12, the ball tap 14, and the hydraulic drive mechanism 16. As in the first embodiment described above, the ball tap 14 includes the float 24 and, as in the first embodiment, the pilot valve is opened and closed and the main valve body of the ball tap 14 is opened and closed by this float 24. In the present embodiment, as the delay mechanism, a small tank 40 disposed surrounding the float 24 of the ball tap 14 is provided in addition to the ball tap 14.

The small tank 40 is a tank of a small size disposed surrounding the float 24 in the flush water tank 4, and the float 24 is moved up and down in accordance with the water level in the small tank 40. In the standby state of the flush toilet device illustrated in FIG. 10, the small tank 40 disposed in the flush water tank 4 is entirely submerged. That is, the small tank 40 is formed in a box shape with open top so as to receive the float 24 from above, and the small tank 40 is disposed so that its upper end is at a position lower than the initial water level $L_2$ in the flush water tank 4. Therefore, in the standby state illustrated in FIG. 10, the small tank 40 is entirely submerged in the flush water in the flush water tank 4, and the small tank 40 is filled with flush water.

Further, a discharge hole 40*a* is formed in a bottom surface of the small tank 40, and this discharge hole 40*a* is configured to be opened and closed by a check valve float 42 provided at the bottom surface of the small tank 40. The check valve float 42 includes a float portion on which buoyancy from the flush water in the flush water tank 4 acts, and a rubber seal for closing the discharge hole 40*a*. The check valve float 42 is attached to the bottom surface of the small tank 40 and is vertically movable so as to open and close the discharge hole 40*a*.

That is, the check valve float 42 is configured to be pushed up by buoyancy acting on the float portion. Therefore, in a state in which the water level of flush water in the flush water tank 4 is higher than the bottom surface of the small tank 40, the rubber seal of the check valve float 42 is pressed against the discharge hole 40*a* in the bottom surface of the small tank 40 by buoyancy, thereby closing the discharge hole 40*a*. Meanwhile, when the water level in the flush water tank 4 drops, the check valve float 42 also lowers due to its own weight, opening the discharge hole 40*a* and causing the flush water in the small tank 40 to be discharged into the flush water tank 4.

With this configuration, when the water level in the flush water tank 4 drops, the water level in the small tank 40 drops later than the water level in the flush water tank 4. With the float 24 of the ball tap 14 falling in association with the water level in the small tank 40, the main valve body of the ball tap 14 is opened later than the drop of the water level in the flush water tank 4. This action delays the supply of flush water to the hydraulic drive mechanism 16 and the opening of the second drain valve 12.

Next, operation of the flush toilet device according to the second embodiment of the present invention will be described with new reference to FIG. 11 and FIG. 12.

Figure 12:
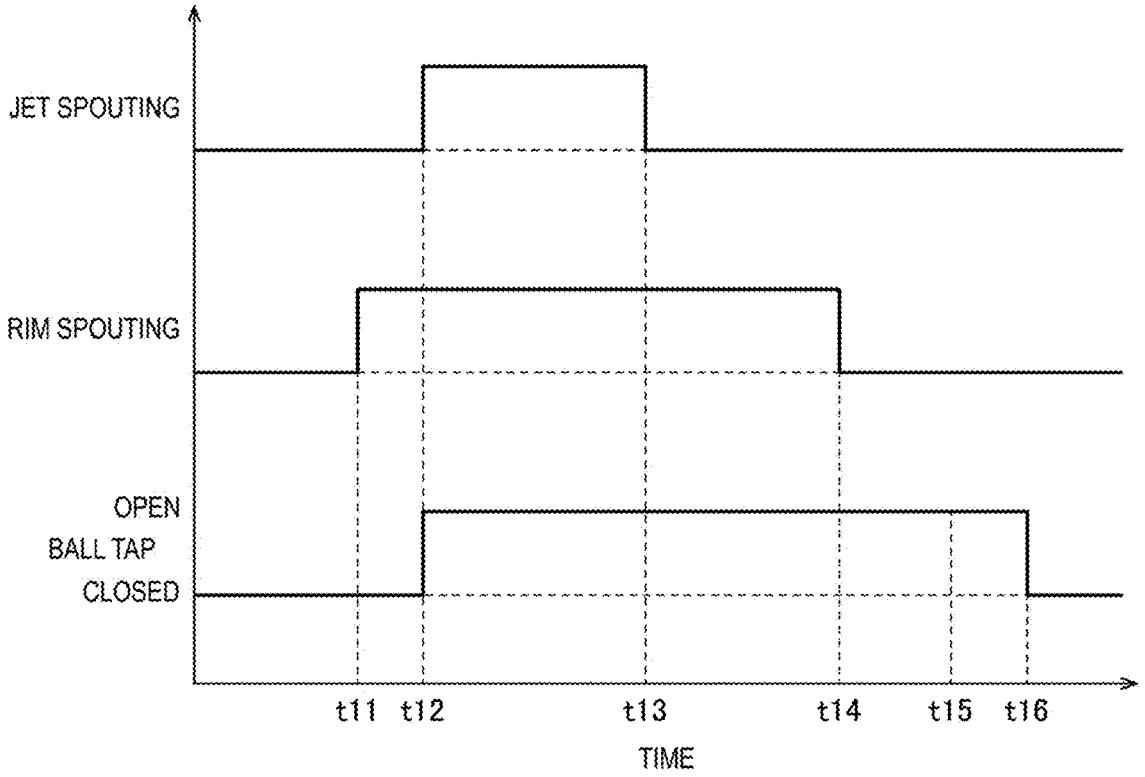
FIG. 12 is a time chart illustrating actions of the flush toilet device according to the second embodiment of the present invention.

First, at time t11 in FIG. 12, when the user rotates the lever handle 4*a* of the flush water tank 4, the bead chain 10*a* connected to the lever handle 4*a* pulls up the first drain valve 10. As a result, the first drain port 4*b* is opened, and flush water in the flush water tank 4 is spouted from the rim spout port.

The flush water is discharged from the first drain port 4*b*, causing the water level in the flush water tank 4 to drop. However, in a state in which the water level in the flush water tank 4 is higher than the bottom surface of the small tank 40, the discharge hole 40*a* of the small tank 40 is closed by the check valve float 42, and thus the water level in the small tank 40 does not change. Therefore, the float 24 in the small tank 40 does not lower, and the main valve body of the ball tap 14 is maintained in a closed state.

When the water level in the flush water tank 4 has further dropped and lowered than the bottom surface of the small tank 40, the check valve float 42 of the small tank 40 is opened, and flush water in the small tank 40 starts to flow out from the discharge hole 40*a*. Then, when the water level in the small tank 40 lowered below a predetermined set water level $L_3$ at time t12 in FIG. 12, the float 24 of the ball tap 14 falls, opening the pilot valve, as illustrated in FIG. 11. As a result, the main valve body 20 of the ball tap 14 is opened, starting water supply to the hydraulic drive mechanism 16. When water is supplied to the hydraulic drive mechanism 16, the second drain valve 12 is pulled up by the hydraulic drive mechanism 16, starting spouting from the jet spout port 2*e*.

After spouting from the jet spout port 2*e* is started at time t12, the operation of closing the second drain valve 12 at time t13 and the operation of closing the first drain valve 10 at time t14 are the same as in the first embodiment described above, and thus description thereof will be omitted. After the first drain valve 10 is closed at time t14, the water level in the flush water tank 4 rises. Then, even in a state in which the water level in the flush water tank 4 is higher than the bottom surface of the small tank 40, since the discharge hole 40*a* of the small tank 40 is closed by the buoyancy acting on the check valve float 42, the water level in the small tank 40 does not rise. When the water level in the flush water tank 4 further rises and the water level in the flush water tank 4 exceeds the upper end of the small tank 40, flush water flows into the small tank 40 and the water level in the small tank 40 also rises.

Then, at time t15, when the water level in the small tank 40 exceeds the predetermined set water level $L_3$, the pilot valve is closed. Furthermore, at time t16, the main valve body of the ball tap 14 is closed, and the water supply to the hydraulic drive mechanism 16 is stopped. As a result, the rod extending from the piston 16*b* of the hydraulic drive mechanism 16 lowers, and the rod is coupled again to the valve stem of the second drain valve 12 by the clutch mechanism 32. Thus, one toilet flush is completed, and the flush toilet device returns to the toilet flush standby state illustrated in FIG. 10.

Figure 11:
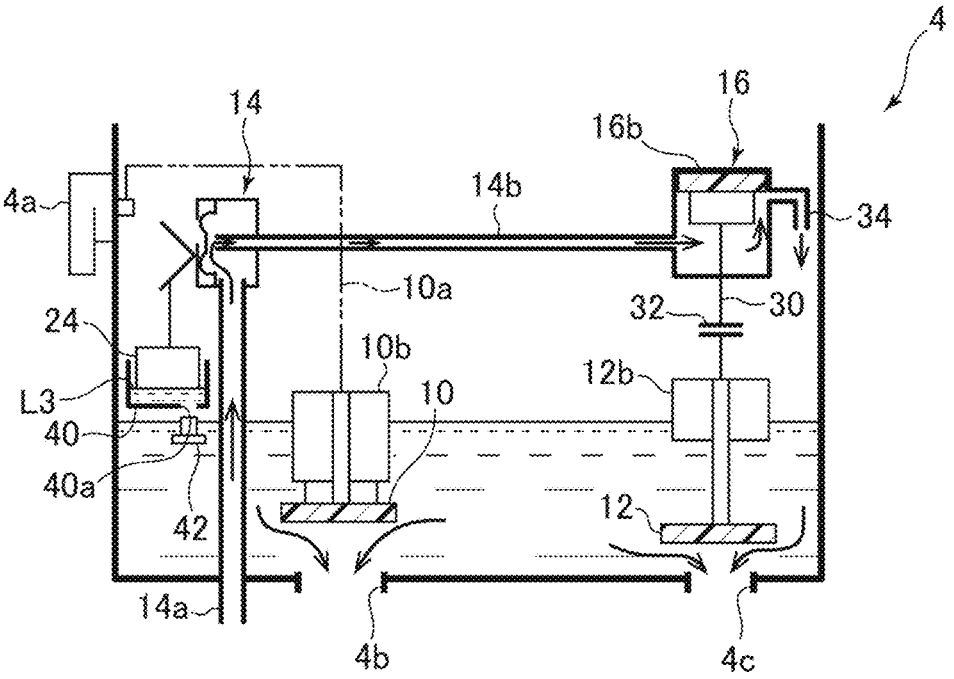
FIG. 11 is a schematic view for explaining operation of the flush water tank in the flush toilet device according to the second embodiment of the present invention.

According to the flush toilet device of the second embodiment of the present invention, the delay mechanism includes the small tank 40 and the check valve float 42 and, when the water level in the small tank 40 drops below the predetermined set water level $L_3$, flush water is supplied to the hydraulic drive mechanism 16 (FIG. 11). Therefore, the time at which flush water is supplied to the hydraulic drive mechanism 16 can be set by the configuration of the small tank 40 and the like as desired, and spouting can be started at a time suitable for flushing.

Next, the flush toilet device according to a third embodiment of the present invention will be described with reference to FIG. 13 and FIG. 14.

The flush toilet device of the present embodiment differs from that of the first embodiment described above in the configuration of the delay mechanism provided in the flush water tank. Thus, only the components and operations of the third embodiment of the present invention that differ from those of the first embodiment will be described below, and the same components will be denoted by the same reference signs and descriptions thereof will be omitted.

Figure 13:
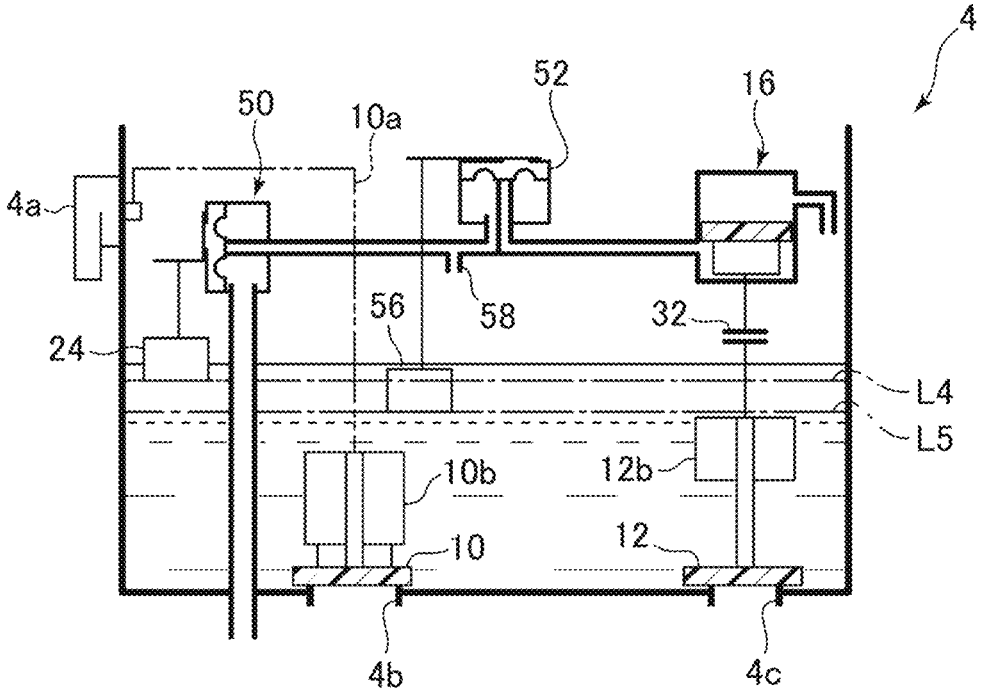
FIG. 13 is a cross-sectional view illustrating a schematic configuration of the flush water tank provided in the flush toilet device according to a third embodiment of the present invention.

FIG. 13 is a cross-sectional view illustrating a schematic configuration of the flush water tank provided in the flush toilet device according to the third embodiment of the present invention. FIG. 14 is a time chart illustrating operations of the flush toilet device according to the third embodiment of the present invention.

As illustrated in FIG. 13, the flush water tank 4 provided in the flush toilet device of the present embodiment includes the first drain valve 10, the second drain valve 12, a first ball tap 50, a second ball tap 52, and the hydraulic drive mechanism 16.

Similar to the ball tap 14 in the first embodiment described above, the first ball tap 50 is configured to operate in association with the water level in the flush water tank 4 and start water supply into the flush water tank. That is, the first ball tap 50 includes the float 24, and the float 24 moves up and down in association with the water level in the flush water tank 4, whereby the pilot valve is opened and closed and a main valve body of the first ball tap 50 is opened and closed. Furthermore, in the present embodiment, as the delay mechanism, the second ball tap 52 is provided in addition to the first ball tap 50.

The second ball tap 52 is provided on a downstream side of the first ball tap 50 and on an upstream side of the hydraulic drive mechanism 16 and, when the main valve body of the first ball tap 50 is opened, the supply of flush water to the second ball tap 52 is started. The second ball tap 52 includes a float 56 and is configured to open and close a built-in main valve body in association with the water level in the flush water tank 4. That is, the structure of the second ball tap 52 is also the same as the structure of the ball tap 14 in the first embodiment described above. Further, a water supply port 58 is provided in a pipe line between the first ball tap 50 and the second ball tap 52. In a state in which the first ball tap 50 is opened and the second ball tap 52 is closed, the entire amount of flush water flowing out from the first ball tap 50 is spouted from the water supply port 58 and flows into the flush water tank 4.

The first ball tap 50 is configured such that the main valve body is opened when the water level in the flush water tank 4 drops to a predetermined first water level $L_4$, and the second ball tap 52 is configured such that the main valve body is opened when the water level in the flush water tank 4 drops to a predetermined second water level $L_5$ lower than the first water level $L_4$. Accordingly, the second ball tap 52 is configured to be opened after the first drain valve 10 is opened and the water level in a first tank portion 54*a* starts to drop. Then, when the second ball tap 52 is opened, water supply to the hydraulic drive mechanism 16 is started.

Next, actions of the flush toilet device according to the third embodiment of the present invention will be described with new reference to FIG. 14.

Figure 14:
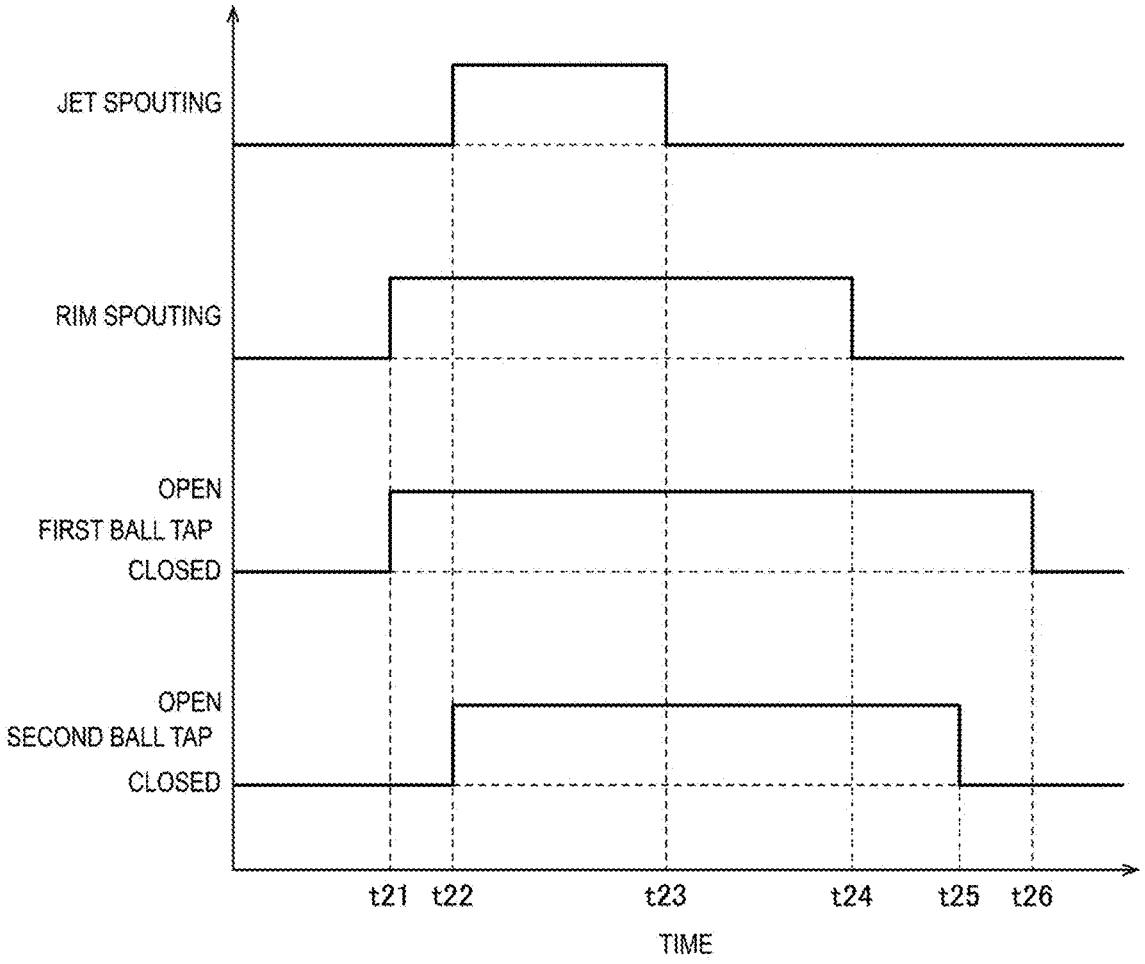
FIG. 14 is a time chart illustrating operation of the flush toilet device according to the third embodiment of the present invention.

First, at time t21 in FIG. 14, when the user rotates the lever handle 4*a* of the flush water tank 4, the bead chain 10*a* connected to the lever handle 4*a* pulls up the first drain valve 10. As a result, the first drain port 4*b* is opened, and flush water in the flush water tank 4 is spouted from the rim spout port.

The flush water is discharged from the first drain port 4*b*, causing the water level in the flush water tank 4 to drop. Then, when the water level in the flush water tank 4 drops to the predetermined first water level $L_4$, the main valve body of the first ball tap 50 is opened. In this state, the main valve body of the second ball tap 52 is not opened, and thus the entire amount of flush water supplied from the water supply source and flowing through the first ball tap 50 flows into the flush water tank 4 from the water supply port 58. Here, because the flow rate of flush water discharged from the first drain port 4*b* is greater than the flow rate of flush water flowing into the flush water tank 4 from the water supply port 58, the water level in the flush water tank 4 drops even after the first ball tap 50 is opened.

When the water level in the flush water tank 4 further drops to the predetermined second water level $L_5$, the main valve body of the second ball tap 52 is also opened. Thus, at time t22 in FIG. 14, water supply to the hydraulic drive mechanism 16 is started. When water is supplied to the hydraulic drive mechanism 16, the second drain valve 12 is pulled up by the hydraulic drive mechanism 16, starting spouting from the jet spout port 2*e*. The flush water supplied to the hydraulic drive mechanism 16 flows into the flush water tank 4 through the cylinder of the hydraulic drive mechanism 16. Note that, in a state in which the main valve body of the first ball tap 50 and the main valve body of the second ball tap 52 are opened, some of the flush water supplied to the flush water tank 4 flows into the flush water tank 4 from the water supply port 58, and the remaining flush water flows into the flush water tank 4 through the cylinder of the hydraulic drive mechanism 16.

After time t22, when the second drain valve 12 is pulled up to a predetermined height, the second drain valve 12 is separated from the rod of the hydraulic drive mechanism 16 by the clutch mechanism 32, and the second drain valve 12 starts to fall. Then, at time t23 in FIG. 14, the second drain valve 12 is seated on the second drain port 4*c*, and the spouting from the jet spout port 2*e* is stopped. Even after the second drain valve 12 is closed, the first ball tap 50 and the second ball tap 52 are maintained in the open state, and thus flush water continues to flow into the flush water tank 4 from the water supply port 58 and the hydraulic drive mechanism 16.

Since the first drain valve 10 is open even after the second drain valve 12 is closed, the water level in the flush water tank 4 drops even if flush water flows into the flush water tank 4. Then, at time t24 in FIG. 14, when the water level in the flush water tank 4 drops to the predetermined dead water level, the first drain valve 10 is seated on the first drain port 4*b*, and the spouting from the rim spout port 2*d* is stopped. When the first drain valve 10 is closed, the water level in the flush water tank 4 starts to rise.

Then, at time t25, when the water level in the flush water tank 4 exceeds the second water level $L_5$, the main valve body of the second ball tap 52 is closed. As a result, the entire amount of flush water supplied from the water supply source flows into the flush water tank 4 from the water supply port 58. Further, when the supply of flush water from the second ball tap 52 to the hydraulic drive mechanism 16 is stopped, the rod extending from the piston 16*b* of the hydraulic drive mechanism 16 lowers, and the rod is again coupled to the valve stem of the second drain valve 12 by the clutch mechanism 32.

Furthermore, at time t26, when the water level in the flush water tank 4 exceeds the first water level $L_4$, the main valve body of the first ball tap 50 is closed and the supply of flush water to the flush water tank 4 is also stopped. Accordingly, the supply of the flush water from the water supply source into the flush water tank 4 is stopped. Thus, one toilet flush is completed, and the flush toilet device returns to the toilet flush standby state illustrated in FIG. 13.

The flush toilet device according to the third embodiment of the present invention includes the first ball tap 50 that starts supplying flush water into the flush water tank 4 at the first water level $L_4$ (time t21 in FIG. 14) and the second ball tap 52 that starts supplying flush water to the hydraulic drive mechanism 16 at the second water level $L_5$ lower than the first water level $L_4$ (time t22 in FIG. 14). As a result, the time at which flush water is supplied to the hydraulic drive mechanism 16 can be set according to the arrangement of the float 56 of the second ball tap 52 as desired, and spouting can be started at a time suitable for flushing.

Next, a flush toilet device according to a fourth embodiment of the present invention will be described with reference to the accompanying drawings.

Figure 15:
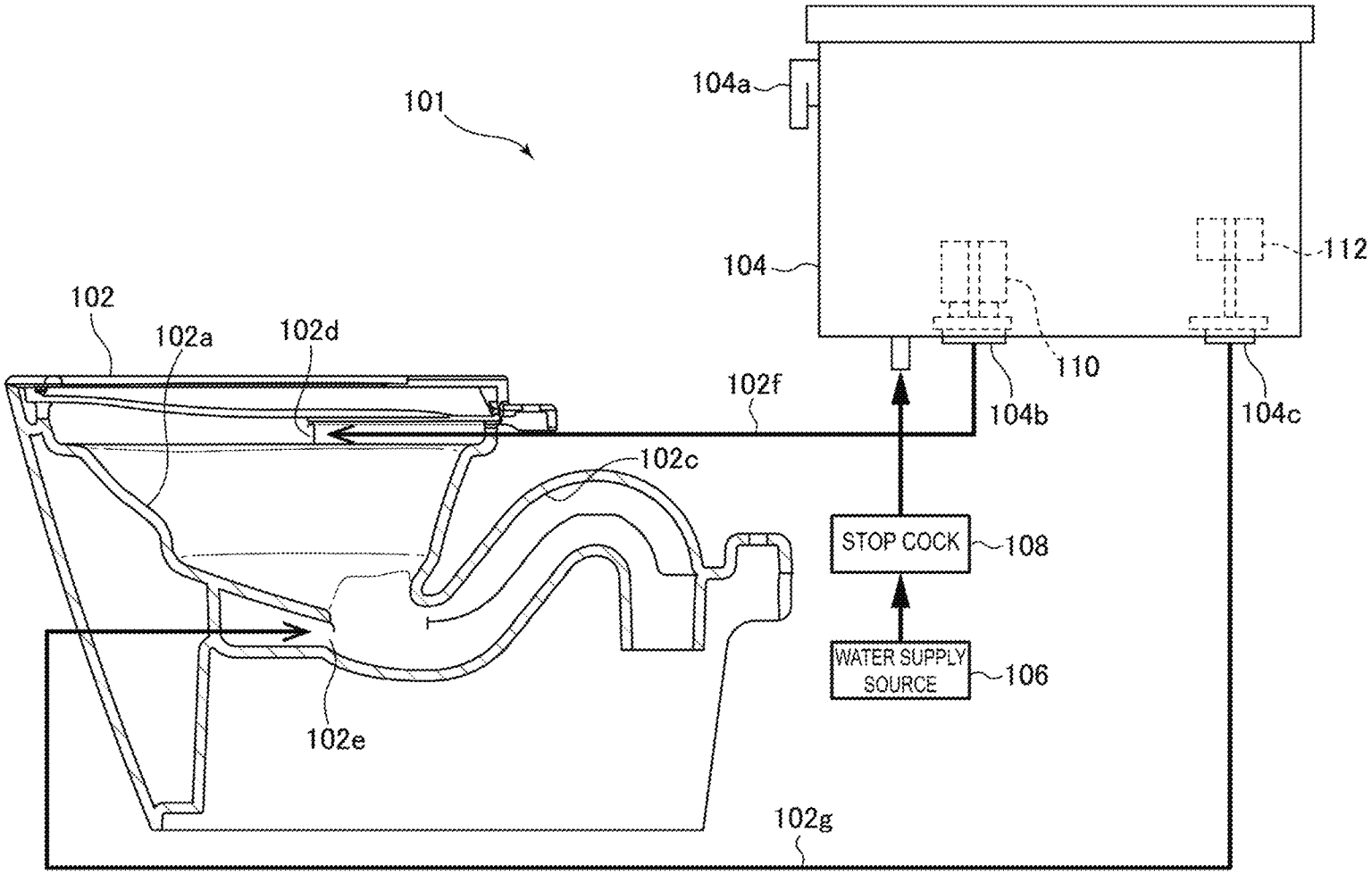
FIG. 15 is a block diagram illustrating a flush toilet device according to a fourth embodiment of the present invention.
Figure 16:
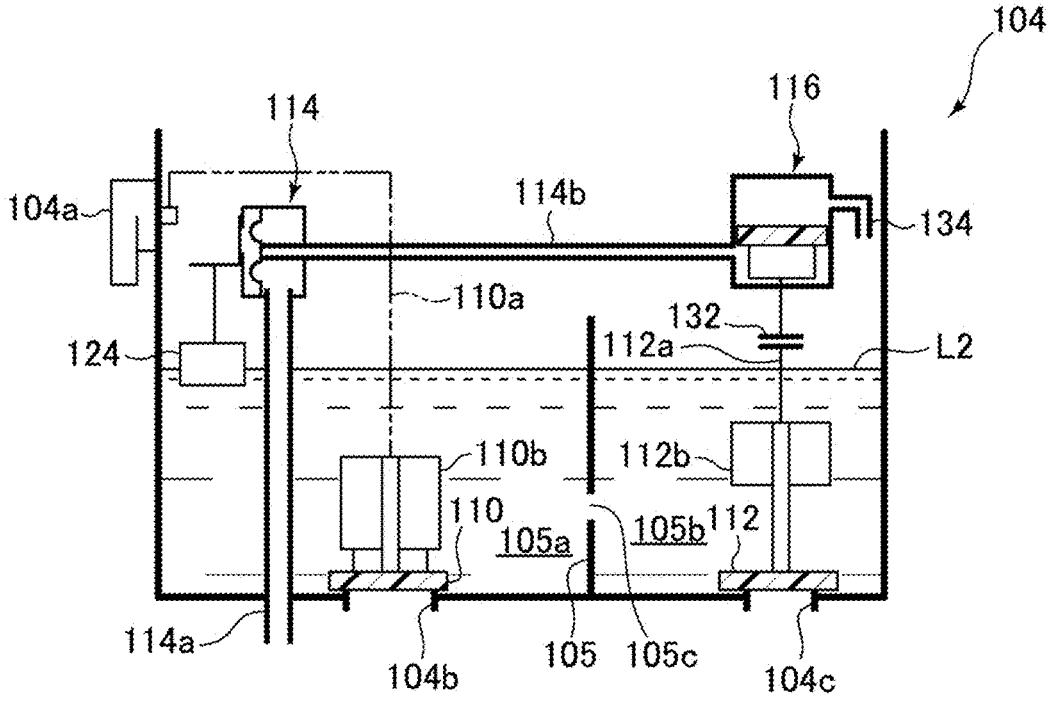
FIG. 16 is a cross-sectional view illustrating a schematic configuration of a flush water tank provided in the flush toilet device according to a fourth embodiment of the present invention.
Figure 17:
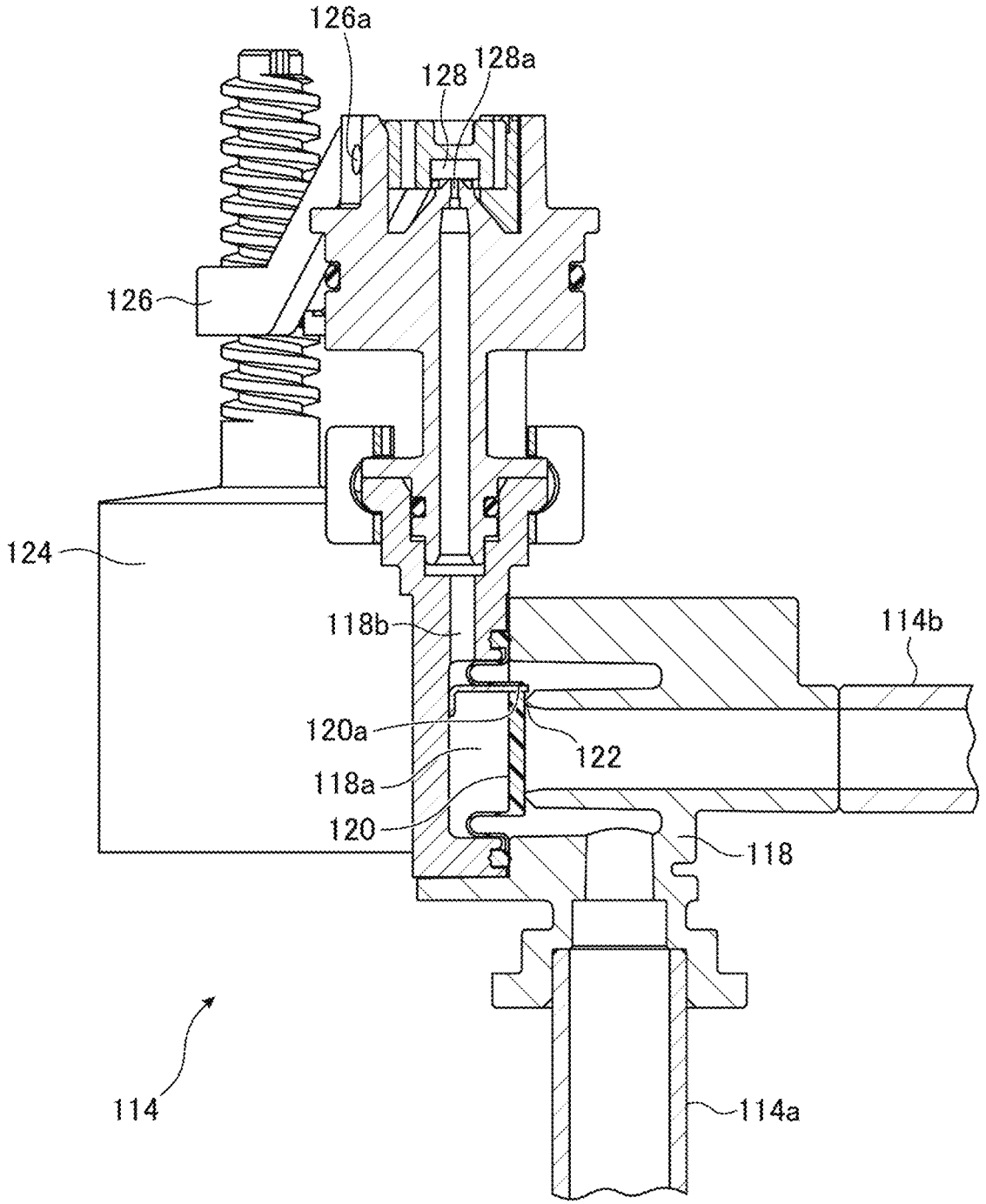
FIG. 17 is a cross-sectional view illustrating a structure of a ball tap incorporated into the flush water tank in the flush toilet device according to the fourth embodiment of the present invention.
Figure 18:
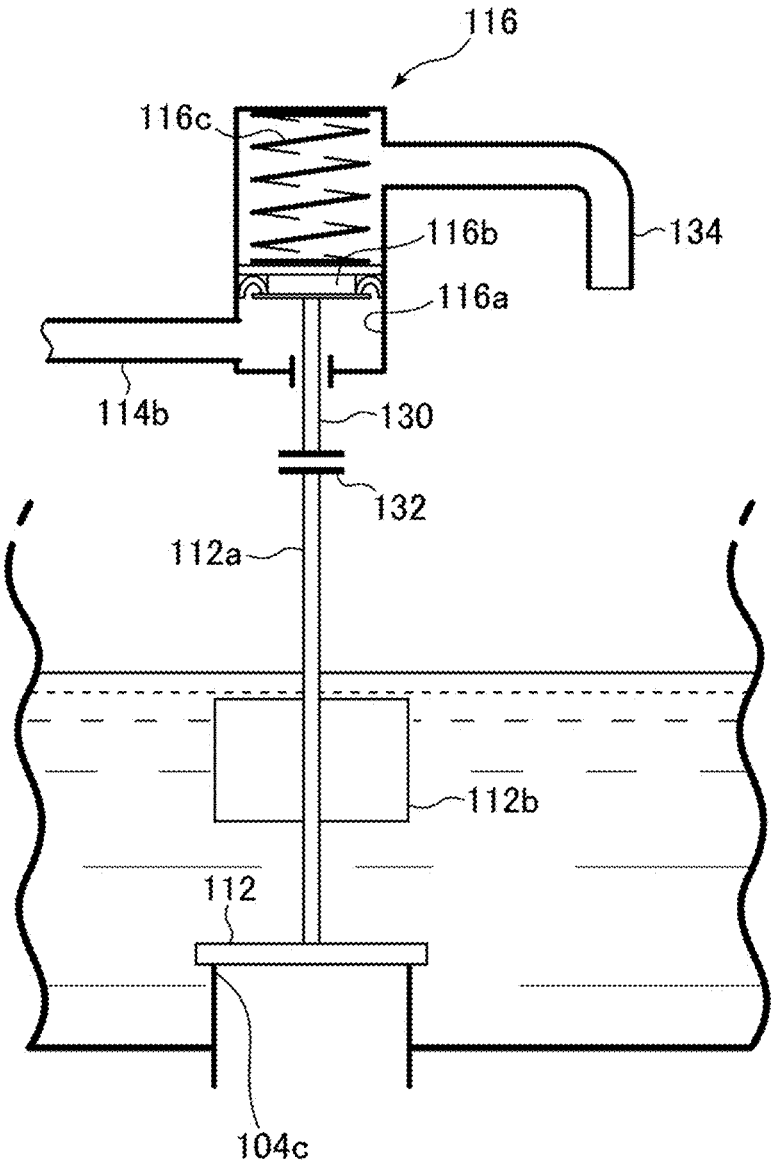
FIG. 18 is a cross-sectional view illustrating a structure of a hydraulic drive mechanism incorporated into the flush water tank in the flush toilet device according to the fourth embodiment of the present invention.

FIG. 15 is a block diagram illustrating the flush toilet device according to the fourth embodiment of the present invention. FIG. 16 is a cross-sectional view illustrating a schematic configuration of the flush water tank provided in the flush toilet device according to the fourth embodiment of the present invention. FIG. 17 is a cross-sectional view illustrating a structure of a ball tap incorporated into the flush water tank in the flush toilet device according to the fourth embodiment of the present invention. FIG. 18 is a cross-sectional view illustrating a structure of a hydraulic drive mechanism incorporated into the flush water tank in the flush toilet device according to the fourth embodiment of the present invention.

As illustrated in FIG. 15, a flush toilet device 101 according to the embodiment of the present invention includes a flush toilet main body 102, which is a flush toilet, and a flush water tank 104 disposed at a rear portion of the flush toilet main body 102. The flush toilet device 101 of the present embodiment is configured such that flushing is performed by operating a lever handle 104*a* provided on the flush water tank 104 after use of the flush toilet device 101. Note that, as an exemplary modification, the present invention may also be configured such that flushing is performed on the basis of a control signal from a remote control device (not illustrated) or a detection signal from a human presence sensor (not illustrated).

The flush toilet main body 102 includes a bowl 102*a* and a drain trap conduit 102*c* extending from a lower portion of the bowl 102*a*. Further, a rim spout port 102*d* is provided at an upper edge portion of the bowl 102*a*, and a jet spout port 102*e* is provided at the lower portion of the bowl 102*a*. When the toilet is flushed, flush water is spouted from the rim spout port 102*d* and the jet spout port 102*e* at predetermined times, a waste receiving surface of the bowl 102*a* is flushed, and waste and flush water in the bowl 102*a* are discharged to the drain trap conduit 102*c*. The waste and flush water discharged to the drain trap conduit 102*c* are discharged to a sewer pipe (not illustrated) through a drain socket (not illustrated).

Flush water is supplied to the flush water tank 104 from a water supply source 106 such as a tap water supply line through a stop cock 108, and the supplied flush water is stored up to a predetermined water level in the flush water tank 104. The stop cock 108 is provided for stopping the supply of flush water to the flush water tank 104 during maintenance or the like, and is normally in an "open" state. The flush water tank 104 includes a first drain valve 110 and a second drain valve 112, which are configured to open and close a first drain port 104*b* and a second drain port 104*c* provided at a bottom portion of the flush water tank 104, respectively.

Flush water flowing out from the first drain port 104*b* passes through a rim conduit 102*f* formed inside the flush toilet main body 102 and is spouted from the rim spout port 102*d*. Accordingly, the first drain valve 110 switches between spouting and stopping the flush water from the rim spout port 102*d* by opening and closing the first drain port 104*b* provided in the flush water tank 104. Further, flush water flowing out from the second drain port 104*c* passes through a jet conduit 102*g* formed inside the flush toilet main body 102 and is spouted from the jet spout port 102*e*. Accordingly, the second drain valve 112 switches between spouting and stopping the flush water from the jet spout port 102*e* by opening and closing the second drain port 104*c* provided in the flush water tank 104.

Next, an internal structure of the flush water tank 104 will be described with reference to FIG. 16.

As illustrated in FIG. 16, the flush water tank 104 includes the first drain valve 110 that opens and closes the first drain port 104*b*, the second drain valve 112 that opens and closes the second drain port 104*c*, a ball tap 114 which is a delay mechanism, and a hydraulic drive mechanism 116.

The flush water tank 104 is a tank configured to store flush water to be supplied to the flush toilet main body 102, and the first drain port 104*b* and the second drain port 104*c* for discharging the stored flush water to the flush toilet main body 102 are formed at the bottom portion of the flush water tank 104. Furthermore, a partition wall 105 is provided inside the flush water tank 104 and divides the flush water tank 104 into a first tank portion 105*a* provided with the first drain port 104*b* and a second tank portion 105*b* provided with the second drain port 104*c*. Further, a small hole 105*c* is formed at a predetermined height position of the partition wall 105. The first tank portion 105*a* and the second tank portion 105*b* are in communication with each other at a predetermined water level by this small hole 105*c*.

The first drain valve 110 is a valve body disposed so as to open and close the first drain port 104*b*, and the first drain port 104*b* is opened by the first drain valve 110 being pulled up. As a result, flush water in the first tank portion 105*a* of the flush water tank 104 is discharged to the rim conduit 102*f* (FIG. 15) of the flush toilet main body 102, and spouted from the rim spout port 102*d*.

In the present embodiment, when the user rotates the lever handle 104*a* provided on the flush water tank 104, a bead chain 110*a* (schematically illustrated in FIG. 16) coupled to the first drain valve 110 is pulled, pulling up the first drain valve 110. Further, in the present embodiment, the first drain valve 110 is a valve body including a floating ball 110*b*. The first drain valve 110 is configured to, after being pulled up from the first drain port 104*b* and opened, gradually fall as the water level in the first tank portion 105*a* drops, closing when the water level drops to a predetermined water level.

The second drain valve 112 is a valve body disposed so as to open and close the second drain port 104*c*, and the second drain port 104*c* is opened by the second drain valve 112 being pulled up. As a result, flush water in the second tank portion 105*b* of the flush water tank 104 is discharged to the jet conduit 102*g* (FIG. 15) of the flush toilet main body 102 and spouted from the jet spout port 102*e*.

In the present embodiment, the second drain valve 112 is configured to be pulled up from the second drain port 104*c* by the hydraulic drive mechanism 116. The second drain valve 112 is a valve body including a valve stem 112*a* extending upward and a floating ball 112*b*, and the valve stem 112*a* is pulled up by the hydraulic drive mechanism 116. Then, when pulled up to a predetermined height, the second drain valve 112 is separated from the hydraulic drive mechanism 116 and gradually falls as the water level in the second tank portion 105*b* drops, closing the second drain port 104*c*.

Further, in the present embodiment, the floating ball 112*b* of the second drain valve 112 is attached at a position higher than that of the floating ball 110*b* of the first drain valve 110. Thus, the second drain valve 112 is seated on and closes the second drain port 104*c* in a state in which the water level in the second tank portion 105*b* is relatively high. That is, even if the water levels of the first tank portion 105*a* and the second tank portion 105*b* drop while maintaining the same water level, the second drain valve 112 is seated on and closes the second drain port 104*c* earlier than the first drain valve 110.

The ball tap 114, which is a delay mechanism, is configured such that flush water supplied from the water supply source 106 flows in through an inflow pipe 114*a* and, by the action of this ball tap 114, the second drain valve 112 is opened later than the first drain valve 110 in the present embodiment.

Next, a configuration of the ball tap 114 will be described with reference to FIG. 17.

As illustrated in FIG. 17, the ball tap 114 includes a main portion 118 to which the inflow pipe 114*a* and an outflow pipe 114*b* are connected, a main valve body 120 disposed in the main portion 118, a valve seat 122 on which the main valve body 120 is seated, an arm portion 126 that is rotated by a float 124, and a pilot valve 128 that is moved by rotation of the arm portion 126. That is, the ball tap 114 includes the float 124 that operates in association with the water level in the flush water tank 104, and is configured to supply flush water to the hydraulic drive mechanism 116 when the float 124 lowers to a predetermined position.

The main portion 118 is a member provided with a connecting portion for the inflow pipe 114*a* at a lower portion thereof and a connecting portion for the outflow pipe 114*b* on one side thereof. Further, the valve seat 122 is formed inside the main portion 118. The valve seat 122 is in communication with the outflow pipe 114*b* connected to the connecting portion. Furthermore, the main valve body 120 is disposed inside the main portion 118 so as to open and close the valve seat 122. When the valve seat 122 is open, tap water from the inflow pipe 114*a* passes through the valve seat 122 and flows out to the outflow pipe 114*b*. Further, the outflow pipe 114*b* is connected to the hydraulic drive mechanism 116.

The main valve body 120 is a diaphragm-type valve body having a substantially disk shape, and is attached in the main portion 118 so as to be seated on and unseated from the valve seat 122. Further, a bleed hole 120*a* is provided in a peripheral edge portion of the main valve body 120. In the main portion 118, a pressure chamber 118*a* is formed on a side (left side in FIG. 17) of the main valve body 120 opposite to the valve seat 122. That is, the pressure chamber 118*a* is defined by an inner wall surface of the main portion 118 and by the main valve body 120 and, when pressure in the pressure chamber 118*a* increases, the main valve body 120 is pressed against the valve seat 122 by this pressure and is seated on the valve seat 122.

Furthermore, in the pressure chamber 118*a* provided in the main portion 118, a pressure passageway 118*b* extends upward with the pressure chamber 118*a* in communication therewith, and a pilot valve port 128*a* is provided at an upper end of the pressure passageway 118*b*. This pilot valve port 128*a* opens upward and is configured to be opened and closed by the pilot valve 128.

On the other hand, the float 124 is supported by the arm portion 126, and the arm portion 126 is rotatably supported by a support shaft 126*a*. Furthermore, the pilot valve 128 is coupled to the arm portion 126, and the pilot valve 128 is configured to be moved in the vertical direction in association with the rotation of the arm portion 126. As a result, in a state in which the water level in the first tank portion 105*a* of the flush water tank 104 has risen to or above the predetermined set water level $L_1$, the float 124 is pushed upward, and the pilot valve 128 is accordingly moved downward and seated on the pilot valve port 128*a*, closing the pilot valve port 128*a*. Meanwhile, when the flush water in the first tank portion 105*a* is discharged and the water level in the first tank portion 105*a* drops, the float 124 moves downward and the pilot valve 128 moves upward, opening the pilot valve port 128*a*. Therefore, the pilot valve port 128*a* of the main portion 118 is closed during toilet flush standby state where the water level in the first tank portion 105*a* is higher than the set water level $L_1$.

Further, the tap water flowing into the main portion 118 from the inflow pipe 114*a* flows into a space having a ring configuration surrounding the valve seat 122, passes through the bleed hole 120*a* of the main valve body 120, and flows into the pressure chamber 118*a*. In a state in which the pilot valve port 128*a* is closed by the pilot valve 128, there is no outflow channel for the tap water flowing from the bleed hole 120*a* into the pressure chamber 118*a*, which increases the pressure in the pressure chamber 118*a*. When the pressure in the pressure chamber 118*a* increases, the main valve body 120 is pressed toward the valve seat 122 (to the right side in FIG. 17) by this pressure, and the valve seat 122 is closed by the main valve body 120.

Meanwhile, when the first drain valve 110 is opened by the flushing operation and the water level in the first tank portion 105*a* of the flush water tank 104 drops below the set water level $L_1$, the float 124 moves downward, the pilot valve 128 moves upward, and the pilot valve port 128*a* is opened. When the pilot valve port 128*a* is opened, the water in the pressure chamber 118*a* flows out from the pilot valve port 128*a*, and, as a result, the pressure in the pressure chamber 118*a* drops. Accordingly, the main valve body 120 is moved so as to separate from the valve seat 122 (to the left side in FIG. 17), and the valve seat 122 is opened. In this way, in a state in which the pilot valve port 128*a* is opened, the pressure in the pressure chamber 118*a* does not rise, and thus the valve seat 122 is in an open state.

Next, a configuration of the hydraulic drive mechanism 116 will be described with reference to FIG. 18.

The hydraulic drive mechanism 116 is configured to drive the second drain valve 112 by using the supply pressure of the flush water supplied from the tap water supply line to the flush water tank 104. Specifically, the hydraulic drive mechanism 116 includes a cylinder 116*a* into which the water supplied from the ball tap 114 flows, a piston 116*b* slidably disposed in the cylinder 116*a*, and a rod 130 that protrudes from a lower end of the cylinder 116*a* and drives the second drain valve 112. Furthermore, a spring 116*c* is disposed inside the cylinder 116*a*, urging the piston 116*b* downward, and a rubber seal is attached to the piston 116*b*, ensuring water tightness between an inner wall surface of the cylinder 116*a* and the piston 116*b*. Further, a clutch mechanism 132 is provided at a lower end of the rod 130. The clutch mechanism 132 couples and separates the rod 130 and the valve stem 112*a* of the second drain valve 112.

The cylinder 116*a* is a member having a cylindrical shape, is disposed with its axis oriented in the vertical direction, and slidably receives the piston 116*b* therein. The outflow pipe 114*b* extending from the ball tap 114 is connected to a lower end portion of the cylinder 116*a* such that flush water flowing out from the ball tap 114 flows into the cylinder 116*a*. Therefore, the piston 116*b* in the cylinder 116*a* is pushed up by the water flowing into the cylinder 116*a* while overcoming the urging force of the spring 116*c*.

On the other hand, an outflow hole is provided in an upper end portion of the cylinder 116*a*, and a water supply pipe 134 is in communication with the inside of the cylinder 116*a* via the outflow hole. Accordingly, when water flows into the cylinder 116*a* from the outflow pipe 114*b* connected to a lower portion of the cylinder 116*a*, the piston 116*b* is pushed upward from the lower portion of the cylinder 116*a*. Accordingly, when the piston 116*b* is pushed up to a position higher than the outflow hole, the water flowing into the cylinder 116*a* flows out from the outflow hole and into the water supply pipe 134. Further, the flush water flowing into the water supply pipe 134 falls into the second tank portion 105*b* of the flush water tank 104, and the flush water is supplied to the flush water tank 104.

The rod 130 is a rod-shaped member connected to a lower surface of the piston 116*b*, and protrudes downwardly from the inside of the cylinder 116*a* through a through hole formed in a bottom surface of the cylinder 116*a*. The valve stem 112*a* of the second drain valve 112 is connected to the lower end of the rod 130 via the clutch mechanism 132, and the rod 130 couples the piston 116*b* and the second drain valve 112. Therefore, when the water flows into the cylinder 116*a* and the piston 116*b* is pushed up, the rod 130 connected to the piston 116*b* lifts the second drain valve 112 upward, opening the second drain valve 112.

Further, a gap is provided between the rod 130 downwardly protruding from the inside of the cylinder 116*a* and an inner wall of the through hole of the cylinder 116*a*, and some of the water flowing into the cylinder 116*a* flows out from the gap. The water flowing out from the gap flows into the second tank portion 105*b*. Herein, since the gap is relatively narrow, the gap has large flow channel resistance. Thus, even in a state in which the water flows out from the gap, the water flowing from the outflow pipe 114*b* into the cylinder 116*a* causes the pressure in the cylinder 116*a* to increase and pushes the piston 116*b* up against the urging force of the spring 116*c*.

Furthermore, the clutch mechanism 132 detachably couples the rod 130 and the second drain valve 112. The clutch mechanism 132 is configured to separate the valve stem 112*a* of the second drain valve 112 from the rod 130 when the second drain valve 112 is lifted a predetermined distance together with the rod 130. In a state in which the valve stem 112*a* and the rod 130 are separated by the clutch mechanism 132, the second drain valve 112 is not accompanied with the movement of the piston 116*b* and an upper portion of the rod 130, and the second drain valve 112 falls as the water level in the second tank portion 105*b* of the flush water tank 104 drops.

Next, actions of the flush toilet device 101 according to the fourth embodiment of the present invention will be described with new reference to FIG. 19 to FIG. 24.

FIG. 19 to FIG. 23 are schematic views for explaining operations of the flush toilet device 101 according to the fourth embodiment of the present invention. FIG. 24 is a time chart illustrating operation of the flush toilet device 101 according to the fourth embodiment of the present invention.

First, in the toilet flush standby state described above, as illustrated in FIG. 16, the first drain port 104*b* and the second drain port 104*c* of the flush water tank 104 are closed by the first drain valve 110 and the second drain valve 112, respectively. The first tank portion 105*a* and the second tank portion 105*b* of the flush water tank 104 are in communication with each other via the small hole 105*c* of the partition wall 105. Thus, the water level of the first tank portion 105*a* is equal to that of the second tank portion 105*b* in the standby state. The initial water level $L_2$ inside the flush water tank 104 is higher than the predetermined set water level $L_1$ (the reason that the initial water level $L_2$ is higher than the set water level $L_1$ will be described below). As a result, the pilot valve port 128*a* of the main portion 118 (FIG. 17) of the ball tap 114 is closed, and the valve seat 122 is closed by the main valve body 120.

Figure 19:
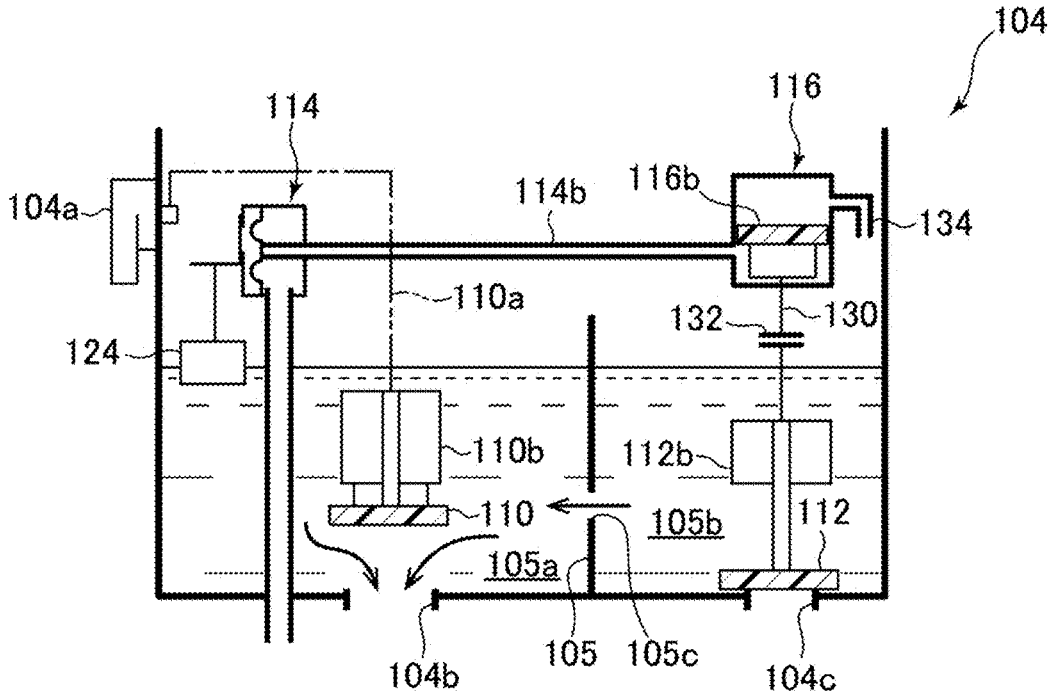
FIG. 19 is a schematic view for explaining operation of the flush toilet device according to the fourth embodiment of the present invention.

Next, at time t101 in FIG. 24, when the user rotates the lever handle 104*a* of the flush water tank 104 to flush the toilet, the bead chain 110*a* connected to the lever handle 104*a* pulls up the first drain valve 110. As a result, as illustrated in FIG. 19, the first drain valve 110 is separated from the first drain port 104*b*, opening the first drain port 104*b*. When the first drain port 104*b* is opened, the flush water stored in the first tank portion 105*a* of the flush water tank 104 flows from the first drain port 104*b* into the rim conduit 102*f* (FIG. 15) and is spouted from the rim spout port 102*d*. The rim spouting from the rim spout port 102*d* generates a circulating flow on the waste receiving surface of the bowl 102*a*, flushing the waste receiving surface. Note that, when the water level in the first tank portion 105*a* has lowered below the water level in the second tank portion 105*b* due to the discharge of flush water, the flush water in the second tank portion 105*b* flows into the first tank portion 105*a* little by little through the small hole 105*c* of the partition wall 105.

Figure 20:
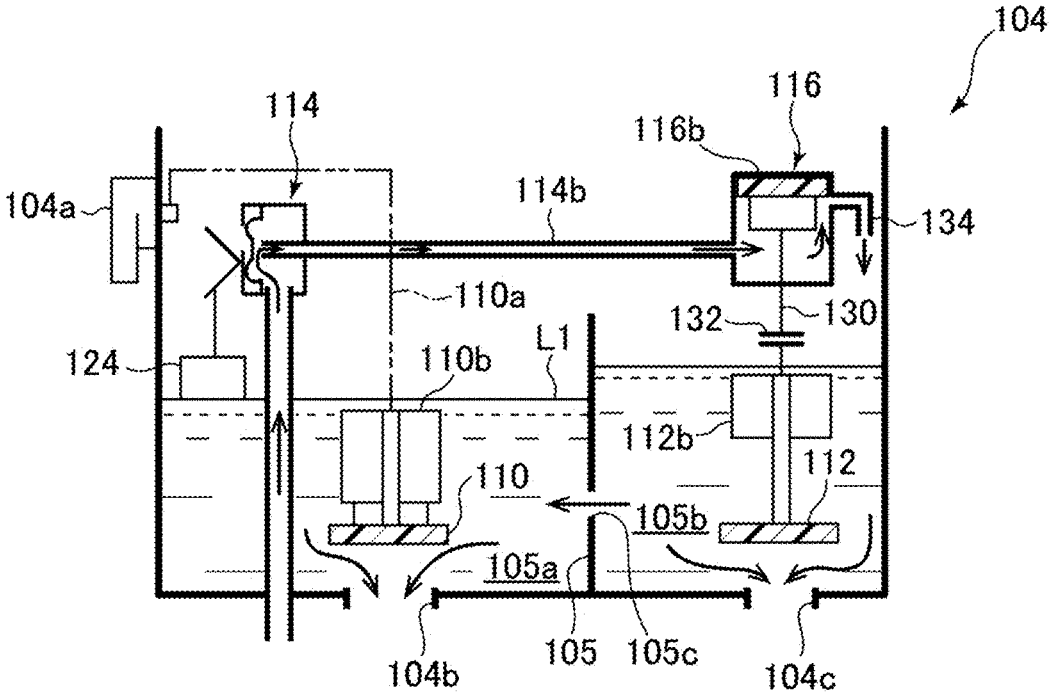
FIG. 20 is a schematic view for explaining operation of the flush toilet device according to the fourth embodiment of the present invention.

The flush water is discharged from the first drain port 104*b*, causing the water level in the first tank portion 105*a* to drop. Then, when the water level in the first tank portion 105*a* has lowered below the set water level $L_1$ at time t102 in FIG. 24, the float 124 of the ball tap 114 lowers, opening the pilot valve 128 (FIG. 17). As a result, the pressure in the pressure chamber 118*a* drops, opening the main valve body 120 and starting water supply to the hydraulic drive mechanism 116, as illustrated in FIG. 20.

When flush water is supplied to the hydraulic drive mechanism 116, the flush water flowing into the cylinder 116*a* (FIG. 18) pushes the piston 116*b* up by overcoming the urging force of the spring 116*c*. As a result, the rod 130 coupled to the piston 116*b* pulls up the valve stem 112*a* of the second drain valve 112, opening the second drain port 104*c*. That is, the second drain valve 112 is driven and opened by the water supply pressure of the tap water supplied through the ball tap 114.

When the second drain port 104*c* is opened, the flush water stored in the second tank portion 105*b* of the flush water tank 104 flows from the second drain port 104*c* into the jet conduit 102*g* (FIG. 15) and is spouted from the jet spout port 102*e*. The jet spouting from the jet spout port 102*e* fills the drain trap conduit 102*c* and induces a siphon action. When the siphon action is generated, residual water and waste in the bowl 102*a* are suctioned into the drain trap conduit 102*c* and discharged to a sewer pipe (not illustrated).

Figure 21:
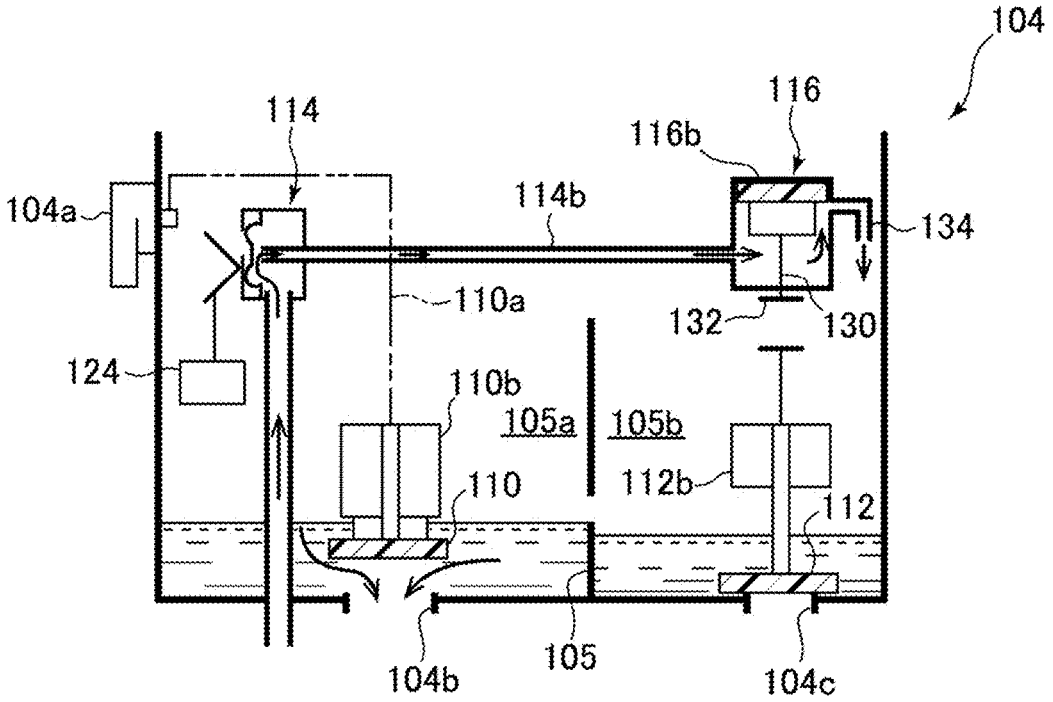
FIG. 21 is a schematic view for explaining operation of the flush toilet device according to the fourth embodiment of the present invention.

When the second drain valve 112 is pulled up to a predetermined height together with the piston 116*b* of the hydraulic drive mechanism 116, the valve stem 112*a* of the second drain valve 112 is separated from the rod 130 by the clutch mechanism 132 (FIG. 18). As a result, the second drain valve 112 falls toward the second drain port 104*c*. Then, at time t103 in FIG. 24, as illustrated in FIG. 21, the second drain valve 112 is seated on the second drain port 104*c*, closing the second drain port 104*c*. As a result, the jet spouting from the jet spout port 102*e* is stopped. Note that, as described above, since the floating ball 112*b* of the second drain valve 112 is attached at a relatively high position, the second drain valve 112 is seated on the second drain port 104*c* earlier than the first drain valve 110, even if the water level inside the first tank portion 105*a* and the water level inside the second tank portion 105*b* are about the same.

In the state illustrated in FIG. 21, the main valve body 120 of the ball tap 114 is open, and thus flush water supplied from the water supply source 106 (tap water supply line) is supplied to the hydraulic drive mechanism 116 via the ball tap 114 and flows into the second tank portion 105*b* from the water supply pipe 134 connected to the cylinder 116*a*. Meanwhile, since the first drain valve 110 is still open, the flush water in the first tank portion 105*a* flows out from the first drain port 104*b* and is spouted from the rim spout port 102*d*. After the jet spouting is stopped at time t103 in FIG. 24, the flush water spouted from the rim spout port 102*d* is used as refill water for returning the water level in the bowl 102*a* to the residual water level in the standby state.

Figure 22:
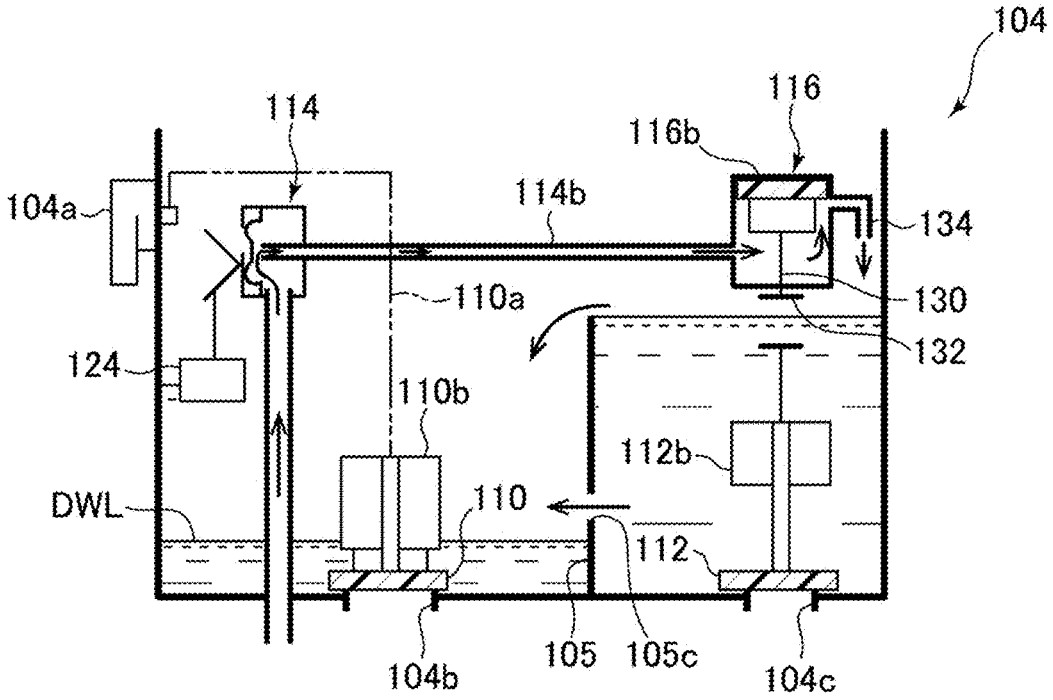
FIG. 22 is a schematic view for explaining operation of the flush toilet device according to the fourth embodiment of the present invention.

Here, the flow rate of flush water flowing from the second tank portion 105*b* into the first tank portion 105*a* through the small hole 105*c* of the partition wall 105 is small. Thus, even if water is supplied from the water supply pipe 134 into the second tank portion 105*b*, the water level in the first tank portion 105*a* drops and the first drain valve 110 falls accordingly. Then, when the water level in the first tank portion 105*a* drops to the dead water level DWL at time t104 in FIG. 24, as illustrated in FIG. 22, the first drain valve 110 is seated on the first drain port 104*b*, and the first drain valve 110 is closed. The rim spouting from the rim spout port 102*d* is thereby stopped.

Furthermore, the main valve body 120 of the ball tap 114 is maintained in an open state even after the first drain valve 110 is closed, and, as a result the flush water supplied from the water supply source 106 (tap water supply line) flows into the second tank portion 105*b* of the flush water tank 104 from the water supply pipe 134 via the ball tap 114 and the hydraulic drive mechanism 116. Then, when the water level in the second tank portion 105*b* exceeds the height of the small hole 105*c* in the partition wall 105, flush water flows from the second tank portion 105*b* into the first tank portion 105*a* through the small hole 105*c*. Furthermore, when the water level in the second tank portion 105*b* further rises, flush water flows over the partition wall 105, from the second tank portion 105*b* into the first tank portion 105*a*. As a result, the water level in the first tank portion 105*a* rises. Then, as illustrated in FIG. 23, when the water level in the first tank portion 105*a* rises to the set water level $L_1$, the float 124 of the ball tap 114 rises, closing the pilot valve 128 (FIG. 17).

When the pilot valve 128 is closed in this way, flush water flowing into the pressure chamber 118*a* from the bleed hole 120*a* provided in the main valve body 120 of the ball tap 114 cannot flow out, causing the pressure in the pressure chamber 118*a* to rise. Then, at time t105 in FIG. 24, the main valve body 120 is pressed by the pressure in the pressure chamber 118*a* and seated on the valve seat 122, closing the main valve body 120. As a result, the water supply from the water supply source 106 to the hydraulic drive mechanism 116 via the ball tap 114 is stopped, thereby stopping the supply of flush water into the flush water tank 104.

Figure 23:
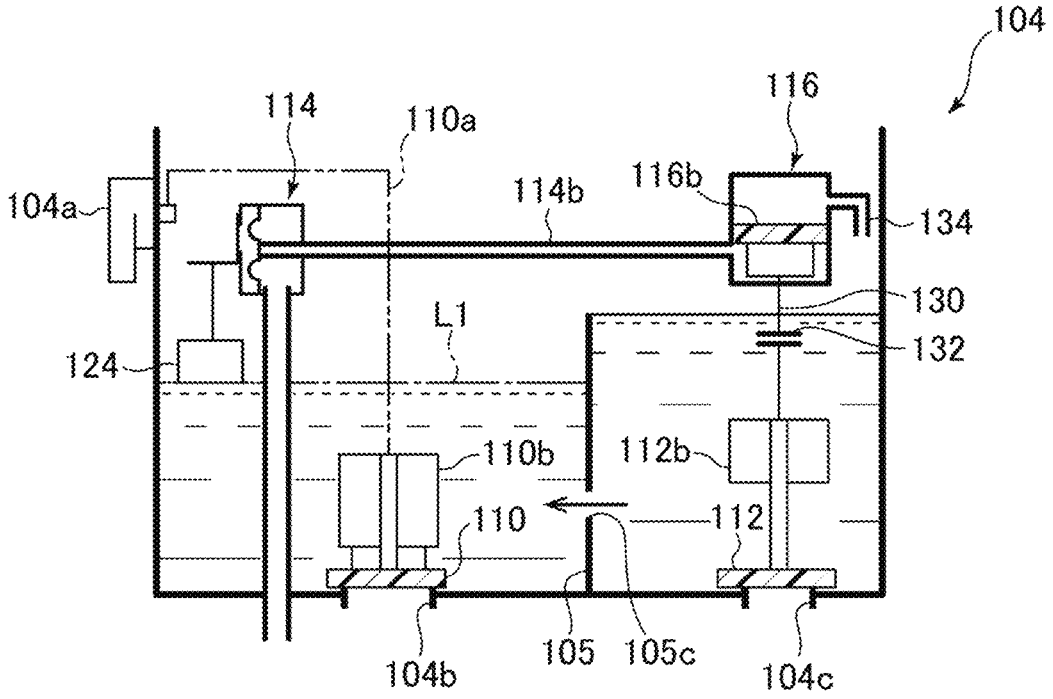
FIG. 23 is a schematic view for explaining operation of the flush toilet device according to the fourth embodiment of the present invention.
Figure 24:
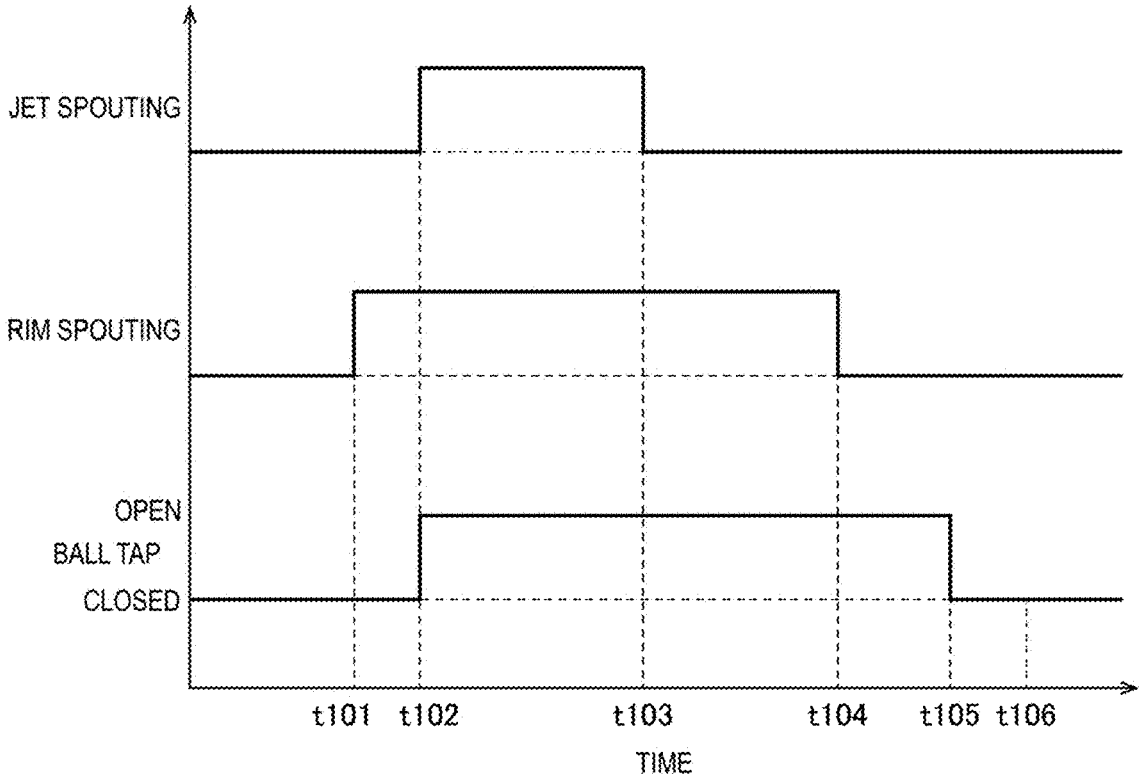
FIG. 24 is a time chart illustrating operation of the flush toilet device according to the fourth embodiment of the present invention.
Figure 26:
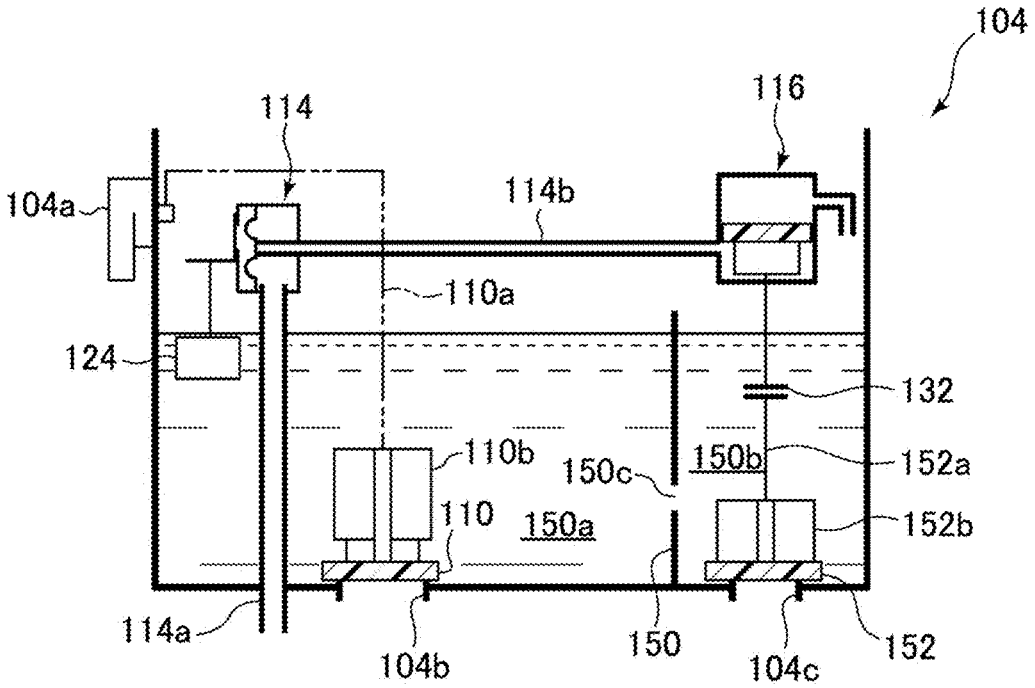
FIG. 26 is a cross-sectional view illustrating a schematic configuration of the flush water tank provided in the flush toilet device according to a sixth embodiment of the present invention.

At time t105 in FIG. 24, at the time point when water supply to the hydraulic drive mechanism 116 is stopped, since the flush water supplied from the hydraulic drive mechanism 116 flows into the second tank portion 105*b*, the water level in the second tank portion 105*b* is higher than the water level in the first tank portion 105*a*, as illustrated in FIG. 23. Therefore, the flush water in the second tank portion 105*b* flows into the first tank portion 105*a* through the small hole 105*c* in the partition wall 105. Accordingly, after time t105 in FIG. 24, the water level in the second tank portion 105*b* drops below the height of the partition wall 105, and the water level in the first tank portion 105*a* rises to exceed the set water level $L_1$. Finally, at time t106 in FIG. 24, the water levels of the first tank portion 105*a* and the second tank portion 105*b* become equal and return to the initial water level $L_2$ (FIG. 26).

Meanwhile, when the water supply to the hydraulic drive mechanism 116 is stopped, the piston 116*b* (FIG. 18) in the cylinder 116*a* which has been pushed up by the water supply is pushed down by the urging force of the spring 116*c*. Accordingly, the rod 130 attached to the piston 116*b* also lowers. When the rod 130 falls to a predetermined position, the rod 130 is coupled again to the valve stem 112*a* of the second drain valve 112 by the clutch mechanism 132. Thus, one toilet flush is completed, and the flush toilet device 101 returns to the toilet flush standby state illustrated in FIG. 16.

Thus, the water level in the first tank portion 105*a* of the flush water tank 104 rises to the set water level $L_1$, the pilot valve 128 is closed (time t105 in FIG. 24), the main valve body 120 of the ball tap 114 is closed, and subsequently the flush water in the second tank portion 105*b* flows into the first tank portion 105*a* through the small hole 105*c* of the partition wall 105. Therefore, at time t106 following time t105 in FIG. 24, the water level in the first tank portion 105*a* reaches the initial water level $L_2$, which is higher than the set water level $L_1$.

As a result, the initial water level $L_2$ in the first tank portion 105*a* in the standby state of the flush toilet device 101 is set to a higher water level than the predetermined set water level $L_1$ at which the pilot valve 128 is closed. Therefore, at the time point when the user operates the lever handle 104*a* in the standby state (time t101 in FIG. 24), the water level in the first tank portion 105*a* is higher than the set water level $L_1$, and the main valve body 120 of the ball tap 114 is closed. Then, between times t101 and t102, during which a predetermined amount of flush water is discharged from the first drain port 104*b* as rim spouting and the water level in the first tank portion 105*a* drops to the set water level $L_1$, the pilot valve 128 is opened and the main valve body 120 of the ball tap 114 is also opened. As a result, at time t102, water supply to the hydraulic drive mechanism 116 is started, the second drain valve 112 is opened by the hydraulic drive mechanism 116, and jet spouting is started.

According to the flush toilet device 101 of the fourth embodiment of the present invention, the spouting and stopping of flush water from the rim spout port 102*d* are switched by the first drain valve 110 and the spouting and stopping of flush water from the jet spout port 102*e* are switched by the second drain valve 112. With this configuration, it is possible to independently set the times for rim spouting and jet spouting as desired and effectively flush the bowl 102*a* of the flush toilet main body 102. Further, since the second drain valve 112 is opened by the hydraulic drive mechanism 116 by using the supply pressure of the flush water, the drain valve can be pulled up without using electric power such as that generated by a motor, and thus the spouting time from the jet spout port 102*e* can be set without the use of a complex mechanism for opening the drain valve. Furthermore, since the first drain valve 110 is closed after the second drain valve 112 is closed, the spouting from the rim spout port 102*d* is continued even after the spouting from the jet spout port 102*e* is completed and waste in the bowl 102*a* is discharged to the drain trap conduit 102*c*. Accordingly, it is possible to set the water level retained in the bowl 102*a* to an appropriate water level by refilling.

Further, according to the flush toilet device 101 of the present embodiment, the first tank portion 105*a* provided with the first drain port 104*b* and the second tank portion 105*b* provided with the second drain port 104*c* are divided by the partition wall 105, making it possible to suppress variations in the amount of flush water spouted from each spout port. As a result, it is possible to perform appropriate flushing of the bowl 102*a* and appropriately set the retained water level in the bowl 102*a* after completion of one flush while suppressing the amount of flush water.

Furthermore, according to the flush toilet device 101 of the present embodiment, the partition wall 105 of the flush water tank 104 has the small hole 105*c* through which the first tank portion 105*a* and the second tank portion 105*b* are in communication with each other at a predetermined water level. With this configuration, flush water flows from the second tank portion 105*b* into the first tank portion 105*a* when the water level in the second tank portion 105*b* is higher than the water level in the first tank portion 105*a*. As a result, a drop in the water level of the first tank portion 105*a* is delayed, making it possible to lengthen the time period during which the first drain valve 110 is open. Therefore, the amount of flush water spouted from the rim spout port 102*d* can be increased, and spouting from the rim spout port 102*d* can be continued even after spouting from the jet spout port 102*e* is completed. Thus, by performing refill, the water level retained in the bowl 102*a* can be set to an appropriate water level.

Next, the flush toilet device according to a fifth embodiment of the present invention will be described with reference to FIG. 25.

The flush toilet device of the present embodiment differs from that of the fourth embodiment described above in the configuration for delaying the closing of the first drain valve relative to the closing of the second drain valve. Thus, only the components and actions of the fifth embodiment of the present invention that differ from those of the fourth embodiment will be described below, and the same components will be denoted by the same reference signs and descriptions thereof will be omitted.

Figure 25:
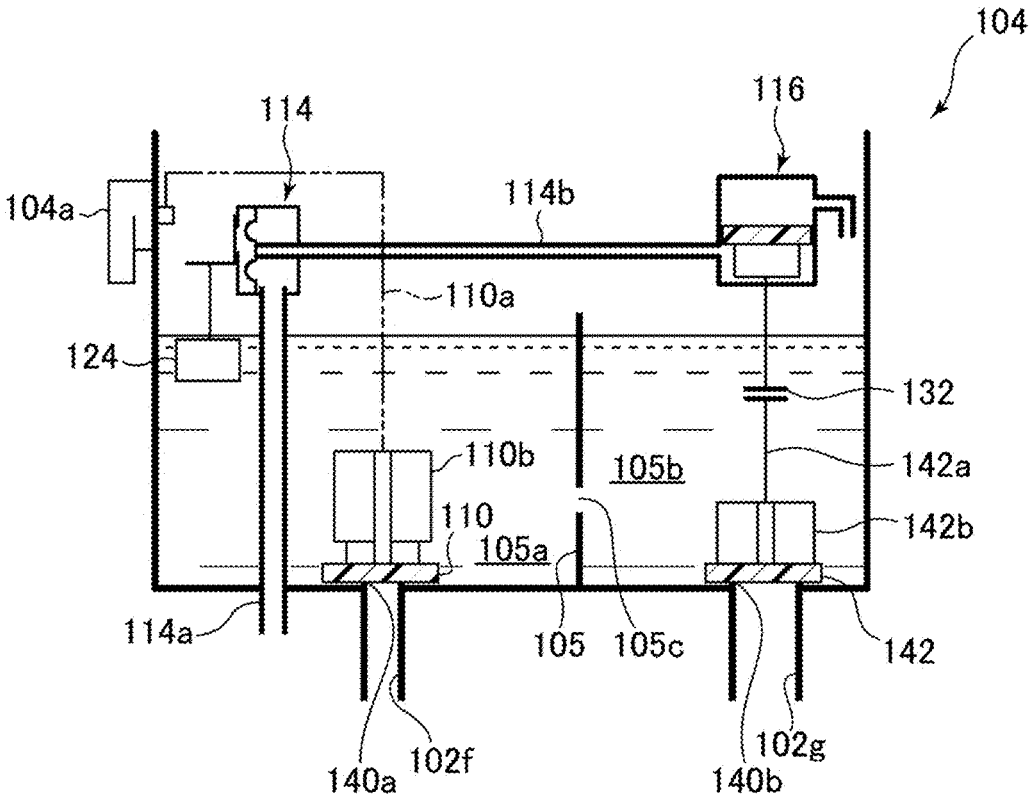
FIG. 25 is a cross-sectional view illustrating a schematic configuration of the flush water tank provided in the flush toilet device according to a fifth embodiment of the present invention.

FIG. 25 is a cross-sectional view illustrating a schematic configuration of the flush water tank provided in the flush toilet device according to the fifth embodiment of the present invention.

As illustrated in FIG. 25, the flush water tank 104 provided in the flush toilet device of the present embodiment includes the first drain valve 110, a second drain valve 142, the ball tap 114, and the hydraulic drive mechanism 116. As in the fourth embodiment described above, a first drain port 140*a* configured to be opened and closed by the first drain valve 110 and a second drain port 140*b* configured to be opened and closed by the second drain valve 142 are formed on the bottom surface of the flush water tank 104. Furthermore, the partition wall 105 is provided inside the flush water tank 104 to divide the flush water tank 104 into the first tank portion 105*a* provided with the first drain port 140*a* and the second tank portion 105*b* provided with the second drain port 140*b*. Further, the partition wall 105 is provided with the small hole 105*c*.

In the present embodiment, a flow channel cross-sectional area of the first drain port 140*a* configured to be opened and closed by the first drain valve 110 and the rim conduit 102*f* that is in communication therewith is configured to be smaller than a flow channel cross-sectional area of the second drain port 140*b* configured to be opened and closed by the second drain valve 142 and the jet conduit 102*g* that is in communication therewith. Thus, a pressure loss of the rim conduit 102*f* through which the first drain port 140*a* and the rim spout port 102*d* are in communication with each other is set greater than a pressure loss of the jet conduit 102*g* through which the second drain port 140*b* and the jet spout port 102*e* are in communication with each other.

On the other hand, in the fourth embodiment, the floating ball 112*b* of the second drain valve 112 is attached at a position higher than that of the floating ball 110*b* of the first drain valve 110, and thus the second drain valve 112 is closed earlier for the same water level drop. In contrast, as illustrated in FIG. 25, in the present embodiment, the floating ball 142*b* of the second drain valve 142 is attached at substantially the same height as the floating ball 110*b* of the first drain valve 110.

Next, operation of the flush toilet device according to the fifth embodiment of the present invention will be described.

First, when the user rotates the lever handle 104*a* of the flush water tank 104, the bead chain 110*a* connected to the lever handle 104*a* pulls up the first drain valve 110. As a result, the first drain port 140*a* is opened, and flush water in the first tank portion 105*a* of the flush water tank 104 is spouted from the rim spout port.

The flush water is discharged from the first drain port 140*a*, and the water level in the first tank portion 105*a* drops. However, as in the fourth embodiment, since the initial water level $L_2$ in the first tank portion 105*a* is higher than the predetermined set water level $L_1$ at which the pilot valve 128 is closed, the main valve body of the ball tap 114 is maintained in the closed state.

When the water level in the first tank portion 105*a* further drops below the set water level $L_1$, the float 124 of the ball tap 114 lowers, opening the pilot valve. As a result, the main valve body 120 of the ball tap 114 is opened, starting water supply to the hydraulic drive mechanism 116. When water is supplied to the hydraulic drive mechanism 116, the second drain valve 142 is pulled up by the hydraulic drive mechanism 116, discharging the flush water from the second tank portion 105*b* and starting spouting from the jet spout port 102*e*. After the second drain valve 142 is pulled up, a valve stem 142*a* of the second drain valve 142 is separated from the rod 130 of the hydraulic drive mechanism 116 by the clutch mechanism 132.

The first drain valve 110 is pulled up and subsequently falls in association with the drop of the water level in the first tank portion 105*a*, and the second drain valve 142 is pulled up and subsequently falls in association with the drop of the water level in the second tank portion 105*b*. In the present embodiment, the pressure loss of the rim conduit 102*f* through which the first drain port 140*a* and the rim spout port 102*d* are in communication with each other is greater than the pressure loss of the jet conduit 102*g* through which the second drain port 140*b* and the jet spout port 102*e* are in communication with each other. Therefore, in the present embodiment, the water level in the second tank portion 105*b* which discharges flush water through the second drain port 140*b* drops earlier than the water level in the first tank portion 105*a*.

In the present embodiment, although the floating ball 142*b* of the second drain valve 142 and the floating ball 110*b* of the first drain valve 110 are provided at substantially the same height, because the water level in the second tank portion 105*b* drops quickly, the second drain valve 142 is closed earlier than the first drain valve 110. In this way, after the second drain valve 142 is closed and the jet spouting is stopped, the first drain valve 110 is closed and the rim spouting is stopped after a delay. Further, the operations after the rim spouting is stopped, and then the flush water tank 104 returns to the standby state are the same as the operations in the fourth embodiment described above, and thus description thereof will be omitted.

According to the flush toilet device of the fifth embodiment of the present invention, since the pressure loss of the rim conduit 102*f* is set greater than the pressure loss of the jet conduit 102*g*, the flow amount of flush water flowing out from the first tank portion 105*a* per unit time is less than the flow amount of flush water flowing out from the second tank portion 105*b* per unit time. As a result, the water level in the first tank portion 105*a* drops more gradually than the water level in the second tank portion 105*b*, and flush water in the first tank portion 105*a* continues to be spouted from the rim spout port 102*d* even after the water level in the second tank portion 105*b* drops and the second drain valve 142 is closed. Thus, even after spouting from the jet spout port 102*e* is completed, spouting from the rim spout port 102*d* is continued. Accordingly, it is possible to set the water level retained in the bowl 102*a* to an appropriate water level by refilling.

Next, the flush toilet device according to a sixth embodiment of the present invention will be described with reference to FIG. 26.

The flush toilet device of the present embodiment differs from that of the fourth embodiment described above in the configuration for delaying the closing of the first drain valve relative to the closing of the second drain valve. Thus, only the components and operations of the sixth embodiment of the present invention that differ from those of the fourth embodiment will be described below, and the same components will be denoted by the same reference signs and descriptions thereof will be omitted.

FIG. 26 is a cross-sectional view illustrating a schematic configuration of the flush water tank provided in the flush toilet device according to the sixth embodiment of the present invention.

As illustrated in FIG. 26, the flush water tank 104 provided in the flush toilet device of the present embodiment includes the first drain valve 110, a second drain valve 152, the ball tap 114, and the hydraulic drive mechanism 116. As in the fourth embodiment described above, the first drain port 104*b* configured to be opened and closed by the first drain valve 110 and the second drain port 104*c* configured to be opened and closed by the second drain valve 152 are formed on the bottom surface of the flush water tank 104. Furthermore, a partition wall 150 is provided inside the flush water tank 104 to divide the flush water tank 104 into a first tank portion 150*a* provided with the first drain port 104*b* and a second tank portion 150*b* provided with the second drain port 104*c*. Further, the partition wall 150 is provided with a small hole 150*c*.

In the present embodiment, the volume of the first tank portion 150*a* in which the first drain valve 110 is disposed is larger than the volume of the second tank portion 150*b* in which the second drain valve 152 is disposed. In the present embodiment, a flow channel cross-sectional area of the first drain port 104*b* configured to be opened and closed by the first drain valve 110 and a flow channel cross-section area of the second drain port 104*c* configured to be opened and closed by the second drain valve 152 are configured to be substantially the same.

On the other hand, in the fourth embodiment, the floating ball 112*b* of the second drain valve 112 is attached at a position higher than that of the floating ball 110*b* of the first drain valve 110, and thus the second drain valve 112 is closed earlier for the same water level drop. In contrast, as illustrated in FIG. 26, in the present embodiment, a floating ball 152*b* of the second drain valve 152 and the floating ball 110*b* of the first drain valve 110 are attached at substantially the same height.

Next, operation of the flush toilet device according to the sixth embodiment of the present invention will be described.

First, when the user rotates the lever handle 104*a* of the flush water tank 104, the bead chain 110*a* connected to the lever handle 104*a* pulls up the first drain valve 110. As a result, the first drain port 104*b* is opened, and flush water in the first tank portion 150*a* of the flush water tank 104 is spouted from the rim spout port.

The flush water is discharged from the first drain port 104*b*, and the water level in the first tank portion 150*a* drops. However, as in the first embodiment, since the initial water level $L_2$ in the first tank portion 150*a* is higher than the predetermined set water level $L_1$ at which the pilot valve 128 is closed, the main valve body of the ball tap 114 is maintained in the closed state.

When the water level in the first tank portion 150*a* further drops below the set water level $L_1$, the float 124 of the ball tap 114 lowers, opening the pilot valve. As a result, the main valve body 120 of the ball tap 114 is opened, starting water supply to the hydraulic drive mechanism 116. When water is supplied to the hydraulic drive mechanism 116, the second drain valve 152 is pulled up by the hydraulic drive mechanism 116, discharging the flush water from the second tank portion 150*b* and starting spouting from the jet spout port 102*e*. After the second drain valve 152 is pulled up, the clutch mechanism 132 separates a valve stem 152*a* of the second drain valve 152 from the rod 130 of the hydraulic drive mechanism 116.

The first drain valve 110 is pulled up and subsequently lowers in association with the drop of the water level in the first tank portion 150*a*, and the second drain valve 152 is pulled up and subsequently lowers in association with the drop of the water level in the second tank portion 150*b*. In the present embodiment, the first tank portion 150*a* has a volume larger than the volume of a second tank portion 150*b*. Therefore, in the present embodiment, although the flow amount per unit time of the flush water discharged from the first drain port 104*b* is substantially the same as that from the second drain port 104*c*, the water level in the second tank portion 150*b* drops earlier than the water level in the first tank portion 150*a*.

Furthermore, in the present embodiment, although the floating ball 152*b* of the second drain valve 152 and the floating ball 110*b* of the first drain valve 110 are provided at substantially the same height, because the water level in the second tank portion 150*b* drops quickly, the second drain valve 152 is closed earlier than the first drain valve 110. In this way, after the second drain valve 152 is closed and the jet spouting is stopped, the first drain valve 110 is closed later and the rim spouting is stopped. Further, after the rim spouting is stopped, the operations until the flush water tank 104 returns to the standby state are the same as in the fourth embodiment described above, and thus description thereof will be omitted.

According to the flush toilet device of the sixth embodiment of the present invention, since the first tank portion 150*a* is formed with the volume larger than the volume of the second tank portion 150*b*, the water level in the first tank portion 150*a* drops more gradually than the water level in the second tank portion 150*b*. As a result, flush water in the first tank portion 150*a* continues to be spouted from the rim spout port even after the water level in the second tank portion 150*b* drops and the second drain valve 152 is closed. Thus, even after spouting from the jet spout port is completed, spouting from the rim spout port 102*d* is continued. Accordingly, it is possible to set the water level retained in the bowl 102*a* to an appropriate water level by refilling.

Next, a flush toilet device according to a seventh embodiment of the present invention will be described with reference to the accompanying drawings.

Figure 27:
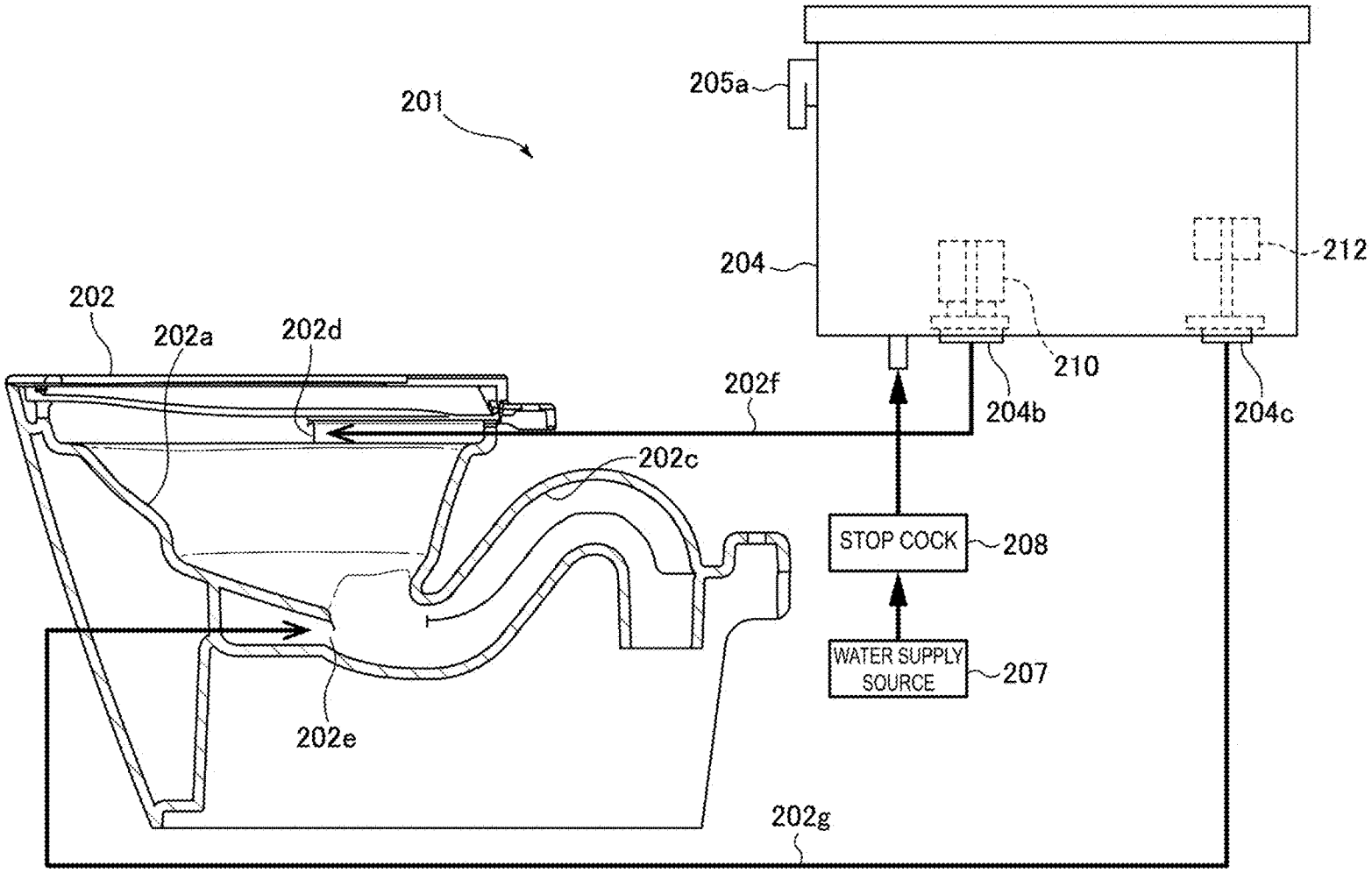
FIG. 27 is a block diagram illustrating a flush toilet device according to a seventh embodiment of the present invention.
Figure 28:
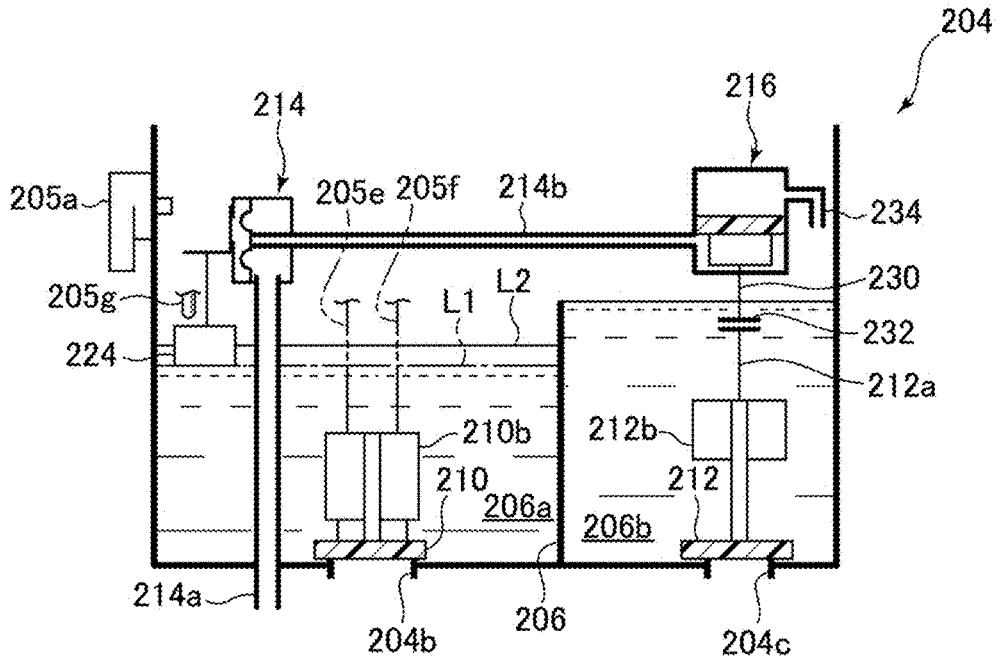
FIG. 28 is a cross-sectional view illustrating a schematic configuration of a flush water tank provided in the flush toilet device according to the seventh embodiment of the present invention.
Figure 29:
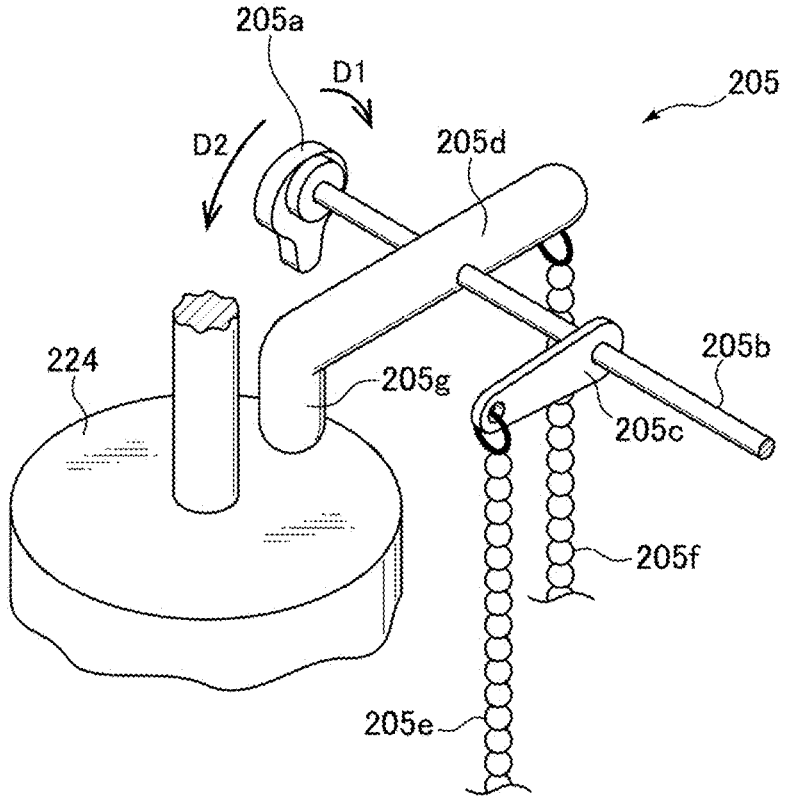
FIG. 29 is an extracted schematic view illustrating a schematic configuration of an operation unit provided in the flush water tank of the flush toilet device according to the seventh embodiment of the present invention.
Figure 30:
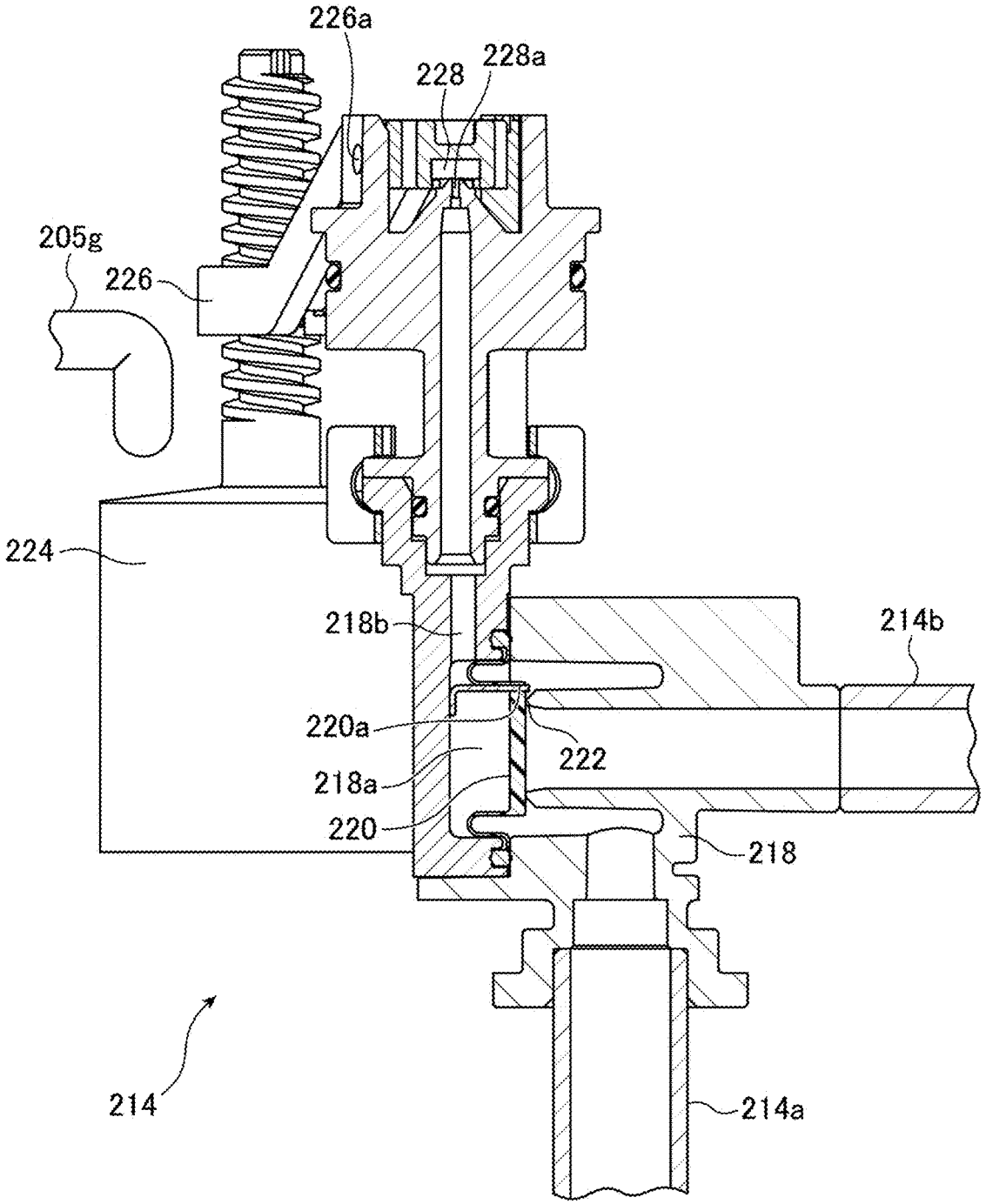
FIG. 30 is a cross-sectional view illustrating a structure of a ball tap incorporated into the flush water tank in the flush toilet device according to the seventh embodiment of the present invention.
Figure 31:
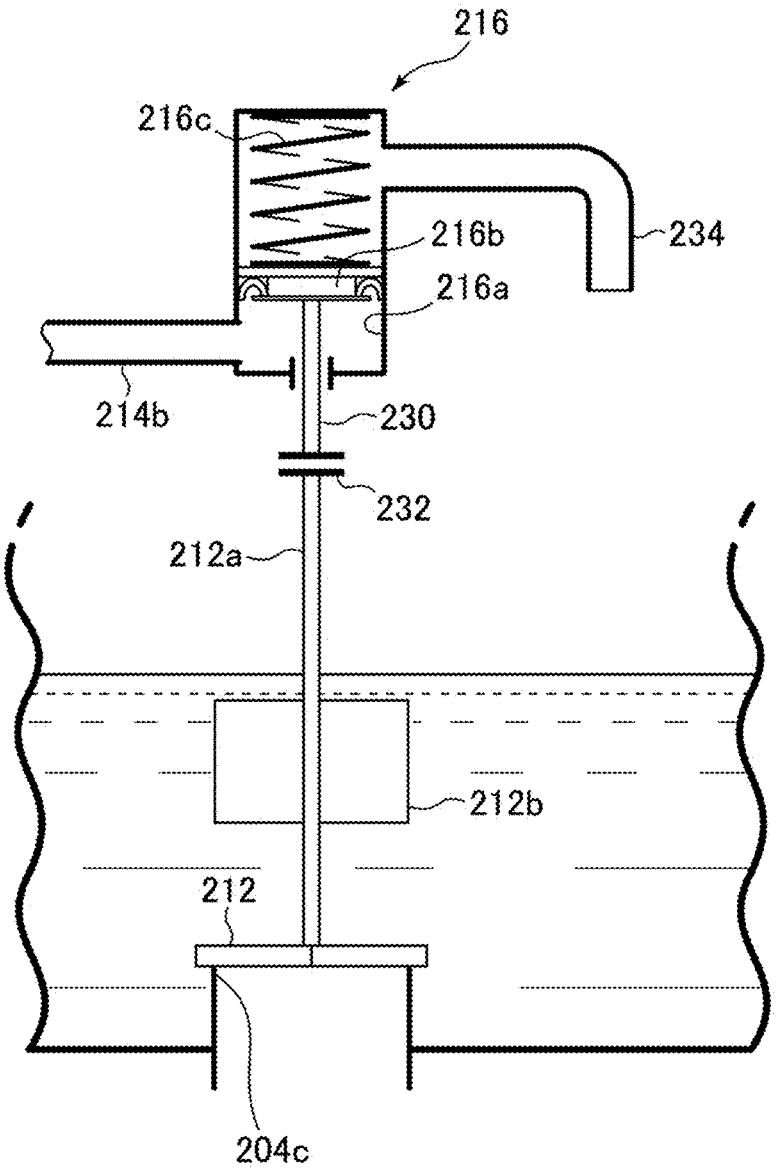
FIG. 31 is a cross-sectional view illustrating a structure of a hydraulic drive mechanism incorporated into the flush water tank in the flush toilet device according to the seventh embodiment of the present invention.

FIG. 27 is a block diagram illustrating the flush toilet device according to the seventh embodiment of the present invention. FIG. 28 is a cross-sectional view illustrating a schematic configuration of a flush water tank provided in the flush toilet device according to the seventh embodiment of the present invention. FIG. 29 is an extracted schematic diagram illustrating a schematic configuration of an operation unit provided in the flush water tank of the flush toilet device according to the seventh embodiment of the present invention. FIG. 30 is a cross-sectional view illustrating a structure of a ball tap incorporated into the flush water tank in the flush toilet device according to the seventh embodiment of the present invention. FIG. 31 is a cross-sectional view illustrating a structure of a hydraulic drive mechanism incorporated into the flush water tank in the flush toilet device according to the seventh embodiment of the present invention.

As illustrated in FIG. 27, a flush toilet device 201 according to the embodiment of the present invention includes a flush toilet main body 202, which is a flush toilet, and a flush water tank 204 disposed at a rear portion of the flush toilet main body 202. The flush toilet device 201 of the present embodiment is configured such that flushing is performed by operating a lever handle 205*a* provided on the flush water tank 204 after use of the flush toilet device 201. Note that, as an exemplary modification, the present invention may also be configured such that flushing is performed on the basis of a control signal from a remote control device (not illustrated) or a detection signal from a human presence sensor (not illustrated).

The flush toilet main body 202 includes a bowl 202*a* and a drain trap conduit 202*c* extending from a lower portion of the bowl 202*a*. Further, a rim spout port 202*d* is provided at an upper edge portion of the bowl 202*a*, and a jet spout port 202*e* is provided at the lower portion of the bowl 202*a*. When the toilet is flushed, flush water is spouted from the rim spout port 202*d* and the jet spout port 202*e* at predetermined times, a waste receiving surface of the bowl 202*a* is flushed, and waste and flush water in the bowl 202*a* are discharged to the drain trap conduit 202*c*. The waste and flush water discharged to the drain trap conduit 202*c* are discharged to a sewer pipe (not illustrated) through a drain socket (not illustrated).

Flush water is supplied to the flush water tank 204 from a water supply source 207 such as a tap water supply line through a stop cock 208, and the supplied flush water is stored up to a predetermined water level in the flush water tank 204. The stop cock 208 is provided for stopping the supply of flush water to the flush water tank 204 during maintenance or the like, and is normally in an "open" state. The flush water tank 204 includes a first drain valve 210 and a second drain valve 212, which are configured to open and close a first drain port 204*b* and a second drain port 204*c* provided at a bottom portion of the flush water tank 204, respectively.

Flush water flowing out from the first drain port 204*b* passes through a rim conduit 202*f* formed inside the flush toilet main body 202 and is spouted from the rim spout port 202*d*. Accordingly, the first drain valve 210 switches between spouting and stopping the flush water from the rim spout port 202*d* by opening and closing the first drain port 204*b* provided in the flush water tank 204. Further, flush water flowing out from the second drain port 204*c* passes through a jet conduit 202*g* formed inside the flush toilet main body 202 and is spouted from the jet spout port 202*e*. Accordingly, the second drain valve 212 switches between spouting and stopping the flush water from the jet spout port 202*e* by opening and closing the second drain port 204*c* provided in the flush water tank 204.

Next, an internal structure of the flush water tank 204 will be described with reference to FIG. 28.

As illustrated in FIG. 28, the flush water tank 204 includes the first drain valve 210 that opens and closes the first drain port 204*b*, the second drain valve 212 that opens and closes the second drain port 204*c*, a ball tap 214 which is a delay mechanism, and a hydraulic drive mechanism 216.

The flush water tank 204 is a tank configured to store flush water to be supplied to the flush toilet main body 202, and the first drain port 204*b* and the second drain port 204*c* for discharging the stored flush water to the flush toilet main body 202 are formed at the bottom portion of the flush water tank 204. Furthermore, a partition wall 206 is provided inside the flush water tank 204 to divide the flush water tank 204 into a first tank portion 206*a* provided with the first drain port 204*b* and a second tank portion 206*b* provided with the second drain port 204*c*.

The first drain valve 210 is a valve body disposed so as to open and close the first drain port 204*b*, and the first drain port 204*b* is opened by the first drain valve 210 being pulled up. As a result, flush water in the first tank portion 206*a* of the flush water tank 204 is discharged to the rim conduit 202*f* (FIG. 27) of the flush toilet main body 202, and spouted from the rim spout port 202*d*. Further, in the present embodiment, the first drain valve 210 is a valve body including a floating ball 210*b*. The first drain valve 210 is configured to, after being pulled up from the first drain port 204*b* and opened, gradually fall as the water level in the first tank portion 206*a* drops.

In the present embodiment, when the user rotates the lever handle 205*a* provided on the flush water tank 204, the first drain valve 210 is pulled up and the first drain valve 210 is opened. Further, in the present embodiment, a full flush mode and a light flush mode can be selectively executed on the basis of the rotational direction of the lever handle 205*a*. Note that the lever handle 205*a* constitutes part of an operation unit 205. The operation unit 205 selectively executes the full flush mode and the light flush mode. The light flush mode is a mode in which the amount of flush water supplied to the bowl 202*a* is less than that in the full flush mode and a flushing sequence differs from that in the full flush mode. A configuration of the operation unit 205 will be described below.

The second drain valve 212 is a valve body disposed so as to open and close the second drain port 204*c*, and the second drain port 204*c* is opened by the second drain valve 212 being pulled up. As a result, flush water in the second tank portion 206*b* of the flush water tank 204 is discharged to the jet conduit 202*g* (FIG. 27) of the flush toilet main body 202 and spouted from the jet spout port 202*e*.

In the present embodiment, the second drain valve 212 is configured to be pulled up from the second drain port 204*c* by the hydraulic drive mechanism 216. The second drain valve 212 is a valve body including a valve stem 212*a* extending upward and a floating ball 212*b*, and the valve stem 212*a* is pulled up by the hydraulic drive mechanism 216. Then, when pulled up to a predetermined height, the valve stem 212*a* is separated from the hydraulic drive mechanism 216 and gradually falls as the water level in the second tank portion 206*b* drops, closing the second drain port 204*c*.

The ball tap 214, which is a delay mechanism, is configured such that flush water supplied from the water supply source 207 flows in through the inflow pipe 214*a* and, by the action of this ball tap 214, the second drain valve 212 opens later than the first drain valve 210 during a full flush.

Next, a configuration of the operation unit 205 will be described with reference to FIG. 29.

As illustrated in FIG. 29, the operation unit 205 includes the lever handle 205*a*, which is a handle provided on a side surface of the flush water tank 204, a shaft 205*b* configured to be rotated by the lever handle 205*a*, a first arm 205*c* and a second arm 205*d* attached to the shaft, a full flush bead chain 205*e* coupling the first arm 205*c* and the first drain valve 210, and a light flush bead chain 205*f* coupling the second arm 205*d* and the first drain valve 210.

The lever handle 205*a* is a lever provided on the side surface of the flush water tank 204 and is configured to be rotatable to a front side and a rear side of the flush toilet device 201. Thus, the full flush mode and the light flush mode can be selectively executed on the basis of the direction of rotation.

The shaft 205*b* is a rod-like member fixed to the lever handle 205*a* and extending horizontally in a width direction of the flush toilet device 201 in an upper portion of the flush water tank 204. The shaft 205*b* is rotatably supported with respect to the flush water tank 204, and is rotated together with the lever handle 205*a* when the lever handle 205*a* is rotated.

The first arm 205*c* is an elongated member fixed in a direction orthogonal to the shaft 205*b* and extends horizontally frontward of the flush toilet device 201. One end of the full flush bead chain 205*e* is attached to an endmost portion of the first arm 205*c*, and the other end of the full flush bead chain 205*e* is fixed to the first drain valve 210. With this configuration, when the lever handle 205*a* is rotated in the direction of the arrow D1, which is a first direction, the endmost portion of the first arm 205*c* moves upward. As a result, the full flush bead chain 205*e* is pulled upward, pulling up the first drain valve 210 and opening the first drain valve 210.

The second arm 205*d* is an elongated member fixed in a direction orthogonal to the shaft 205*b* and extends horizontally frontward and rearward of the flush toilet device 201. One end of the light flush bead chain 205*f* is attached to a rear-side end portion of the second arm 205*d*, and the other end of the light flush bead chain 205*f* is fixed to the first drain valve 210. On the other hand, a protruding portion 205*g* protruding downward is provided at a front-side end portion of the second arm 205*d*, and the protruding portion 205*g* is positioned above and in the vicinity of a float 224 (FIG. 30) of the ball tap 214.

With this configuration, when the lever handle 205*a* is rotated in the direction of the arrow D2, which is a second direction, the rear end of the second arm 205*d* moves upward. As a result, the light flush bead chain 205*f* is pulled upward, pulling up the first drain valve 210 and opening the first drain valve 210. At the same time, the protruding portion 205*g* at the front end of the second arm 205*d* is moved downward, pushing the float 224 of the ball tap 214 downward. As a result, a main valve body 220 (FIG. 30) of the ball tap 214 is opened, starting water supply to the hydraulic drive mechanism 216. The configuration and operation of the ball tap 214 will be described below.

When the lever handle 205*a* is rotated in the direction of the arrow D1 as described above, the full flush bead chain 205*e* is pulled upward, the first drain valve 210 is pulled up, and the full flush mode is executed. When the lever handle 205*a* is rotated in the direction of the arrow D2 opposite to the arrow D1, the light flush bead chain 205*f* is pulled upward, the first drain valve 210 is pulled up, and the light flush mode is executed. In the present embodiment, the full flush bead chain 205*e* is shorter (have less slack) than the light flush bead chain 205*f*. Therefore, when the first drain valve 210 is pulled up by the full flush bead chain 205*e*, the first drain valve 210 is pulled up to a higher position than when pulled up by the light flush bead chain 205*f*. As a result, when the full flush mode is executed, the time period during which the first drain valve 210 is open is longer and the amount of flush water spouted from the rim spout port 202*d* is greater than when the light flush mode is executed.

Next, the configuration of the ball tap 214 will be described with reference to FIG. 30.

As illustrated in FIG. 30, the ball tap 214 includes a main portion 218 to which an inflow pipe 214*a* and an outflow pipe 214*b* are connected, the main valve body 220 disposed in the main portion 218, a valve seat 222 on which the main valve body 220 is seated, an arm portion 226 that is rotated by the float 224, and a pilot valve 228 that is moved by rotation of the arm portion 226. That is, the ball tap 214 includes the float 224 that operates in association with the water level in the flush water tank 204, and is configured to supply flush water to the hydraulic drive mechanism 216 when the float 224 lowers to a predetermined position.

The main portion 218 is a member provided with a connecting portion for the inflow pipe 214*a* at a lower portion thereof and a connecting portion for the outflow pipe 214*b* on one side thereof. Further, the valve seat 222 is formed inside the main portion 218. The valve seat 222 is in communication with the outflow pipe 214*b* connected to the connecting portion. Furthermore, the main valve body 220 is disposed inside the main portion 218 so as to open and close the valve seat 222. When the valve seat 222 is open, tap water from the inflow pipe 214*a* passes through the valve seat 222 and flows out to the outflow pipe 214*b*. Further, the outflow pipe 214*b* is connected to the hydraulic drive mechanism 216.

The main valve body 220 is a diaphragm-type valve body having a substantially disk shape, and is attached in the main portion 218 so as to be seated on and unseated from the valve seat 222. Further, a bleed hole 220*a* is provided in a peripheral edge portion of the main valve body 220. In the main portion 218, a pressure chamber 218*a* is formed on a side (left side in FIG. 30) of the main valve body 220 opposite to the valve seat 222. That is, the pressure chamber 218*a* is defined by an inner wall surface of the main portion 218 and by the main valve body 220 and, when pressure in the pressure chamber 218*a* increases, the main valve body 220 is pressed against the valve seat 222 by this pressure and is seated on the valve seat 222.

Furthermore, in the pressure chamber 218*a* provided in the main portion 218, a pressure passageway 218*b* extends upward with the pressure chamber 218*a* in communication therewith, and a pilot valve port 228*a* is provided at an upper end of the pressure passageway 218*b*. This pilot valve port 228*a* opens upward and is configured to be opened and closed by the pilot valve 228.

On the other hand, the float 224 is supported by the arm portion 226, and the arm portion 226 is rotatably supported by a support shaft 226*a*. Furthermore, the pilot valve 228 is coupled to the arm portion 226, and the pilot valve 228 is configured to be moved in a vertical direction in association with the rotation of the arm portion 226. As a result, in a state in which the water level in the first tank portion 206*a* of the flush water tank 204 has risen to or above the predetermined set water level $L_1$, the float 224 is pushed upward, and the pilot valve 228 is accordingly moved downward and seated on the pilot valve port 228*a*, closing the pilot valve port 228*a*. Meanwhile, when the flush water in the first tank portion 206*a* is discharged and the water level in the first tank portion 206*a* drops, the float 224 moves downward and the pilot valve 228 moves upward, opening the pilot valve port 228*a*. Therefore, the pilot valve port 228*a* of the main portion 218 is closed during toilet flush standby state where the water level in the first tank portion 206*a* is higher than the set water level $L_1$.

Further, the tap water flowing into the main portion 218 from the inflow pipe 214*a* flows into a space having a ring configuration surrounding the valve seat 222, passes through the bleed hole 220*a* of the main valve body 220, and flows into the pressure chamber 218*a*. In a state in which the pilot valve port 228*a* is closed by the pilot valve 228, there is no outflow path for the tap water flowing from the bleed hole 220*a* into the pressure chamber 218*a*, which increases the pressure in the pressure chamber 218*a*. When the pressure in the pressure chamber 218*a* increases, the main valve body 220 is pressed toward the valve seat 222 (to the right side in FIG. 30) by this pressure, and the valve seat 222 is closed by the main valve body 220.

Meanwhile, when the first drain valve 210 is opened by the flushing operation and the water level in the first tank portion 206*a* of the flush water tank 204 drops below the set water level $L_1$, the float 224 moves downward, the pilot valve 228 moves upward, and the pilot valve port 228*a* is opened. When the pilot valve port 228*a* is opened, the water in the pressure chamber 218*a* flows out from the pilot valve port 228*a*, and, as a result the pressure in the pressure chamber 218*a* drops. Accordingly, the main valve body 220 is moved so as to separate from the valve seat 222 (to the left side in FIG. 30), and the valve seat 222 is opened. In this way, in a state in which the pilot valve port 228*a* is opened, the pressure in the pressure chamber 218*a* does not rise, and thus the valve seat 222 is in an open state.

As described above, the ball tap 214 is configured such that the float 224 moves up and down in association with the water level in the flush water tank 204 and, when the float 224 lowers to a predetermined position, the main valve body 220 is opened and flush water is supplied to the hydraulic drive mechanism 216. However, as described above, the protruding portion 205*g* (FIG. 29) of the operation unit 205 is positioned above and in the vicinity of the float 224. When the lever handle 205*a* is operated, thereby moving the protruding portion 205*g* downward, the float 224 of the ball tap 214 is pushed down. As a result, the float 224 is forced down and the main valve body 220 is opened, regardless of the water level in the flush water tank 204. In this way, when the float 224 is forced to lower on the basis of the operation of the operation unit 205, the supply of flush water to the hydraulic drive mechanism 216 is started regardless of the water level in flush water tank 204.

Next, the configuration of the hydraulic drive mechanism 216 will be described with reference to FIG. 31.

The hydraulic drive mechanism 216 is configured to drive the second drain valve 212 by using the supply pressure of the flush water supplied from the tap water supply line to the flush water tank 204. Specifically, the hydraulic drive mechanism 216 includes a cylinder 216*a* into which the water supplied from the ball tap 214 flows, a piston 216*b* slidably disposed in the cylinder 216*a*, and a rod 230 that protrudes from a lower end of the cylinder 216*a* and drives the second drain valve 212. Furthermore, a spring 216*c* is disposed inside the cylinder 216*a*, urging the piston 216*b* downward, and a rubber seal is attached to the piston 216*b*, ensuring water tightness between an inner wall surface of the cylinder 216*a* and the piston 216*b*. Further, a clutch mechanism 232 is provided at a lower end of the rod 230. The clutch mechanism 232 couples and separates the rod 230 and the valve stem 212*a* of the second drain valve 212.

The cylinder 216*a* is a member having a cylindrical shape, is disposed with its axis oriented in the vertical direction, and slidably receives the piston 216*b* therein. The outflow pipe 214*b* extending from the ball tap 214 is connected to a lower end portion of the cylinder 216*a* such that flush water flowing out of the ball tap 214 flows into the cylinder 216*a*. Therefore, the piston 216*b* in the cylinder 216*a* is pushed up by the water flowing into the cylinder 216*a* by overcoming the urging force of the spring 216*c*.

On the other hand, an outflow hole is provided in an upper end portion of the cylinder 216*a*, and a water supply pipe 234 is in communication with the inside of the cylinder 216*a* via the outflow hole. Accordingly, when water flows into the cylinder 216*a* from the outflow pipe 214*b* connected to a lower portion of the cylinder 216*a*, the piston 216*b* is pushed upward from the lower portion of the cylinder 216*a*. Accordingly, when the piston 216*b* is pushed up to a position higher than the outflow hole, the water flowing into the cylinder 216*a* flows out from the outflow hole and into the water supply pipe 234. Further, the flush water flowing into the water supply pipe 234 falls into the second tank portion 206*b* of the flush water tank 204, and the flush water is supplied to the flush water tank 204.

The rod 230 is a rod-shaped member connected to a lower surface of the piston 216*b*, and protrudes downwardly from the inside the cylinder 216*a* through a through hole formed in a bottom surface of the cylinder 216*a*. The valve stem 212*a* of the second drain valve 212 is connected to the lower end of the rod 230 via the clutch mechanism 232, and the rod 230 couples the piston 216*b* and the second drain valve 212. Therefore, when the water flows into the cylinder 216*a* and the piston 216*b* is pushed up, the rod 230 connected to the piston 216*b* lifts the second drain valve 212 upward, opening the second drain valve 212.

Further, a gap is provided between the rod 230 downwardly protruding from the inside of the cylinder 216*a* and an inner wall of the through hole of the cylinder 216*a*, and some of the water flowing into the cylinder 216*a* flows out from the gap. The water flowing out from the gap flows into the second tank portion 206*b*. Herein, since the gap is relatively narrow, the gap has large flow channel resistance. Thus, even in a state in which the water flows out from the gap, the water flowing from the outflow pipe 214*b* into the cylinder 216*a* causes the pressure in the cylinder 216*a* to increase and pushes the piston 216*b* up against the urging force of the spring 216*c*.

Furthermore, the clutch mechanism 232 detachably couples the rod 230 and the second drain valve 212. The clutch mechanism 232 is configured to separate the valve stem 212*a* of the second drain valve 212 from the rod 230, when the second drain valve 212 is lifted a predetermined distance together with the rod 230. In a state in which the valve stem 212*a* and the rod 230 are separated by the clutch mechanism 232, the second drain valve 212 is not accompanied with the movement of the piston 216*b* and an upper portion of the rod 230, and the second drain valve 212 falls as the water level in the second tank portion 206*b* of the flush water tank 204 drops.

Next, actions of the flush toilet device 201 according to the seventh embodiment of the present invention will be described with new reference to FIG. 32 to FIG. 40.

Figure 37:
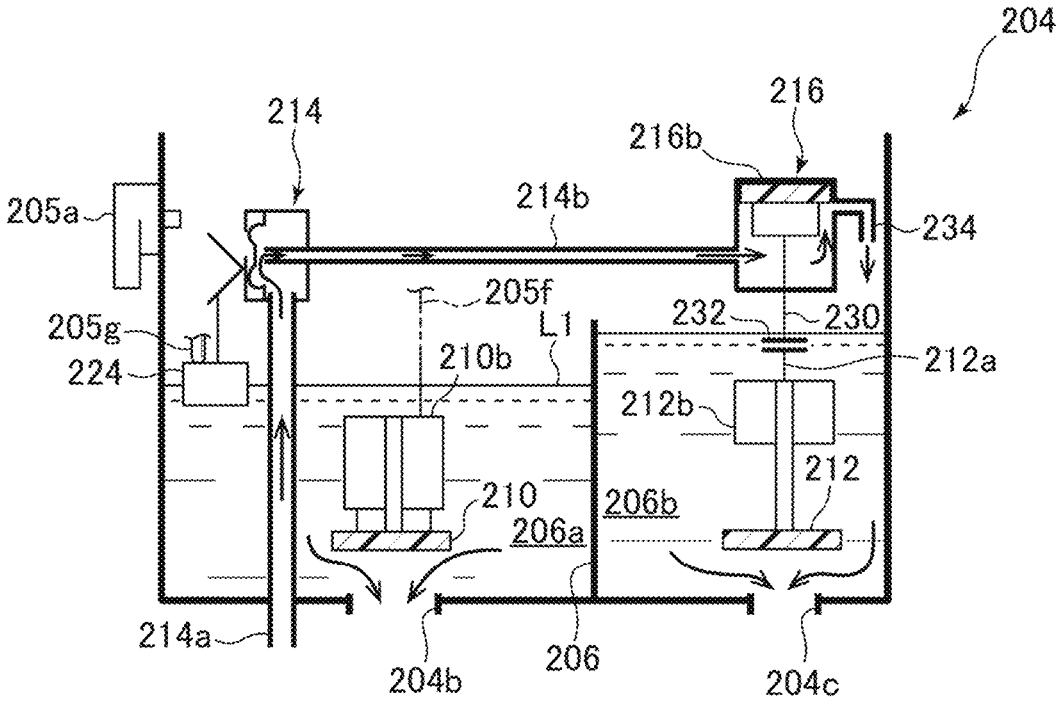
FIG. 37 is a schematic view for explaining operation when a light flush mode is executed by the flush toilet device according to the seventh embodiment of the present invention.
Figure 38:
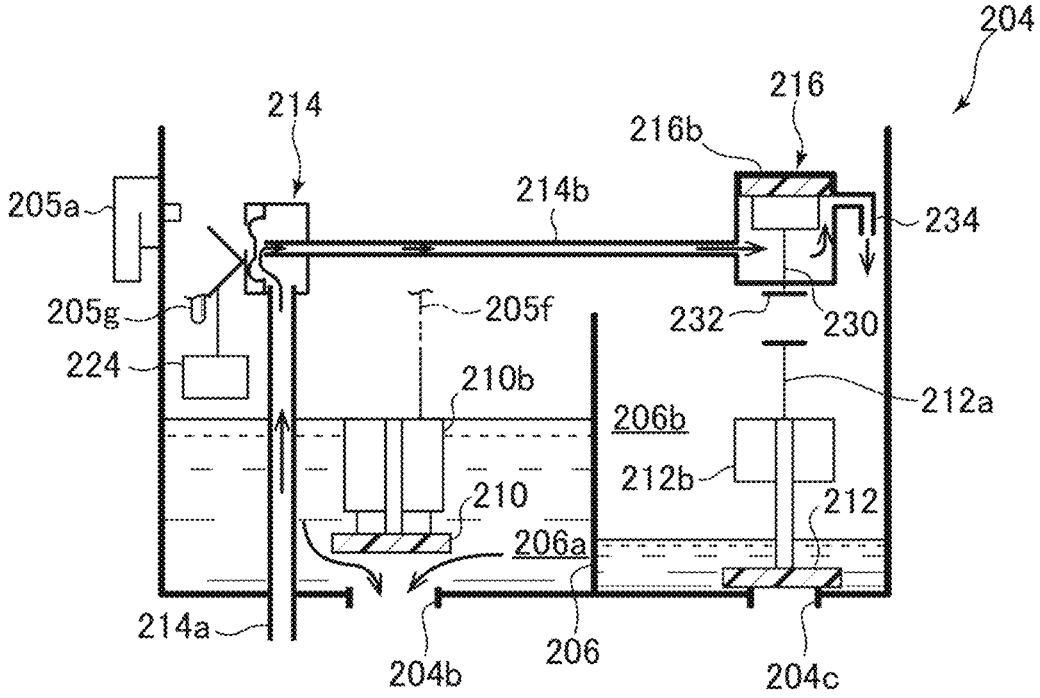
FIG. 38 is a schematic view for explaining operation when the light flush mode is executed by the flush toilet device according to the seventh embodiment of the present invention.
Figure 39:
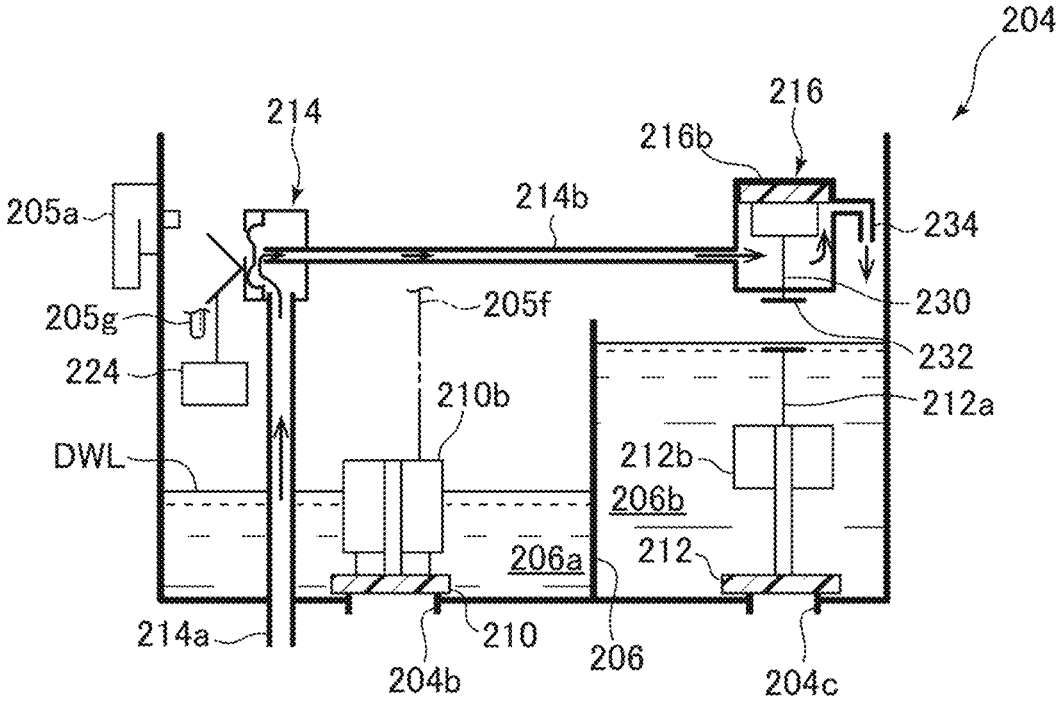
FIG. 39 is a schematic view for explaining operation when the light flush mode is executed by the flush toilet device according to the seventh embodiment of the present invention.
Figure 40:
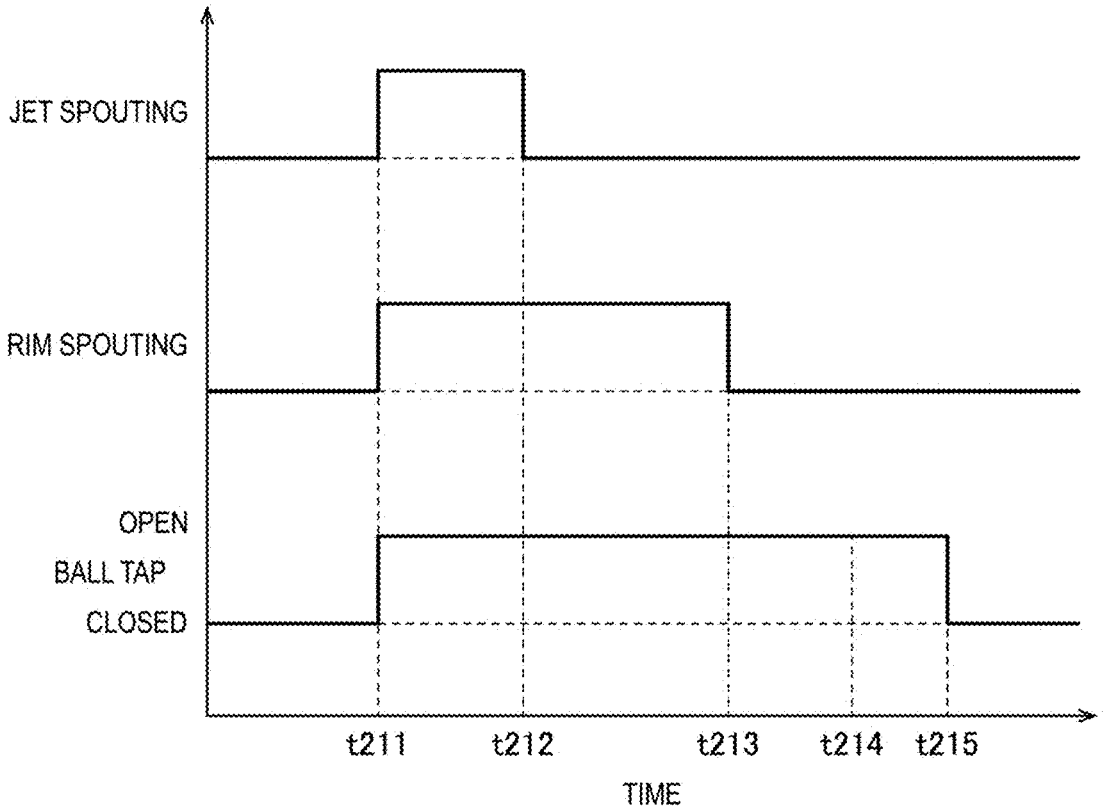
FIG. 40 is a time chart illustrating operation when the light flush mode is executed by the flush toilet device according to the seventh embodiment of the present invention.

FIG. 32 to FIG. 35 are schematic diagrams for explaining operations when the full flush mode is executed by the flush toilet device 201 according to the seventh embodiment of the present invention. FIG. 36 is a time chart illustrating operation when the full flush mode is executed by the flush toilet device 201 according to the seventh embodiment of the present invention. FIG. 37 to FIG. 39 are schematic views for explaining operation when the light flush mode is executed by the flush toilet device 201 according to the seventh embodiment of the present invention. FIG. 40 is a time chart illustrating operation when the light flush mode is executed by the flush toilet device 201 according to the seventh embodiment of the present invention.

First, in the toilet flush standby state described above, as illustrated in FIG. 28, the first drain port 204*b* and the second drain port 204*c* of the flush water tank 204 are closed by the first drain valve 210 and the second drain valve 212, respectively. Further, the second tank portion 206*b* of the flush water tank 204 is filled with water (the water level is equal to an upper end of the partition wall 206). Meanwhile, the initial water level $L_2$ in the first tank portion 206*a* is higher than the predetermined set water level $L_1$ (the reason that the initial water level $L_2$ is higher than the set water level $L_1$ will be described below). As a result, the pilot valve port 228*a* of the main portion 218 (FIG. 30) of the ball tap 214 is closed, and the valve seat 222 is closed by the main valve body 220.

Figure 32:
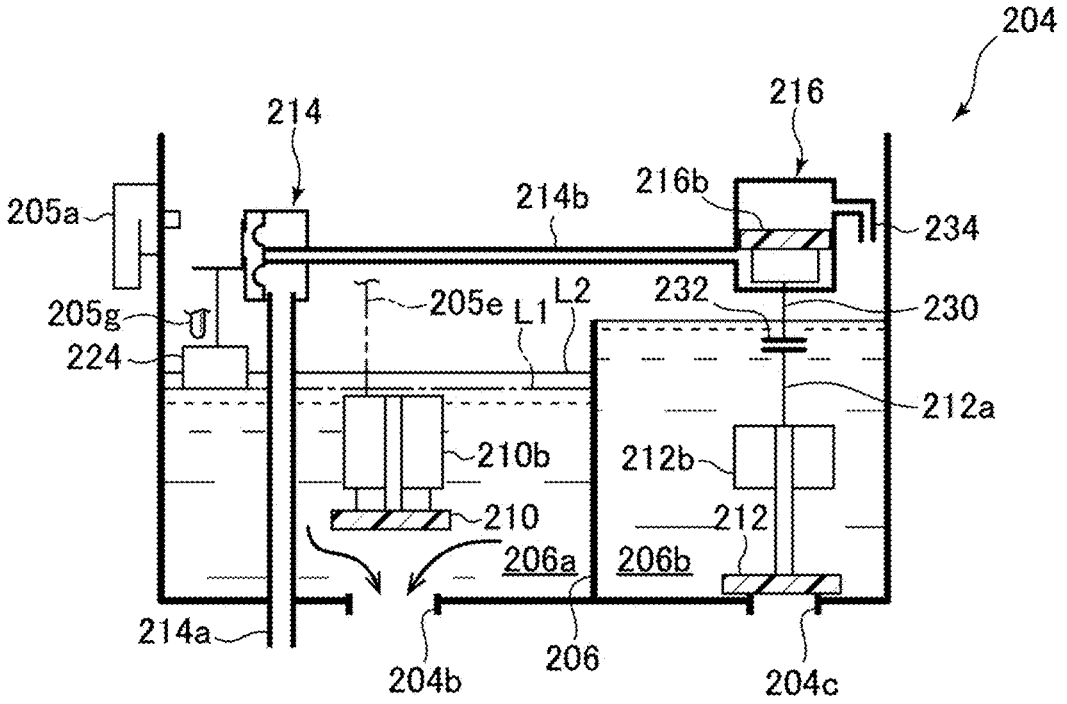
FIG. 32 is a schematic view for explaining operation when a full flush mode is executed by the flush toilet device according to the seventh embodiment of the present invention.

Next, at time t201 in FIG. 36, when the user rotates the lever handle 205*a* of the flush water tank 204 to flush the toilet in the full flush mode, the full flush bead chain 205*e* pulls up the first drain valve 210. As a result, as illustrated in FIG. 32, the first drain valve 210 is separated from the first drain port 204*b*, opening the first drain port 204*b*. When the first drain port 204*b* is opened, the flush water stored in the first tank portion 206*a* of the flush water tank 204 flows from the first drain port 204*b* into the rim conduit 202*f* (FIG. 27) and is spouted from the rim spout port 202*d*.

The rim spouting from the rim spout port 202*d* generates a circulating flow on the waste receiving surface of the bowl 202*a*, thereby flushing the waste receiving surface. Note that, by the discharge of the flush water, the water level in the first tank portion 206*a* drops.

Figure 33:
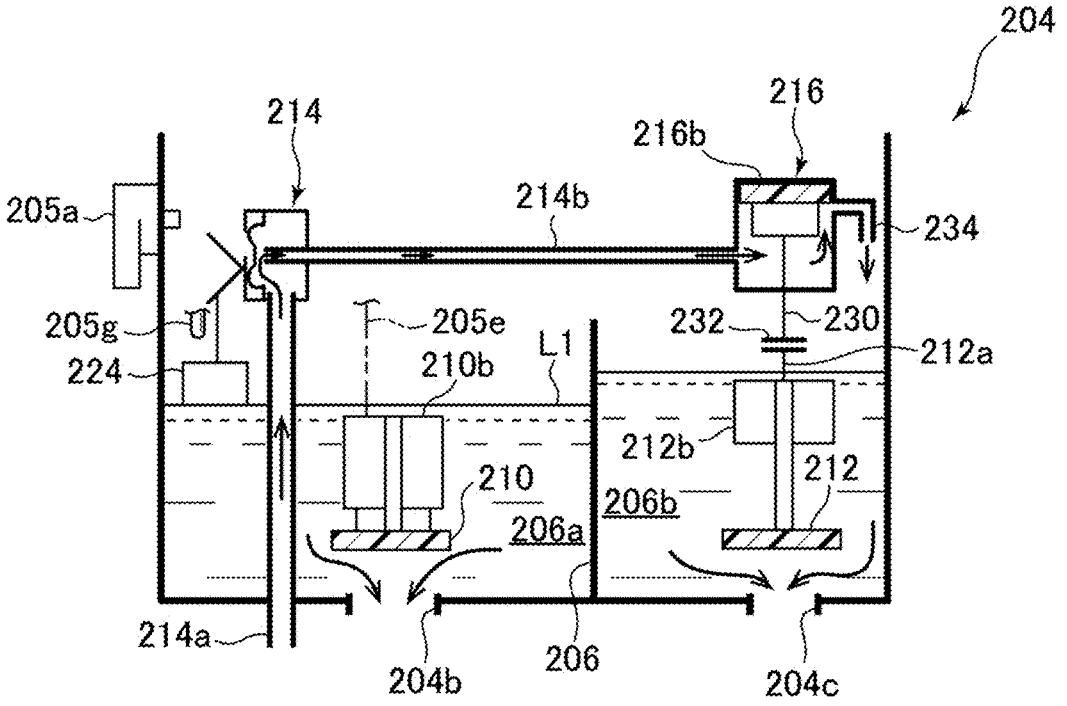
FIG. 33 is a schematic view for explaining operation when the full flush mode is executed by the flush toilet device according to the seventh embodiment of the present invention.

As the flush water is discharged from the first drain port 204*b*, the water level in the first tank portion 206*a* drops. Then, when the water level in the first tank portion 206*a* drops lower than the set water level $L_1$ at time t202 in FIG. 36, the float 224 of the ball tap 214 lowers, opening the pilot valve 228 (FIG. 30). As a result, the pressure in the pressure chamber 218*a* drops, opening the main valve body 220 and starting water supply to the hydraulic drive mechanism 216, as illustrated in FIG. 33.

When flush water is supplied to the hydraulic drive mechanism 216, the flush water flowing into the cylinder 216*a* (FIG. 31) pushes the piston 216*b* up by overcoming the urging force of the spring 216*c*. As a result, the rod 230 coupled to the piston 216*b* pulls up the valve stem 212*a* of the second drain valve 212, opening the second drain port 204*c*. That is, the second drain valve 212 is driven and opened by the water supply pressure of the tap water supplied through the ball tap 214. In this way, in the full flush mode, the first drain valve 210 is opened at time t201, and the second drain valve 212 is opened at time t202 after a predetermined time period has elapsed.

When the second drain port 204*c* is opened, the flush water stored in the second tank portion 206*b* of the flush water tank 204 flows from the second drain port 204*c* into the jet conduit 202*g* (FIG. 27) and is spouted from the jet spout port 202*e*. The jet spouting from the jet spout port 202*e* fills the drain trap conduit 202*c* and induces a siphon action. When the siphon action is generated, residual water and waste in the bowl 202*a* are suctioned into the drain trap conduit 202*c* and discharged to a sewer pipe (not illustrated).

Figure 34:
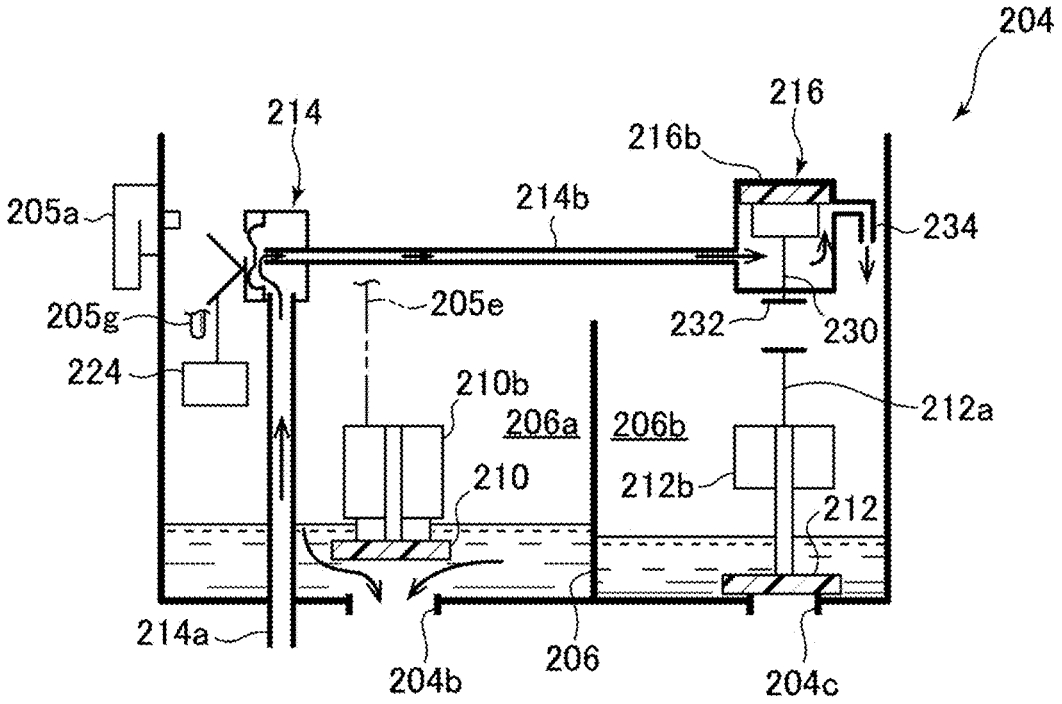
FIG. 34 is a schematic view for explaining operation when the full flush mode is executed by the flush toilet device according to the seventh embodiment of the present invention.

When the second drain valve 212 is pulled up to a predetermined height together with the piston 216*b* of the hydraulic drive mechanism 216, the clutch mechanism 232 (FIG. 31) separates the valve stem 212*a* of the second drain valve 212 from the rod 230. As a result, the second drain valve 212 falls toward the second drain port 204*c*. Then, at time t203 in FIG. 36, as illustrated in FIG. 34, the second drain valve 212 is seated on the second drain port 204*c*, closing the second drain port 204*c*. As a result, the jet spouting from the jet spout port 202*e* is stopped. Note that since the second drain port 204*c* and the jet conduit 202*g* connected thereto have low flow channel resistance, the flush water is spouted at a high flow rate from the jet spout port 202*e*. As a result, the water level in the second tank portion 206*b* rapidly drops, and the second drain valve 212 is closed earlier than the first drain valve 210.

In the state illustrated in FIG. 34, the main valve body 220 of the ball tap 214 is open, and thus flush water supplied from the water supply source 207 (tap water supply line) is supplied to the hydraulic drive mechanism 216 through the ball tap 214 and flows into the second tank portion 206*b* from the water supply pipe 234 connected to the cylinder 216*a*. Meanwhile, since the first drain valve 210 is still opened, the flush water in the first tank portion 206*a* flows out from the first drain port 204*b* and is spouted from the rim spout port 202*d*. After the jet spouting is stopped at time t203 in FIG. 36, the flush water spouted from the rim spout port 202*d* is used as refill water for returning the water level in the bowl 202*a* to the residual water level in the standby state.

Figure 35:
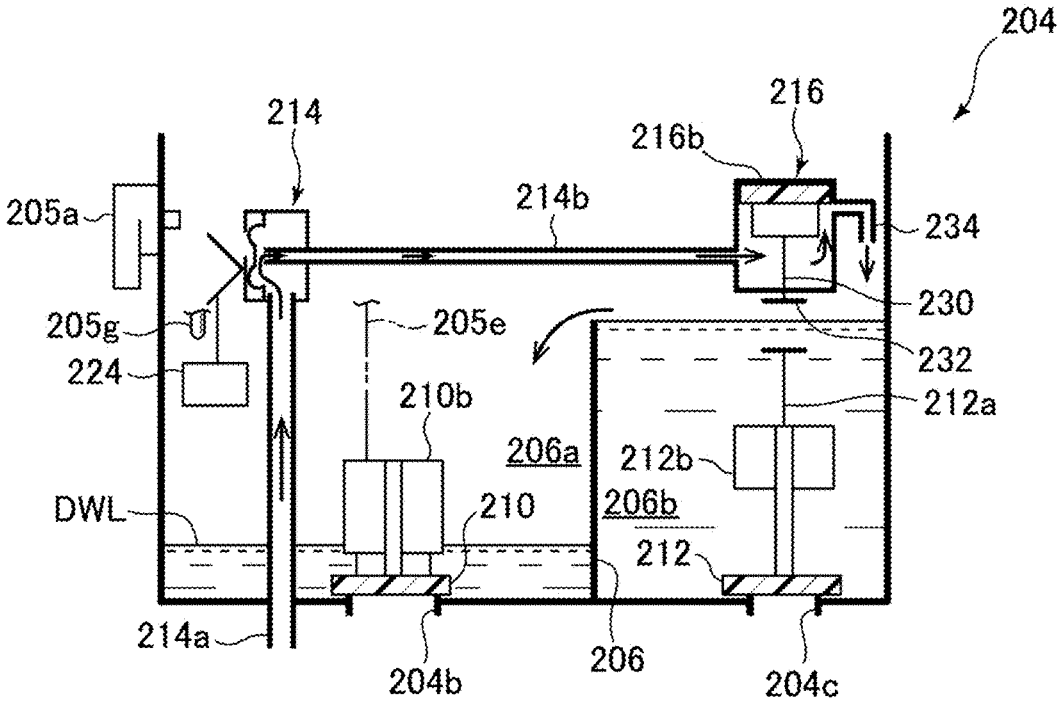
FIG. 35 is a schematic view for explaining operation when the full flush mode is executed by the flush toilet device according to the seventh embodiment of the present invention.
Figure 36:
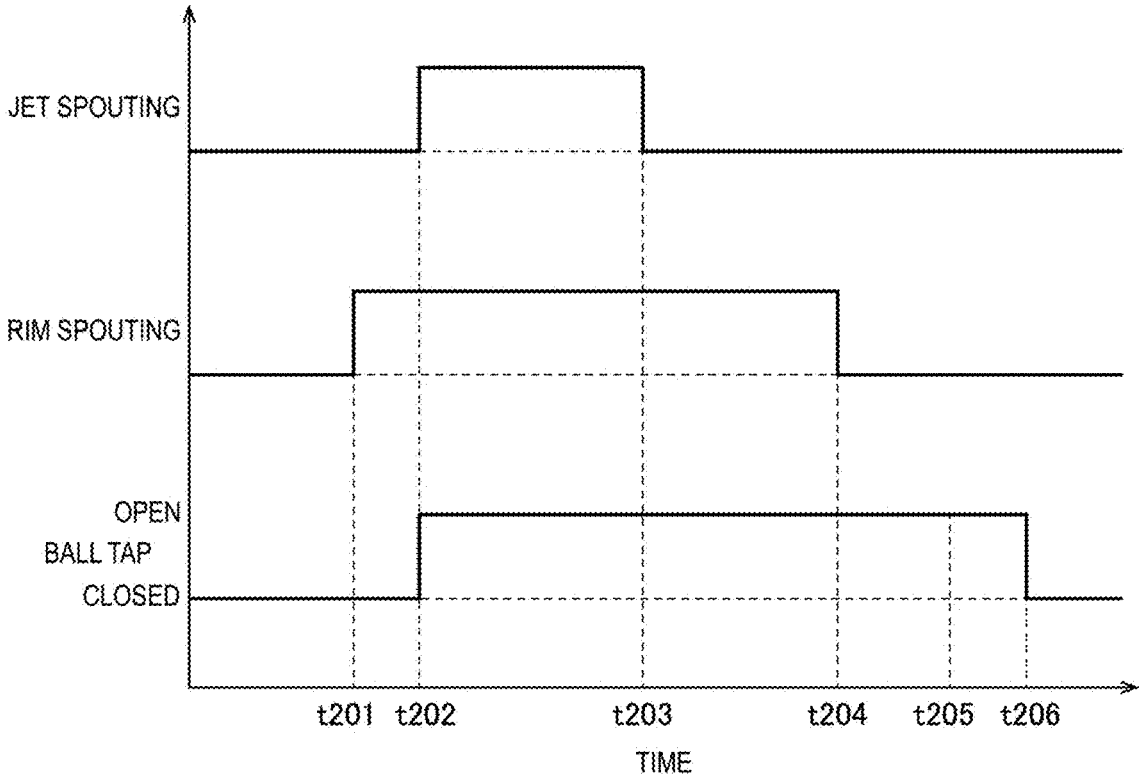
FIG. 36 is a time chart illustrating operation when the full flush mode is executed by the flush toilet device according to the seventh embodiment of the present invention.

Next, when the water level in the first tank portion 206*a* of the flush water tank 204 drops to the dead water level DWL at time t204 in FIG. 36, as illustrated in FIG. 35, the first drain valve 210 is seated on the first drain port 204*b*, closing the first drain valve 210. The rim spouting from the rim spout port 202*d* is thereby stopped.

Furthermore, since the main valve body 220 of the ball tap 214 is maintained in an open state even after the first drain valve 210 is closed, the flush water supplied from the water supply source 207 (tap water supply line) flows into the second tank portion 206*b* of the flush water tank 204 from the water supply pipe 234 through the ball tap 214 and the hydraulic drive mechanism 216. Then, when the water level in the second tank portion 206*b* exceeds the height of the partition wall 206, flush water flows over the partition wall 206, from the second tank portion 206*b* into the first tank portion 206*a*. As a result, the water level in the first tank portion 206*a* rises. Then, when the water level in the first tank portion 206*a* rises to the set water level $L_1$ at time t205 in FIG. 36, the float 224 of the ball tap 214 rises, closing the pilot valve 228 (FIG. 30).

When the pilot valve 228 is closed in this way, flush water flowing into the pressure chamber 218*a* from the bleed hole 220*a* provided in the main valve body 220 of the ball tap 214 cannot flow out, causing the pressure in the pressure chamber 218*a* to rise. Then, at time t206 in FIG. 36, the main valve body 220 is pressed by the pressure in the pressure chamber 218*a* and seated on the valve seat 222, closing the main valve body 220. As a result, the water supply from the water supply source 207 to the hydraulic drive mechanism 216 via the ball tap 214 is stopped, thereby stopping the supply of flush water into the flush water tank 204.

When the water supply to the hydraulic drive mechanism 216 is stopped, the piston 216*b* (FIG. 31) in the cylinder 216*a* which has been pushed up by the water supply is pushed down by the urging force of the spring 216*c*. Accordingly, the rod 230 attached to the piston 216*b* also lowers. When the rod 230 lowers to a predetermined position, the clutch mechanism 232 couples the rod 230 again to the valve stem 212*a* of the second drain valve 212. Thus, one toilet flush is completed, and the flush toilet device 201 returns to the toilet flush standby state illustrated in FIG. 28.

Consequently, there is a predetermined time lag from the time at which the water level in the first tank portion 206*a* of the flush water tank 204 rises to the set water level $L_1$ and the pilot valve 228 is closed (time t205 in FIG. 36) to the time at which the main valve body 220 of the ball tap 214 is closed (time t206 in FIG. 36). Therefore, during the period from time t205 to time t206, the main valve body 220 is open, causing flush water supply to continue. Thus, at the time point when the main valve body 220 is closed at time t206, the water level in the first tank portion 206*a* is set at the initial water level $L_2$, which is higher than the set water level $L_1$.

As a result, the initial water level $L_2$ in the first tank portion 206*a* in the standby state of the flush toilet device 201 is set higher than the predetermined set water level $L_1$ at which the pilot valve 228 is closed. Therefore, at the time point when the user operates the lever handle 205*a* in the standby state (time t201 in FIG. 36), the water level in the first tank portion 206*a* is higher than the set water level $L_1$, and the main valve body 220 of the ball tap 214 is not opened. Accordingly, between times t201 and t202, when a predetermined amount of flush water is discharged from the first drain port 204*b* as rim spouting and the water level in the first tank portion 206*a* drops to the set water level $L_1$, the pilot valve 228 is opened and the main valve body 220 of the ball tap 214 is also opened. As a result, at time t202, water supply to the hydraulic drive mechanism 216 is started, the second drain valve 212 is opened by the hydraulic drive mechanism 216, and jet spouting is started.

Next, the toilet flush in the light flush mode will be described with reference to FIG. 37 to FIG. 40.

First, at time t211 in FIG. 40, when the user rotates the lever handle 205*a* of the flush water tank 204 to flush the toilet in the light flush mode, the light flush bead chain 205*f* pulls up the first drain valve 210. As a result, as illustrated in FIG. 37, the first drain valve 210 is separated from the first drain port 204*b*, opening the first drain port 204*b*. At the same time, when the lever handle 205*a* is rotated, the protruding portion 205*g* (FIG. 29) of the operation unit 205 is moved downward, and the float 224 of the ball tap 214 is forced down.

When the float 224 lowers, the pilot valve 228 (FIG. 30) is opened. As a result, the pressure in the pressure chamber 218*a* drops, opening the main valve body 220 and starting water supply to the hydraulic drive mechanism 216, as illustrated in FIG. 37. When flush water is supplied to the hydraulic drive mechanism 216, the second drain valve 212 is pulled up and the second drain port 204*c* is opened.

In this way, when the light flush mode is executed, the float 224 is forced to be pushed down and water supply to the hydraulic drive mechanism 216 is started without waiting for the water level in the first tank portion 206*a* to drop to the set water level $L_1$. Thus, in the light flush mode, the first drain valve 210 and the second drain valve 212 are opened substantially at the same time, that is, the second drain valve 212 is opened before a predetermined time period (between times t201 and t202 in FIG. 36) elapses from opening the first drain valve 210. Thus, in the light flush mode, rim spouting and jet spouting are started substantially simultaneously at time t211 in FIG. 40.

Furthermore, when the second drain valve 212 is pulled up to a predetermined height by the hydraulic drive mechanism 216, the clutch mechanism 232 (FIG. 31) separates the valve stem 212*a* of the second drain valve 212 from the rod 230. As a result, the second drain valve 212 falls toward the second drain port 204*c*. Then, at time t212 in FIG. 40, as illustrated in FIG. 38, the second drain valve 212 is seated on the second drain port 204*c*, closing the second drain port 204*c*. As a result, the jet spouting from the jet spout port 202*e* is stopped. As described above, since flush water is spouted from the jet spout port 202*e* at a high flow rate, the water level in the second tank portion 206*b* rapidly drops and the second drain valve 212 closes earlier than the first drain valve 210.

In the state illustrated in FIG. 38, the main valve body 220 of the ball tap 214 is opened, and thus flush water supplied from the water supply source 207 (tap water supply line) is supplied to the hydraulic drive mechanism 216 through the ball tap 214 and flows into the second tank portion 206*b* from the water supply pipe 234 connected to the cylinder 216*a*. Meanwhile, since the first drain valve 210 is still opened, the flush water in the first tank portion 206*a* flows out from the first drain port 204*b* and is spouted from the rim spout port 202*d*.

Next, when the water level in the first tank portion 206*a* of the flush water tank 204 drops to the dead water level DWL at time t213 in FIG. 40, as illustrated in FIG. 39, the first drain valve 210 is seated on the first drain port 204*b*, closing the first drain valve 210. The rim spouting from the rim spout port 202*d* is thereby stopped.

Here, when the light flush mode is executed, a height of the first drain valve 210 pulled up by the light flush bead chain 205*f* of the operation unit 205 at time t211 in FIG. 40 is set lower than a height of the first drain valve 210 pulled up in the full flush mode, as described above. Therefore, the period during which the first drain valve 210 is opened in the light flush mode (period from time t211 to time t213 in FIG. 40) is shorter than the valve open period of the first drain valve 210 in the full flush mode (period from time t201 to time t204 in FIG. 36). Thus, the amount of flush water spouted from the rim spout port 202*d* in the light flush mode is less than the amount of flush water spouted from the rim spout port 202*d* in the full flush mode, and the dead water level DWL in FIG. 39 (light flush mode) is higher than the dead water level DWL in FIG. 35 (full flush mode).

Furthermore, after the rim spouting is stopped at time t213 in FIG. 40, the water level in the first tank portion 206*a* of the flush water tank 204 rises to the set water level $L_1$ and the pilot valve 228 is closed at time t214. Furthermore, at time t215, the main valve body 220 of the ball tap 214 is closed, and the flush toilet device 201 returns to the standby state. The operations after time t213 until the flush toilet device 201 returns to the standby state are the same as in the full flush mode, and therefore description thereof will be omitted.

Note that, in the present embodiment, the first drain valve 210 and the second drain valve 212 are opened substantially simultaneously in the light flush mode. However, as an exemplary modification, the present invention can be configured such that the second drain valve 212 is opened before a predetermined time period (between time t201 and time t202 in FIG. 36) has elapsed after the first drain valve 210 is opened. In this case, for example, an appropriate gap can be provided between the protruding portion 205*g* (FIG. 29) of the operation unit 205 and the float 224 of the ball tap 214. As a result, when the shaft 205*b* is rotated in the direction of the arrow D2, the first drain valve 210 is pulled up by the light flush bead chain 205*f* and subsequently, following a slight delay (before the predetermined time period has elapsed), the protruding portion 205*g* forcibly pushes down the float 224, starting water supply to the hydraulic drive mechanism 216 and pulling up the second drain valve 212.

According to the flush toilet device 201 of the seventh embodiment of the present invention, the spouting and stopping of flush water from the rim spout port 202*d* are switched by the first drain valve 210 and the spouting and stopping of flush water from the jet spout port 202*e* are switched by the second drain valve 212 (FIG. 28). With this configuration, it is possible to independently set the times for rim spouting and jet spouting as desired while supplying all flush water used for flushing from the flush water tank 204. Thus, the bowl 202*a* of the flush toilet main body 202 can be effectively flushed with flush water stored in the flush water tank 204. Further, according to the flush toilet device 201 of the seventh embodiment of the present invention, during execution of the full flush mode (FIG. 36), flush water is supplied to the bowl 202*a* by opening the first drain valve 210 and then, after a predetermined time period elapses, opening the second drain valve 212 and, during execution of the light flush mode (FIG. 40), the first drain valve 210 and the second drain valve 212 are opened substantially simultaneously. This makes it possible to reduce the amount of rim spouting before the start of jet spouting, which is less necessary in the light flush mode, and suppress the amount of flush water while ensuring sufficient flushing performance.

Further, according to the flush toilet device 201 of the present embodiment, since the second drain valve 212 is opened by the hydraulic drive mechanism 216, it is possible to start jet spouting by pulling up the drain valve after a predetermined time period elapses from rim spouting is started in full flush mode without using electrical power such as that generated by a motor. This makes it possible to effectively flush the bowl 202*a* while suppressing the amount of flush water.

Furthermore, according to the flush toilet device 201 of the present embodiment, during execution of the full flush mode, the float 224 lowers as the water level in the flush water tank 204 drops to start supply of flush water to the hydraulic drive mechanism 216, and thus jet spouting is started after the water level in the flush water tank 204 drops. On the other hand, during execution of the light flush mode, the float 224 is forced to lower to start supply of flush water to the hydraulic drive mechanism 216, and thus jet spouting is started without waiting for the water level in the flush water tank 204 to drop. Thus, the flushing sequence of the full flush mode and the light flush mode can be set without the use of electrical control.

Further, according to the flush toilet device 201 of the present embodiment, the full flush mode is executed when the lever handle 205*a* is rotated in the first direction and the light flush mode is executed when the lever handle 205*a* is rotated in the second direction. Thus, execution of the full flush mode and the light flush mode can be controlled with a simple mechanism.

Next, the flush toilet device according to an eighth embodiment of the present invention will be described with reference to FIG. 41 and FIG. 42.

The flush toilet device of the present embodiment differs from that of the seventh embodiment described above in the configuration of the operation unit for executing the full flush mode and the light flush mode. Thus, only the points of the eighth embodiment of the present invention that differ from those of the seventh embodiment will be described below, and the components that are the same as those in the seventh embodiment will be denoted by the same reference signs and descriptions thereof will be omitted.

Figure 41:
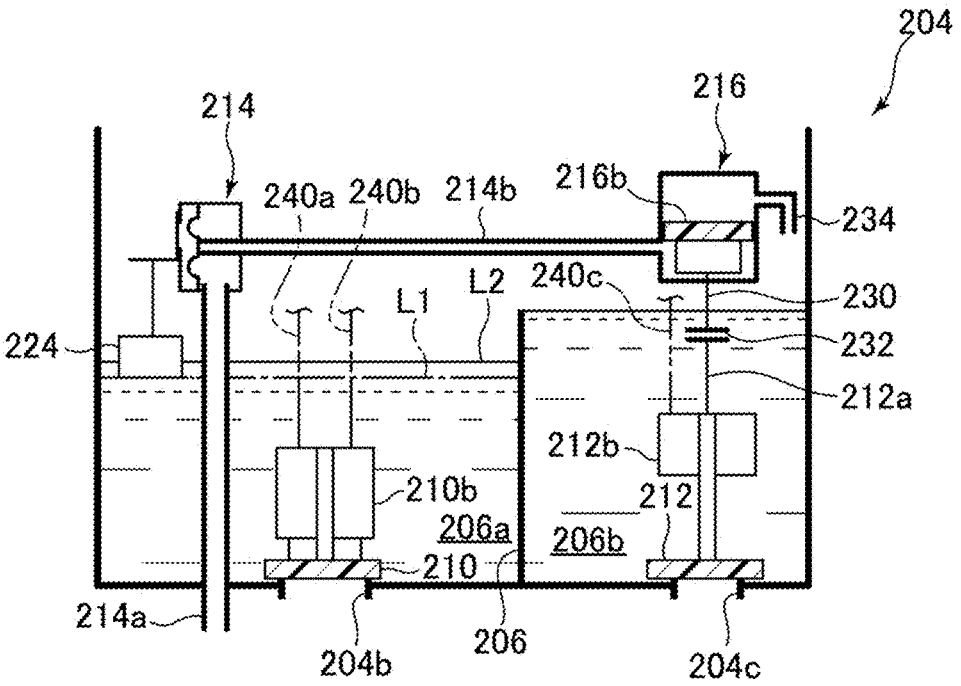
FIG. 41 is a cross-sectional view illustrating a schematic configuration of the flush water tank provided in the flush toilet device according to an eighth embodiment of the present invention.

FIG. 41 is a cross-sectional view illustrating a schematic configuration of the flush water tank provided in the flush toilet device according to the eighth embodiment of the present invention. FIG. 42 is an extracted schematic diagram illustrating a schematic configuration of an operation unit provided in the flush water tank of the flush toilet device according to the eighth embodiment of the present invention.

As illustrated in FIG. 41, the flush water tank 204 provided in the flush toilet device of the present embodiment includes the first drain valve 210, the second drain valve 212, the ball tap 214, and the hydraulic drive mechanism 216. As in the seventh embodiment described above, the first drain port 204*b* configured to be opened and closed by the first drain valve 210 and the second drain port 204*c* configured to be opened and closed by the second drain valve 212 are formed on the bottom surface of the flush water tank 204. Furthermore, the partition wall 206 is provided in the flush water tank 204 to divide the flush water tank 204 into the first tank portion 206*a* provided with the first drain port 204*b* and the second tank portion 206*b* provided with the second drain port 204*c*.

In the present embodiment, the first drain valve 210 is connected to a full flush bead chain 240*a* and a light flush bead chain 240*b* provided in the operation unit (not illustrated in FIG. 42), and the second drain valve 212 is connected to a light flush bead chain 240*c*.

Figure 42:
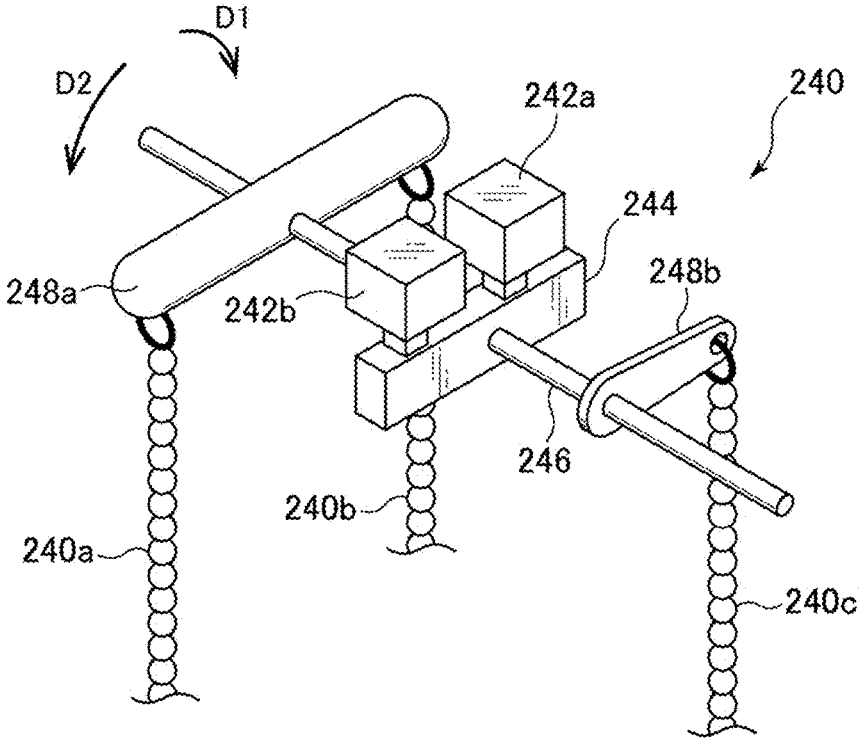
FIG. 42 is an extracted schematic view illustrating a schematic configuration of an operation unit provided in the flush water tank of the flush toilet device according to the eighth embodiment of the present invention.

Next, as illustrated in FIG. 42, an operation unit 240 includes a first button 242*a* for a full flush, a second button 242*b* for a light flush, a lever 244 configured to be pressed by these push buttons, a shaft 246 attached to the lever 244, and a first arm 248*a* and a second arm 248*b* attached to the shaft 246.

The first button 242*a* and the second button 242*b* are push buttons provided on an upper surface of the flush water tank 204, and the user can execute the full flush mode or the light flush mode by pressing these buttons. The first button 242*a* and the second button 242*b* are supported by the flush water tank 204 so as to be movable in the vertical direction when pressed by the user. Furthermore, the first button 242*a* and the second button 242*b* are each configured to return to an original position by a spring (not illustrated) after being pressed by the user. Note that only upper end portions of the first button 242*a* and the second button 242*b* are exposed from the upper surface of the flush water tank 204, and lower portions of the buttons are covered by a cover (not illustrated) on the upper surface of the flush water tank 204.

The lever 244 is a rod-shaped member oriented substantially horizontally so as to extend in a front-rear direction of the flush toilet device, and is disposed under the first button 242*a* and the second button 242*b*.

The shaft 246 is a rod-like member extending horizontally in the width direction of the flush toilet device 201 at the upper portion of the flush water tank 204. The shaft 246 is rotatably supported with respect to the flush water tank 204, and the lever 244 is fixed to an intermediate portion of the shaft 246 in a manner orthogonal to the shaft 246. When the first button 242*a* or the second button 242*b* is pressed, the shaft 246 is rotated together with the lever 244. That is, the first button 242*a* is disposed above a rear-side end portion of the lever 244 and, when the first button 242*a* is pressed, the shaft 246 fixed to the lever 244 is rotated in the direction of the arrow D1. On the other hand, the second button 242*b* is disposed above a front-side end portion of the lever 244 and, when the second button 242*b* is pressed, the shaft 246 fixed to the lever 244 is rotated in the direction of the arrow D2.

The first arm 248*a* is an elongated member fixed in a direction orthogonal to the shaft 246 and extends horizontally frontward and rearward of the flush toilet device 201. One end of the full flush bead chain 240*a* is attached to a front-side endmost portion of the first arm 248*a*, and the other end of the full flush bead chain 240*a* is fixed to the first drain valve 210. On the other hand, one end of the light flush bead chain 240*b* is attached to a rear-side endmost portion of the first arm 248*a*, and the other end of the light flush bead chain 240*b* is also fixed to the first drain valve 210.

The second arm 248*b* is an elongated member fixed in a direction orthogonal to the shaft 246 and extends horizontally rearward of the flush toilet device 201. One end of the light flush bead chain 240*c* is attached to a rear-side end portion of the second arm 248*b*, and the other end of the light flush bead chain 240*c* is fixed to the second drain valve 212.

With this configuration, when the first button 242*a* for a full flush is pressed and the shaft 246 is rotated in the direction of the arrow D1, which is the first direction, the endmost portion of the first arm 248*a* moves upward. As a result, the full flush bead chain 240*a* is pulled upward, pulling up the first drain valve 210 and opening the first drain valve 210.

Meanwhile, when the second button 242*b* for a light flush is pressed and the shaft 246 is rotated in the direction of the arrow D2, which is the second direction, the rear ends of the first arm 248*a* and the second arm 248*b* move upward. As a result, the light flush bead chain 240*b* is pulled upward, pulling up the first drain valve 210 and opening the first drain valve 210. At the same time, the light flush bead chain 240*c* attached to the rear end of the second arm 248*b* is also pulled upward, pulling up the second drain valve 212 and opening the second drain valve 212.

In this way, when the first button 242*a* is pressed and the shaft 246 is rotated in the direction of the arrow D1, the full flush bead chain 240*a* is pulled upward, the first drain valve 210 is pulled up, and the full flush mode is executed. Further, when the second button 242*b* is pressed and the shaft 246 is rotated in the direction of the arrow D2 opposite to the arrow D1, the light flush bead chains 240*b* and 240*c* are pulled upward, the first drain valve 210 and the second drain valve 212 are pulled up, and the light flush mode is executed. In the present embodiment, the full flush bead chain 240*a* is configured to be shorter (have less slack) than the light flush bead chain 240*b*. Therefore, when pulled up by the full flush bead chain 240*a*, the first drain valve 210 is pulled up to a higher position than when pulled up by the light flush bead chain 240*b*. As a result, when the full flush mode is executed, the time period during which the first drain valve 210 is open is longer and the amount of flush water spouted from the rim spout port 202*d* is greater than when the light flush mode is executed.

Next, actions of the flush toilet device according to the eighth embodiment of the present invention will be described.

First, when the user presses the first button 242*a* for a full flush, the first drain valve 210 is pulled up by the full flush bead chain 240*a*, and rim spouting from the rim spout port 202*d* starts. When the water level in the first tank portion 206*a* drops from the initial water level $L_2$ to the set water level $L_1$ by the first drain valve 210 being pulled up and the flush water being discharged, the float 224 of the ball tap 214 lowers, opening the pilot valve 228.

As a result, the main valve body 220 of the ball tap 214 is opened, starting water supply to the hydraulic drive mechanism 216. When the water supply to the hydraulic drive mechanism 216 is started, the second drain valve 212 is opened by the hydraulic drive mechanism 216, and jet spouting from the jet spout port 202*e* starts. That is, in the full flush mode started by pressing the first button 242*a*, jet spouting is started after a predetermined time period (corresponding to times t201 to t202 in FIG. 36 in the seventh embodiment) elapses from starting of the rim spouting from the rim spout port 202*d*. Note that the operations performed after the jet spouting is started in the full flush mode are the same as those of the seventh embodiment described above, and therefore description thereof will be omitted.

Next, when the user presses the second button 242*b* for a light flush, the light flush bead chain 240*b* and the light flush bead chain 240*c* are pulled substantially simultaneously, and the first drain valve 210 and the second drain valve 212 are pulled up. As a result, the rim spouting from the rim spout port 202*d* and the jet spouting from the jet spout port 202*e* are started substantially simultaneously. That is, during execution of the light flush mode, the second drain valve 212 is forced to open on the basis of operation of the operation unit 240 to start jet spouting. Next, when the water level in the first tank portion 206*a* drops from the initial water level $L_2$ to the set water level $L_1$, the float 224 of the ball tap 214 lowers, opening the pilot valve 228.

As a result, the main valve body 220 of the ball tap 214 is opened, starting water supply to the hydraulic drive mechanism 216. That is, in the light flush mode, water supply to the hydraulic drive mechanism 216 is started after the second drain valve 212 is pulled up by the light flush bead chain 240*c*. The flush water supplied to the hydraulic drive mechanism 216 flows into the second tank portion 206*b* through the water supply pipe 234. Note that the operations performed after water supply to the hydraulic drive mechanism 216 is started in the light flush mode are the same as those of the seventh embodiment described above, and therefore description thereof will be omitted.

Note that, in the present embodiment, the first drain valve 210 and the second drain valve 212 are opened substantially simultaneously in the light flush mode. However, as an exemplary modification, the present invention can be configured such that the second drain valve 212 is opened before a predetermined time period elapses from opening the first drain valve 210. In this case, for example, the light flush bead chain 240*c* can be formed slightly longer (with more slack) than the light flush bead chain 240*b*. As a result, when the shaft 246 is rotated in the direction of the arrow D2, the first drain valve 210 is pulled up by the light flush bead chain 240*b* and subsequently, after a slight delay (before the predetermined time period elapses), the second drain valve 212 is pulled up by the light flush bead chain 240*c*.

According to the flush toilet device of the eighth embodiment of the present invention, when the full flush mode is executed, the float 224 lowers as the water level in the first tank portion 206*a* of the flush water tank 204 drops to start supply of flush water to the hydraulic drive mechanism 216, and thus jet spouting starts after the water level in the flush water tank 204 drops. On the other hand, when the light flush mode is executed, the second drain valve 212 is forced to open on the basis of operation of the operation unit 240 to start jet spouting. Thus, the flushing sequence of the full flush mode and the light flush mode can be set without the use of electrical control.

Further, according to the flush toilet device of the present embodiment, the full flush mode is executed when the first button 242*a* is pressed and the light flush mode is executed when the second button 242*b* is pressed. Thus, execution of the full flush mode and the light flush mode can be controlled with a simple mechanism.

Embodiments of the present invention have been described, but various modifications can be made to the embodiments described above. In particular, in the embodiments described above, the jet spouting is started after a delay following the start of rim spouting, but the present invention can also be configured such that the rim spouting is started after the jet spouting is started. In this case, the present invention may be configured such that the first drain valve for switching between spouting and stopping the flush water from the rim spout port is opened by the hydraulic drive mechanism.

Further, although the first drain port and the second drain port of the flush water tank are provided separately in the embodiments described above, these drain ports may be configured to overlap each other in a top view. In this case, for example, the present invention can be configured such that the first drain port and the second drain port are provided concentrically, the inward drain port is opened and closed by a drain valve having a circular shape, and the outward drain port is opened and closed by a drain valve having a donut shape.

Further, the first drain valve is configured to be closed after the second drain valve is closed by making the floating balls of each drain valve have different height in the fourth embodiment, by making the flow channels extending from each drain ports have different flow channel resistance in the fifth embodiment, and by making the first tank portion and the second tank portion have different volume in the sixth embodiment. In contrast, the present invention can be configured by appropriately combining the configurations of each of the embodiments described above so that the first drain valve is closed after the second drain valve is closed.

Furthermore, although the lever handle is provided as the operation unit in the seventh embodiment, and the first and second buttons are provided as the operation unit in the eighth embodiment, the present invention can be configured by utilizing any operation unit so that the full flush mode and the light flush mode can be selectively executed. Further, the first and second buttons may be applied to the seventh embodiment of the present invention, and the lever handle may be applied to the eighth embodiment of the present invention.

Furthermore, in the seventh and eighth embodiments described above, the partition wall is provided in the flush water tank, and the first drain port and the second drain port are provided in the first tank portion and the second tank portion, respectively, but the partition wall of the flush water tank can be omitted. In this case, the first drain port and the second drain port may be configured to overlap each other in a top view. In this case, for example, the present invention can be configured such that the first drain port and the second drain port are provided concentrically, the inward drain port is opened and closed by a drain valve having a circular shape, and the outward drain port is opened and closed by a drain valve having a donut shape.

REFERENCE SIGNS LIST

1 Flush toilet device
2 Flush toilet main body
2*a* Bowl
2*c* Drain trap conduit
2*d* Rim spout port
2*e* Jet spout port
2*f* Rim conduit
2*g* Jet conduit
4 Flush water tank
4*a* Lever handle
4*b* First drain port
4*c* Second drain port
6 Water supply source
8 Stop cock
10 First drain valve

10*a* Bead chain
10*b* Floating ball
12 Second drain valve
12*a* Valve stem
12*b* Floating ball
14 Ball tap (delay mechanism)
14*a* Inflow pipe
14*b* Outflow pipe
16 Hydraulic drive mechanism
16*a* Cylinder
16*b* Piston
16*c* Spring
18 Main portion
18*a* Pressure chamber
20 Main valve body
20*a* Bleed hole
22 Valve seat
24 Float
26 Arm portion
26*a* Support shaft
28 Pilot valve
28*a* Pilot valve port
30 Rod
32 Clutch mechanism
34 Water supply pipe
40 Small tank
40*a* Discharge hole
42 Check valve float
50 First ball tap
52 Second ball tap
56 Float
58 Water supply port
101 Flush toilet device
102 Flush toilet main body
102*a* Bowl
102*c* Drain trap conduit
102*d* Rim spout port
102*e* Jet spout port
102*f* Rim conduit
102*g* Jet conduit
104 Flush water tank
104*a* Lever handle
104*b* First drain port
104*c* Second drain port
105 Partition wall
105*a* First tank portion
105*b* Second tank portion
105*c* Small hole
106 Water supply source
108 Stop cock
110 First drain valve
110*a* Bead chain
110*b* Floating ball
112 Second drain valve
112*a* Valve stem
112*b* Floating ball
114 Ball tap (delay mechanism)
114*a* Inflow pipe
114*b* Outflow pipe
116 Hydraulic drive mechanism
116*a* Cylinder
116*b* Piston
116*c* Spring
118 Main portion
118*a* Pressure chamber
120 Main valve body
120*a* Bleed hole
122 Valve seat
124 Float
126 Arm portion
126*a* Support shaft
128 Pilot valve
128*a* Pilot valve port
130 Rod
132 Clutch mechanism
134 Water supply pipe
140*a* First drain port
140*b* Second drain port
142 Second drain valve
142*a* Valve stem
142*b* Floating ball
150 Partition wall
150*a* First tank portion
150*b* Second tank portion
150*c* Small hole
152 Second drain valve
201 Flush toilet device
202 Flush toilet main body
202*a* Bowl
202*c* Drain trap conduit
202*d* Rim spout port
202*e* Jet spout port
202*f* Rim conduit
202*g* Jet conduit
204 Flush water tank
204*b* First drain port
204*c* Second drain port
205 Operation unit
205*a* Lever handle (handle)
205*b* Shaft
205*c* First arm
205*d* Second arm
205*e* Full flush bead chain
205*f* Light flush bead chain
205*g* Protruding portion
206 Partition wall
206*a* First tank portion
206*b* Second tank portion
207 Water supply source
208 Stop cock
210 First drain valve
210*a* Bead chain
210*b* Floating ball
212 Second drain valve
212*a* Valve stem
212*b* Floating ball
214 Ball tap (delay mechanism)
214*a* Inflow pipe
214*b* Outflow pipe
216 Hydraulic drive mechanism
216*a* Cylinder
216*b* Piston
216*c* Spring
218 Main portion
218*a* Pressure chamber
220 Main valve body
220*a* Bleed hole
222 Valve seat
224 Float
226 Arm portion
226*a* Support shaft
228 Pilot valve
228*a* Pilot valve port
230 Rod

232 Clutch mechanism
234 Water supply pipe
240 Operation unit
240*a* Full flush bead chain
240*b* Light flush bead chain
240*c* Light flush bead chain
242*a* First button
242*b* Second button
244 Lever
246 Shaft
248*a* First arm
248*b* Second arm

The invention claimed is:

1. A flush toilet device configured to perform flushing with flush water stored in a flush water tank, the flush toilet device comprising:

a flush toilet main body including a bowl and a drain trap conduit extending from a lower portion of the bowl;

a flush water tank disposed at a rear portion of the flush toilet main body and configured to store the flush water for flushing the bowl of the flush toilet main body;

a first drain valve configured to switch between spouting and stopping the flush water from a rim spout port provided at an upper edge portion of the bowl by opening and closing a first drain port provided in the flush water tank;

a second drain valve configured to switch between spouting and stopping the flush water from a jet spout port provided in the lower portion of the bowl by opening and closing a second drain port provided in the flush water tank; and a hydraulic drive mechanism configured to open the first drain valve or the second drain valve by using water supply pressure of the flush water supplied from a tap water supply line to the flush water tank.

2. The flush toilet device according to claim 1, further comprising:

a delay mechanism, wherein one of the first drain valve and the second drain valve is opened later than the other by the delay mechanism during flushing of the bowl.

3. The flush toilet device according to claim 2, wherein the hydraulic drive mechanism is configured to open the second drain valve.

4. The flush toilet device according to claim 2, wherein the delay mechanism includes a ball tap configured to operate in association with a water level in the flush water tank, and the flush water is supplied to the hydraulic drive mechanism when a float of the ball tap has lowered to a predetermined position.

5. The flush toilet device according to claim 2, wherein the delay mechanism includes a ball tap having a float, a small tank having a discharge hole and disposed surrounding the float in the flush water tank, and a check valve float configured to open the discharge hole of the small tank when a water level in the flush water tank drops to a predetermined water level, and wherein the flush water is supplied to the hydraulic drive mechanism when a water level in the small tank has dropped to a predetermined water level.

6. The flush toilet device according to claim 2, wherein the delay mechanism includes a first ball tap configured to start water supply into the flush water tank when a water level in the flush water tank drops to a predetermined first water level, and a second ball tap configured to start supply of flush water to the hydraulic drive mechanism when the water level in the flush water tank drops to a predetermined second water level lower than the first water level.

7. The flush toilet device according to claim 2, wherein the flush water tank is provided with a partition wall partitioning the flush water tank into a first tank portion provided with the first drain port and a second tank portion provided with the second drain port.

8. The flush toilet device according to claim 7, wherein the first drain valve is configured to close in association with a drop in water level in the first tank portion, the second drain valve is configured to close in association with a drop in water level in the second tank portion, and wherein by setting a pressure loss in a rim conduit through which the first drain port and the rim spout port are in communication with each other greater than a pressure loss in a jet conduit through which the second drain port and the jet spout port are in communication with each other, the water level in the second tank portion is dropped earlier than the water level in the first tank portion to cause the second drain valve to close earlier than the first drain valve.

9. The flush toilet device according to claim 7, wherein the first drain valve is configured to close in association with a drop in water level in the first tank portion, the second drain valve is configured to close in association with a drop in water level in the second tank portion, and wherein the first tank portion is formed with a volume larger than a volume of the second tank portion, so that the water level in the second tank portion drops earlier than the water level in the first tank portion, causing the second drain valve to close earlier than the first drain valve.

10. The flush toilet device according to claim 7, wherein the partition wall of the flush water tank is provided with a small hole through which the first tank portion and the second tank portion are in communication with each other at a predetermined water level.

11. The flush toilet device according to claim 7, further comprising:

an operation unit configured to selectively execute a full flush mode and a light flush mode, the light flush mode being a mode in which a smaller amount of flush water is supplied to the bowl than in the full flush mode, wherein when the full flush mode is executed, flush water is supplied to the bowl by opening the first drain valve and then, after a predetermined time period elapses, opening the second drain valve, and wherein when the light flush mode is executed, the first drain valve and the second drain valve are opened simultaneously or the first drain valve is opened and then the second drain valve is opened before the predetermined time period elapses.

12. The flush toilet device according to claim 11, wherein the operation unit is configured to open the first drain valve and then open the second drain valve when the full flush mode is executed, and is configured to open the first drain valve and the second drain valve substantially simultaneously when the light flush mode is executed.

13. The flush toilet device according to claim 12, wherein the operation unit includes a handle, the full flush mode is executed when the handle is rotated in a first direction, and the light flush mode is executed when the handle is rotated in a second direction opposite to the first direction.

14. The flush toilet device according to claim 12, wherein the operation unit includes a first button and a second button, the full flush mode is executed when the first button is pressed, and the light flush mode is executed when the second button is pressed.

15. The flush toilet device according to claim 11, wherein the hydraulic drive mechanism opens the second drain valve by using water supply pressure of flush water supplied from a tap water supply line to the flush water tank.

16. The flush toilet device according to claim 15, further comprising:

a ball tap including a float configured to operate in association with a water level in the flush water tank, wherein the ball tap is configured to supply the flush water to the hydraulic drive mechanism when the float has lowered to a predetermined position, when the full flush mode is executed by the operation unit, the float lowers as the water level in the flush water tank drops, starting supply of flush water to the hydraulic drive mechanism, and when the light flush mode is executed by the operation unit, the second drain valve is forced to open on the basis of operation of the operation unit before the float lowers to the predetermined position.

17. The flush toilet device according to claim 15, further comprising:

a ball tap including a float configured to operate in association with a water level in the flush water tank, wherein the ball tap is configured to supply flush water to the hydraulic drive mechanism when the float has lowered to a predetermined position, when the full flush mode is executed by the operation unit, the float lowers as the water level in the flush water tank drops, starting supply of the flush water to the hydraulic drive mechanism, and when the light flush mode is executed by the operation unit, the float is forced down on the basis of operation of the operation unit, starting supply of the flush water to the hydraulic drive mechanism.

18. The flush toilet device according to claim 17, wherein the operation unit includes a handle, the full flush mode is executed when the handle is rotated in a first direction, and the light flush mode is executed when the handle is rotated in a second direction opposite to the first direction.

19. The flush toilet device according to claim 17, wherein the operation unit includes a first button and a second button, the full flush mode is executed when the first button is pressed, and the light flush mode is executed when the second button is pressed.

* * * * *